US010035049B1

(12) United States Patent
Nielson et al.

(10) Patent No.: US 10,035,049 B1
(45) Date of Patent: Jul. 31, 2018

(54) GOLF CLUB HEAD

(71) Applicant: Taylor Made Golf Company, Inc, Carlsbad, CA (US)

(72) Inventors: Joseph R. Nielson, Vista, CA (US); Nathan T. Sargent, Oceanside, CA (US); Christopher J. Harbert, Carlsbad, CA (US); Christian R. Wester, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 26 days.

(21) Appl. No.: 15/255,638

(22) Filed: Sep. 2, 2016

Related U.S. Application Data

(63) Continuation-in-part of application No. 15/087,002, filed on Mar. 31, 2016.

(60) Provisional application No. 62/205,601, filed on Aug. 14, 2015.

(51) Int. Cl.
*A63B 53/04* (2015.01)
*A63B 53/06* (2015.01)

(52) U.S. Cl.
CPC .. *A63B 53/0466* (2013.01); *A63B 2053/0408* (2013.01); *A63B 2053/0412* (2013.01); *A63B 2053/0433* (2013.01); *A63B 2053/0491* (2013.01)

(58) Field of Classification Search
CPC ..... A63B 53/0466; A63B 2053/043; A63B 2053/0491; A63B 2053/0408; A63B 2053/0412
USPC ..... 473/324–350, 287–292
See application file for complete search history.

(56) References Cited

U.S. PATENT DOCUMENTS

| | | | | |
|---|---|---|---|---|
| 5,935,020 | A | 8/1999 | Stites et al. | |
| 6,402,639 | B1 * | 6/2002 | Iwata | A63B 53/0466 473/330 |
| 6,525,157 | B2 | 2/2003 | Cozewith et al. | |
| 6,572,489 | B2 * | 6/2003 | Miyamoto | A63B 53/0466 473/290 |
| 6,623,378 | B2 | 9/2003 | Beach et al. | |
| 6,716,114 | B2 * | 4/2004 | Nishio | A63B 53/04 473/314 |
| 6,773,360 | B2 | 8/2004 | Willett et al. | |

(Continued)

FOREIGN PATENT DOCUMENTS

EP 1923420 B1 2/2009

OTHER PUBLICATIONS

U.S. Appl. No. 15/259,026, filed Sep. 7, 2016.

*Primary Examiner* — Sebastiano Passaniti
(74) *Attorney, Agent, or Firm* — Kunzler, PC

(57) ABSTRACT

Described herein is a golf club head that includes a body that includes a sole portion, a crown portion, a skirt portion, a forward region, and a rearward region. The golf club head also includes a face portion including a striking face with a maximum height from the ground plane of at least about 50 mm. The golf club head has a peak crown height, from the ground plane, of at least about 60 mm. A volume of the golf club head is at least about 370 $cm^3$. A location of a center-of-gravity of the golf club head is at a minimum distance (Zup) away from the ground plane. The difference between Zup and half of the peak crown height is less than about −5.75 mm. A z-axis moment of inertia of the golf club head about a CG z-axis is greater than about 300 kg-$mm^2$.

23 Claims, 27 Drawing Sheets

(56) References Cited

U.S. PATENT DOCUMENTS 6,800,038 B2 10/2004 Willet et al.
6,824,475 B2 11/2004 Burnett et al.
6,855,068 B2 * 2/2005 Antonious ..... A63B 53/0466 473/327
6,969,326 B2 11/2005 De Shiell et al.
6,991,558 B2 1/2006 Beach et al.
6,997,820 B2 2/2006 Willet et al.
7,066,832 B2 6/2006 Willett et al.
7,083,529 B2 8/2006 Cackett et al.
7,140,974 B2 11/2006 Chao et al.
7,166,040 B2 1/2007 Hoffman
7,186,190 B1 3/2007 Beach et al.
7,223,180 B2 5/2007 Willet et al.
7,267,620 B2 9/2007 Chao et al.
7,407,447 B2 8/2008 Beach et al.
7,410,425 B2 8/2008 Willet et al.
7,410,426 B2 8/2008 Willet et al.
7,419,441 B2 9/2008 Hoffman et al.
7,448,963 B2 11/2008 Beach et al.
7,452,285 B2 11/2008 Chao et al.
7,513,296 B1 4/2009 Yu et al.
7,530,904 B2 5/2009 Beach et al.
7,540,811 B2 6/2009 Beach et al.
7,568,985 B2 8/2009 Beach et al.
7,578,753 B2 8/2009 Beach et al.
7,582,024 B2 * 9/2009 Shear ..... A63B 53/0466 473/329
7,591,738 B2 9/2009 Beach et al.
7,621,823 B2 11/2009 Beach et al.
7,628,707 B2 12/2009 Beach et al.
7,628,712 B2 12/2009 Chao et al.
7,632,194 B2 12/2009 Beach et al.
7,674,187 B2 3/2010 Cackett et al.
7,713,142 B2 5/2010 Hoffman et al.
7,717,804 B2 5/2010 Beach et al.
7,717,805 B2 5/2010 Beach et al.
7,731,603 B2 6/2010 Beach et al.
7,744,484 B1 6/2010 Chao
7,753,806 B2 * 7/2010 Beach ..... A63B 53/0466 473/334
RE41,577 E 8/2010 McLean G
7,775,905 B2 8/2010 Beach et al.
7,846,041 B2 12/2010 Beach et al.
7,850,546 B2 12/2010 Chao
7,871,340 B2 1/2011 Chao et al.
7,874,936 B2 1/2011 Chao
7,874,937 B2 1/2011 Chao
7,874,938 B2 1/2011 Chao
7,887,431 B2 2/2011 Beach et al.
7,887,440 B2 2/2011 Wright et al.
7,963,861 B2 6/2011 Beach et al.
RE42,544 E 7/2011 Chao et al.
7,985,146 B2 7/2011 Lin et al.
8,012,038 B1 9/2011 Beach et al.
8,012,039 B2 9/2011 Greaney et al.
8,025,587 B2 9/2011 Beach et al.
8,083,609 B2 12/2011 Burnett et al.
8,088,021 B2 1/2012 Albertsen et al.
8,096,897 B2 1/2012 Beach et al.
8,147,350 B2 4/2012 Beach et al.
8,163,119 B2 4/2012 Chao
8,235,831 B2 8/2012 Beach et al.
8,241,142 B2 * 8/2012 Evans ..... A63B 53/0466 473/345
8,241,143 B2 8/2012 Albertsen et al.
8,241,144 B2 8/2012 Albertsen et al.
8,262,498 B2 9/2012 Beach et al.
RE43,801 E 11/2012 Chao et al.
8,303,431 B2 11/2012 Beach et al.
8,337,319 B2 12/2012 Sargent et al.
8,353,786 B2 1/2013 Beach et al.
8,444,505 B2 5/2013 Beach et al.
8,550,936 B1 10/2013 Burnett et al.
8,597,137 B1 12/2013 Albertsen et al.
8,602,909 B1 12/2013 Burnett et al.
8,608,591 B2 12/2013 Chao et al.
8,622,847 B2 1/2014 Beach et al.
8,628,434 B2 1/2014 Chao
8,636,609 B2 1/2014 Chao et al.
8,734,269 B2 5/2014 Burnett et al.
8,734,271 B2 5/2014 Beach et al.
8,771,101 B2 7/2014 Albertsen et al.
8,777,773 B2 7/2014 Burnett et al.
8,801,541 B2 8/2014 Beach et al.
8,821,312 B2 * 9/2014 Burnett ..... A63B 53/0466 473/329
8,858,359 B2 10/2014 Willett et al.
8,870,678 B2 10/2014 Beach et al.
9,033,821 B2 5/2015 Beach et al.
9,095,752 B2 * 8/2015 Stites ..... A63B 53/04
9,174,096 B2 11/2015 Sargent et al.
9,174,099 B2 11/2015 Greaney et al.
9,220,956 B2 * 12/2015 Beach ..... A63B 53/0466
9,259,625 B2 2/2016 Sargent et al.
9,358,430 B2 * 6/2016 Greaney ..... A63B 53/04
9,566,482 B2 * 2/2017 Beach
9,643,065 B2 * 5/2017 Stites ..... A63B 53/04
9,675,849 B2 * 6/2017 Beach ..... A63B 53/0466
2004/0116207 A1 6/2004 De Shiell et al.
2005/0009622 A1 * 1/2005 Antonious ..... A63B 53/0466 473/327
2008/0149267 A1 6/2008 Chao
2009/0163289 A1 6/2009 Chao
2009/0163291 A1 6/2009 Chao et al.
2011/0152000 A1 6/2011 Sargent et al.
2011/0275451 A1 11/2011 Chao et al.
2011/0312437 A1 12/2011 Sargent et al.
2012/0071264 A1 3/2012 Beach et al.
2012/0071267 A1 * 3/2012 Burnett ..... A63B 53/0466 473/327
2012/0083361 A1 4/2012 Beach et al.
2012/0122601 A1 5/2012 Beach et al.
2012/0172143 A1 7/2012 Greaney et al.
2012/0172146 A1 7/2012 Greaney et al.
2012/0199282 A1 8/2012 Chao
2012/0205615 A1 8/2012 Beach et al.
2012/0258818 A1 10/2012 Beach et al.
2012/0289361 A1 11/2012 Beach et al.
2012/0316007 A1 * 12/2012 Burnett ..... A63B 53/0466 473/327
2013/0123040 A1 5/2013 Willet et al.
2013/0210542 A1 8/2013 Harbert et al.
2013/0225320 A1 8/2013 Woolley et al.
2014/0080622 A1 3/2014 Sargent et al.
2014/0080628 A1 3/2014 Sargent et al.
2014/0274457 A1 9/2014 Beach et al.
2014/0302946 A1 10/2014 Rae et al.
2015/0038262 A1 2/2015 DeShiell et al.
2016/0001146 A1 1/2016 Sargent et al.

* cited by examiner

GOLF CLUB HEAD

CROSS-REFERENCE TO RELATED APPLICATIONS

This application is a continuation-in-part of U.S. patent application Ser. No. 15/087,002, filed on Mar. 31, 2016, which application claims the benefit of U.S. Provisional Patent Application No. 62/205,601, filed on Aug. 14, 2015, both of which are incorporated herein by reference in their entireties.

FIELD

This disclosure relates generally to golf clubs, and more particularly to a head of a golf club with a comparatively low vertical positioning of a center of gravity of the golf club head relative to a crown height of the golf club head.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a club head coupled to a lower end of the shaft. Most modern versions of club heads are made, at least in part, from a lightweight but strong metal, such as a titanium alloy. In most cases, the golf club head is includes a hollow body to which a face plate, or face portion, is attached or integrally formed. The face portion has a front surface, known as a striking face, configured to contact the golf ball during a proper golf swing.

Center-of-gravity (CG) and mass moments of inertia critically affect a golf club head's performance, such as launch angle and flight trajectory on impact with a golf ball, among other characteristics.

A mass moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing distance of a mass from a given axis results in an increased moment of inertia of the mass about that axis. Higher golf club head moments of inertia result in lower golf club head rotation on impact with a golf ball, particularly on "off-center" impacts with a golf ball, e.g., mis-hits. Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Most fairway wood club heads are intended to hit the ball directly from the ground, e.g., the fairway, although many golfers also use fairway woods to hit a ball from a tee. Accordingly, fairway woods are subject to certain design constraints to maintain playability. For example, compared to typical drivers, which are usually designed to hit balls from a tee, fairway woods often have a relatively shallow head height, providing a relatively lower center of gravity and a smaller top view profile for reducing contact with the ground. Such fairway woods inspire confidence in golfers for hitting from the ground. Also, fairway woods typically have a higher loft than most drivers, although some drivers and fairway woods share similar lofts. For example, most fairway woods have a loft greater than or equal to about 13 degrees, and most drivers have a loft between about 7 degrees and about 15 degrees.

Faced with constraints such as those just described, golf club manufacturers often must choose to improve one performance characteristic at the expense of another. For example, some conventional golf club heads offer increased moments of inertia to promote forgiveness while at the same time incurring a higher than desired CG-position and increased club head height. Club heads with high CG and/or large height might perform well when striking a ball positioned on a tee, such is the case with a driver, but not when hitting from the turf. Thus, conventional golf club heads that offer increased moments of inertia for forgiveness often do not perform well as a fairway wood club head.

Although traditional fairway wood club heads generally have a low CG relative to most traditional drivers, such clubs usually also suffer from correspondingly low mass moments of inertia. In part due to their relatively low CG, traditional fairway wood club heads offer acceptable launch angle and flight trajectory when the club head strikes the ball at or near the ideal impact location on the ball striking face. But because of their low mass moments of inertia, traditional fairway wood club heads are less forgiving than club heads with high moments of inertia, which heretofore have been drivers. As already noted, conventional golf club heads that have increased mass moments of inertia, and thus are more forgiving, have a relatively high CG.

Accordingly, to date, golf club designers and manufacturers have not offered golf club heads with high moments of inertia for improved forgiveness and low center-of-gravity.

A continual challenge to improving performance in woods is generating ballspeed. In addition to the center of gravity and center of gravity projection, the geometry of the face and clubhead play a major role in determining initial ball velocity.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

The golf club heads described herein may include a driver-type golf club heads with a relatively large striking face area of at least 3500 mm^2, preferably at least 3800 mm^2, and even more preferably at least 3900 mm^2. Additionally, the driver-type golf club heads may include a center of gravity (CG) projection proximate center face that may be at most 3 mm above or below center face, and preferably may be at most 1 mm above or below center face as measured along a vertical axis (z-axis). Moreover, the driver-type golf club heads may have a relatively high moment of inertia about the vertical z-axis e.g. Izz>350 kg-mm^2 and preferably Izz>400 kg-mm^2, a relatively high moment of inertia about the horizontal x-axis e.g. Ixx>200 kg-mm^2 and preferably Ixx>250 kg-mm^2, and preferably a ratio of Ixx/Izz>0.55.

A club head exhibiting the above features is difficult to design because the above parameters are often competing and lead to various problems and unintended consequences such that maximizing one parameter often penalizes another parameter. For example, increasing the striking face area increases the drag on the club head creating an aerodynamic penalty. The aerodynamic penalty may be solved by increasing the peak crown height of the club head relative to the face height such that a peak crown height to face height ratio is at least 1.12 or more. However, this may help reduce the aerodynamic penalty, but raises the CG of club head causing the CG to project high on the face and well above center face.

Importantly, the CG projection is typically the ideal impact location to maximize ball speed and ideally the CG projection and center face coincide or are at least proximate one another. However, for most club heads to date the CG projection and center face do not coincide and are nowhere near coinciding, the delta between the two is often more than 4 mm. A high CG projection that is well above center face is a ball speed penalty causing a loss in distance. Unfortunately, most driver-type golf club heads suffer from a high CG projection and especially those regarded as aerodynamic due to the increased mass above center face. An additional problem created by a high CG projection is that a ball struck at center face will have increased backspin due to gear effect, which also causes a loss in distance. Another problem with a high CG projection is the CG projection is closer to the face to crown transition which is a very stiff portion of the face. Similarly, a high CG projection projects above the most flexible portion of the face resulting in a coefficient of restitution (COR) penalty. Accordingly, the additional crown mass located above the face to achieve an aerodynamic club head is a CG penalty, ball speed penalty, a spin penalty, and a COR penalty.

The multiple embodiments described below solve the above identified problems while achieving a golf club head with a relatively large striking face area, a CG projection proximate center face, and a relatively high moment of inertia about the x-axis and z-axis. Additionally, solving the above problems led to the unexpected discovery of the importance of Zup (an overlooked parameter in the design of driver-type golf club heads) relative to half the peak crown height (half head height). Zup measures the center of gravity relative to the ground plane along a vertical axis when the club head is in the address position. Zup is an important consideration in the design of fairway woods and irons because these clubs are used to strike golf balls resting on the ground. However, Zup is generally regarded as irrelevant to and not considered at all in designing driver-type golf club heads because these club heads are used to strike golf balls resting on a tee.

Another unexpected discovery was the importance of half head height, and measuring various parameters relative to half head height. Up to this point, the inventors in designing driver-type golf club heads had measured most parameters relative to center face. However, in designing a driver-type golf club head placement of center face can be manipulated and more importantly center face may be difficult to consistently locate when measuring a physical golf club head. Whereas head height and half head height are more readily measured on a physical golf club head.

Realizing the importance of half head height led to a further unexpected discovery, which was the importance of measuring CG projection relative to half head height rather than center face. The inventors also discovered that the club head and its variations were in unchartered territory with respect to Zup relative to half head height, CG projection relative to half head height, and other parameters relative to half head height because no other club heads exhibited these unique parameters to their knowledge. As stated above, the embodiments described below solve the above identified problems while achieving a golf club head with a relatively large striking face area, a CG projection proximate center face, and a relatively high moment of inertia about the x-axis and z-axis.

A golf club head is disclosed herein. The golf club head includes a body, defining an interior cavity. The body includes a sole portion, positioned at a bottom portion of the golf club head, a crown portion, positioned at a top portion of the golf club head, a skirt portion, positioned around a periphery of the golf club head between the sole portion and the crown portion, a forward region, and a rearward region. An entirety of an exterior surface of the crown portion may be convex. The golf club head also includes a face portion, coupled to the body at the forward region of the body and including a striking face with an area of at least 3500 mm^2 and a maximum height from the ground plane, when the golf club head is in an address position on a ground plane, of at least about 50 mm. There is a face-to-crown transition where the face portion connects to the crown portion proximate the forward region of the body and a skirt-to-crown transition where the skirt portion connects to the crown portion proximate the rearward region. In a y-z plane passing through a club head origin the crown height continuously increases starting from the face-to-crown transition up to a local maximum. In some implementations, in a y-z plane passing through a head origin, at a distance delta 1 from the head origin, the crown height can be greater than the face height. According to certain implementations, in a y-z plane passing through the head origin, the skirt-to-crown transition proximate the rearward region or a trailing edge of the golf club head, can be lower than the club head CG. When the golf club head is in the address position on the ground plane, the golf club head has a peak crown height, from the ground plane, of at least about 60 mm. A volume of the golf club head may be at least about 370 $cm^3$. When the golf club head is in the address position on the ground plane, a location of a center-of-gravity of the golf club head is at a minimum distance (Zup) away from the ground plane. The difference between Zup and half of the peak crown height may be less than about −5.75 mm. When the golf club head is in the address position on the ground plane, a z-axis moment of inertia of the golf club head about a z-axis, passing through the center-of-gravity of the golf club head and perpendicular to the ground plane, may be greater than about 300 kg-$mm^2$. The preceding subject matter of this paragraph characterizes example 1 of the present disclosure.

The difference between Zup and half of the peak crown height may be less than about −6.0 mm. The preceding subject matter of this paragraph characterizes example 2 of the present disclosure, wherein example 2 also includes the subject matter according to example 1, above.

Zup may be less than about 27.5 mm. The preceding subject matter of this paragraph characterizes example 3 of the present disclosure, wherein example 3 also includes the subject matter according to any one of examples 1 or 2, above.

An entirety of the body may be made from titanium. More than about 70% of the crown portion of the body has a thickness less than about 0.75 mm. The preceding subject matter of this paragraph characterizes example 4 of the present disclosure, wherein example 4 also includes the subject matter according to any one of examples 1-3, above.

The crown portion of the body may be made from a first material. At least one of the sole portion or the skirt portion of the body are made from a second material, different from the first material. More than about 70% of the crown portion of the body has a thickness less than about 0.75 mm. The preceding subject matter of this paragraph characterizes example 5 of the present disclosure, wherein example 5 also includes the subject matter according to any one of examples 1-3, above.

The first material may be a fiber-reinforced polymer. The preceding subject matter of this paragraph characterizes example 6 of the present disclosure, wherein example 6 also includes the subject matter according to example 5, above.

The second material may be titanium. The preceding subject matter of this paragraph characterizes example 7 of the present disclosure, wherein example 7 also includes the subject matter according to example 6, above.

An overall forward-to-rearward depth of the golf club head may be greater than about 85 mm. The preceding subject matter of this paragraph characterizes example 8 of the present disclosure, wherein example 8 also includes the subject matter according to any one of examples 1-7, above.

An overall forward-to-rearward depth of the golf club head may be greater than about 110 mm. The preceding subject matter of this paragraph characterizes example 9 of the present disclosure, wherein example 9 also includes the subject matter according to any one of examples 1-8, above.

When the golf club head is in the address position on the ground plane, a minimum height from the ground plane to a center of the striking face of the face portion may be at least about 28 mm. The preceding subject matter of this paragraph characterizes example 10 of the present disclosure, wherein example 10 also includes the subject matter according to any one of examples 1-9, above A crown height of the golf club head from the ground plane, when the golf club head is in the address position on the ground plane, at a forwardmost point of the crown portion of the body may be less than 54.8 mm. The preceding subject matter of this paragraph characterizes example 11 of the present disclosure, wherein example 11 also includes the subject matter according to any one of examples 1-9, above.

A head origin y-axis coordinate of the peak crown height may be less than about 20 mm. The preceding subject matter of this paragraph characterizes example 12 of the present disclosure, wherein example 12 also includes the subject matter according to any one of examples 1-11, above.

When the golf club head is in the address position on the ground plane, a maximum crown height of the golf club head, at a first location with a head origin y-axis coordinate of zero, may be less than 65 mm, a maximum crown height of the golf club head, at a second location with a head origin y-axis coordinate of 20 mm, may be more than about 62 mm, and a maximum crown height of the golf club head, at a third location with a head origin y-axis coordinate of 90 mm, may be less than about 32 mm. The preceding subject matter of this paragraph characterizes example 13 of the present disclosure, wherein example 13 also includes the subject matter according to any one of examples 1-12, above.

An overall mass of the golf club head may be between about 195 grams and about 205 grams. The preceding subject matter of this paragraph characterizes example 14 of the present disclosure, wherein example 14 also includes the subject matter according to any one of examples 1-13, above.

The golf club head has a discretionary mass of at least about 5 grams. The preceding subject matter of this paragraph characterizes example 15 of the present disclosure, wherein example 15 also includes the subject matter according to any one of examples 1-14, above.

A ratio of the peak crown height to a height of a forwardmost point of the crown portion from the ground plane, when the golf club head is in the address position on the ground plane, may be greater than about 1.12. A ratio of the peak crown height to a height of a rearwardmost point of the crown portion from the ground plane, when the golf club head is in the address position on the ground plane, may be greater than about 3.3. The preceding subject matter of this paragraph characterizes example 16 of the present disclosure, wherein example 16 also includes the subject matter according to any one of examples 1-15, above.

A crown height, in millimeters, of at least about 90% of the crown portion of the golf club head along a plane passing through a center of the striking face of the face portion and perpendicular to the ground plane, when the golf club head is in the address position on the ground plane, may be approximately between, $-130.73x^4+270.76x^3-269.99x^2+91.737x+59$ and $-107.96x^4+223.87x^3-250.86x^2+92.751x+50$, where x is a normalized forward-to-rearward depth of the crown portion of the golf club head. The preceding subject matter of this paragraph characterizes example 17 of the present disclosure, wherein example 17 also includes the subject matter according to any one of examples 1-16, above.

The crown height, in millimeters, of at least about 95% of the crown portion of the golf club head along the plane passing through the center of the striking face of the face portion and perpendicular to the ground plane, when the golf club head is in the address position on the ground plane, may be approximately between, $-130.73x^4+270.76x^3-269.99x^2+91.737x+59$ and $-107.96x^4+223.87x^3-250.86x^2+92.751x+50$, where x is the normalized forward-to-rearward depth of the crown portion of the golf club head. The preceding subject matter of this paragraph characterizes example 18 of the present disclosure, wherein example 18 also includes the subject matter according to example 17, above.

The crown height, in millimeters, of at least about 95% of the crown portion of the golf club head along the plane passing through the center of the striking face of the face portion and perpendicular to the ground plane, when the golf club head is in the address position on the ground plane, may be approximately between, $-130.73x^4+270.76x^3-269.99x^2+91.737x+59$ and $-107.96x^4+223.87x^3-250.86x^2+92.751x+50$, where x is the normalized forward-to-rearward depth of the crown portion of the golf club head. The preceding subject matter of this paragraph characterizes example 19 of the present disclosure, wherein example 19 also includes the subject matter according to example 18, above.

A crown height, in millimeters, of at least about 90% of the crown portion of the golf club head along a plane passing through a center of the striking face of the face portion and perpendicular to the ground plane, when the golf club head is in the address position on the ground plane, may be approximately between, $-29.988x^4+75.323x^3-141.81x^2+58.102x+60$ and $-107.96x^4+223.87x^3-250.86x^2+92.751x+50$, where x is a normalized forward-to-rearward depth of the crown portion of the golf club head. The preceding subject matter of this paragraph characterizes example 20 of the present disclosure, wherein example 20 also includes the subject matter according to any one of examples 1-19, above.

The crown height, in millimeters, of at least about 95% of the crown portion of the golf club head along the plane passing through the center of the striking face of the face portion and perpendicular to the ground plane, when the golf club head is in the address position on the ground plane, may be approximately between, $-29.988x^4+75.323x^3-141.81x^2+58.102x+60$ and $-107.96x^4+223.87x^3-250.86x^2+92.751x+50$, where x is the normalized forward-to-rearward depth of the crown portion of the golf club head. The preceding subject matter of this paragraph characterizes example 21 of the present disclosure, wherein example 21 also includes the subject matter according to example 20, above.

The crown height, in millimeters, of 100% of the crown portion of the golf club head along the plane passing through the center of the striking face of the face portion and perpendicular to the ground plane, when the golf club head is in the address position on the ground plane, may be approximately between, $-29.988x^4+75.323x^3-141.81x^2+58.102x+60$ and $-107.96x^4+223.87x^3-250.86x^2+92.751x+50$, where x is the normalized forward-to-rearward depth of the crown portion of the golf club head. The preceding subject matter of this paragraph characterizes example 22 of the present disclosure, wherein example 22 also includes the subject matter according to example 21, above.

The golf club head further includes a sliding weight track including at least one ledge extending within the sliding weight track and a weight installation channel located along a useable portion of the sliding weight track. Also, the golf club head includes at least one weight member movably positioned within the sliding weight track and configured to clamp the at least one ledge at two or more positions along the sliding weight track. Movement of the at least one weight member produces a change in a head origin z-axis coordinate of a center-of-gravity of the golf club head of less than about 1.0 mm throughout the adjustability range of the at least one weight member. The preceding subject matter of this paragraph characterizes example 23 of the present disclosure, wherein example 23 also includes the subject matter according to any one of examples 1-22, above.

The golf club head further includes a coefficient of restitution (COR) feature located on the sole portion of the body. The preceding subject matter of this paragraph characterizes example 24 of the present disclosure, wherein example 24 also includes the subject matter according to any one of examples 1-23, above.

The COR feature may be a channel. The preceding subject matter of this paragraph characterizes example 25 of the present disclosure, wherein example 25 also includes the subject matter according to example 24, above.

The COR feature may be a through slot. The preceding subject matter of this paragraph characterizes example 26 of the present disclosure, wherein example 26 also includes the subject matter according to example 24, above.

When the golf club head is in the address position on the ground plane, the golf club head has a peak crown height, from the ground plane, of no more than 67 mm. The preceding subject matter of this paragraph characterizes example 27 of the present disclosure, wherein example 27 also includes the subject matter according to any one of examples 1-26, above.

When the golf club head is in the address position on the ground plane, the golf club head has a crown height no less than 11 mm measured from the ground plane at a midplane of the golf club head. The preceding subject matter of this paragraph characterizes example 28 of the present disclosure, wherein example 28 also includes the subject matter according to any one of examples 1-27, above.

When the golf club head is in the address position on the ground plane, the golf club head has a minimum crown height less than 20 mm measured from the ground plane at the midplane of the golf club head. The preceding subject matter of this paragraph characterizes example 29 of the present disclosure, wherein example 29 also includes the subject matter according to example 28, above.

Disclosed herein is a golf club that includes a head that has a body. The body defines an interior cavity and includes a sole portion, positioned at a bottom portion of the head, a crown portion, positioned at a top portion of the head, a skirt portion, positioned around a periphery of the head between the sole portion and the crown portion, a forward region, and a rearward region. The crown portion does not include a point of inflection. The head also includes a face portion, coupled to the body at the forward region of the body and including a striking face with an area of at least 3500 mm^2 and a maximum height from the ground plane, when the head is in an address position on a ground plane, of at least about 50 mm. When the head is in the address position on the ground plane, the head has a peak crown height, from the ground plane, of at least about 62 mm. A volume of the head may be at least about 370 $cm^3$. When the head is in an address position on a ground plane, a location of a center-of-gravity of the head is at a minimum distance (Zup) away from the ground plane. The difference between Zup and half of the peak crown height may be less than about −5.75 mm. When the head is in the address position on the ground plane, a z-axis moment of inertia of the head about a z-axis, passing through the center-of-gravity of the head and perpendicular to the ground plane, may be greater than about 300 kg-$mm^2$. The golf club also includes a shaft, coupled to the head, and a grip, coupled to the shaft. The preceding subject matter of this paragraph characterizes example 30 of the present disclosure.

An orientation of the shaft relative to the head may be selectively adjustable. The preceding subject matter of this paragraph characterizes example 31 of the present disclosure, wherein example 31 also includes the subject matter according to example 30, above.

A length of the shaft may be between about 45 inches and about 48 inches. The preceding subject matter of this paragraph characterizes example 32 of the present disclosure, wherein example 32 also includes the subject matter according to any one of examples 30-31, above.

Also disclosed herein is a golf club head that includes a body, a coefficient of restitution feature (COR), and a face portion. The body defines an interior cavity and includes a sole portion, positioned at a bottom portion of the golf club head, a crown portion, positioned at a top portion of the golf club head, a skirt portion, positioned around a periphery of the golf club head between the sole portion and the crown portion, a forward region, and a rearward region. An entirety of an exterior surface of the crown portion may be convex. The COR feature may be located on the sole portion of the body of the golf club head. The face portion may be coupled to the body at the forward region of the body and includes a striking face with an area of at least 3500 mm^2 and a maximum height from the ground plane, when the golf club head is in an address position on a ground plane, of at least about 52 mm. When the golf club head is in the address position on the ground plane, the golf club head has a peak crown height, from the ground plane, of at least about 62 mm. A volume of the golf club head may be at least about 370 $cm^3$. When the golf club head is in the address position on the ground plane, a location of a center-of-gravity of the golf club head is at a minimum distance (Zup) away from the ground plane. The difference between Zup and half of the peak crown height may be less than about −5.75 mm. When the golf club head is in the address position on the ground plane, a z-axis moment of inertia of the golf club head about a z-axis, passing through the center-of-gravity of the golf club head and perpendicular to the ground plane, may be greater than about 300 kg-$mm^2$. The preceding subject matter of this paragraph characterizes example 33 of the present disclosure.

The COR feature may be a through-slot. The preceding subject matter of this paragraph characterizes example 34 of the present disclosure, wherein example 34 also includes the subject matter according to example 33, above.

The COR feature may be a channel. The preceding subject matter of this paragraph characterizes example 35 of the present disclosure, wherein example 35 also includes the subject matter according to example 33, above.

The golf club head also includes at least one ledge extending within channel, at least one weight member movably positioned within the channel and configured to clamp the at least one ledge at two or more positions along the channel, and a weight installation cavity located along a portion of the channel where the at least one ledge may be clamped by the weight member. Movement of the at least one weight member produces a change in a head origin z-axis coordinate of a center-of-gravity of the golf club head of less than 1.0 mm throughout the adjustability range of the at least one weight member. The preceding subject matter of this paragraph characterizes example 36 of the present disclosure, wherein example 36 also includes the subject matter according to example 35, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The following describes embodiments of golf club heads in the context of a driver-type golf club, but the principles, methods and designs described may be applicable in whole or in part to fairway woods, utility clubs (also known as hybrid clubs) and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 13:
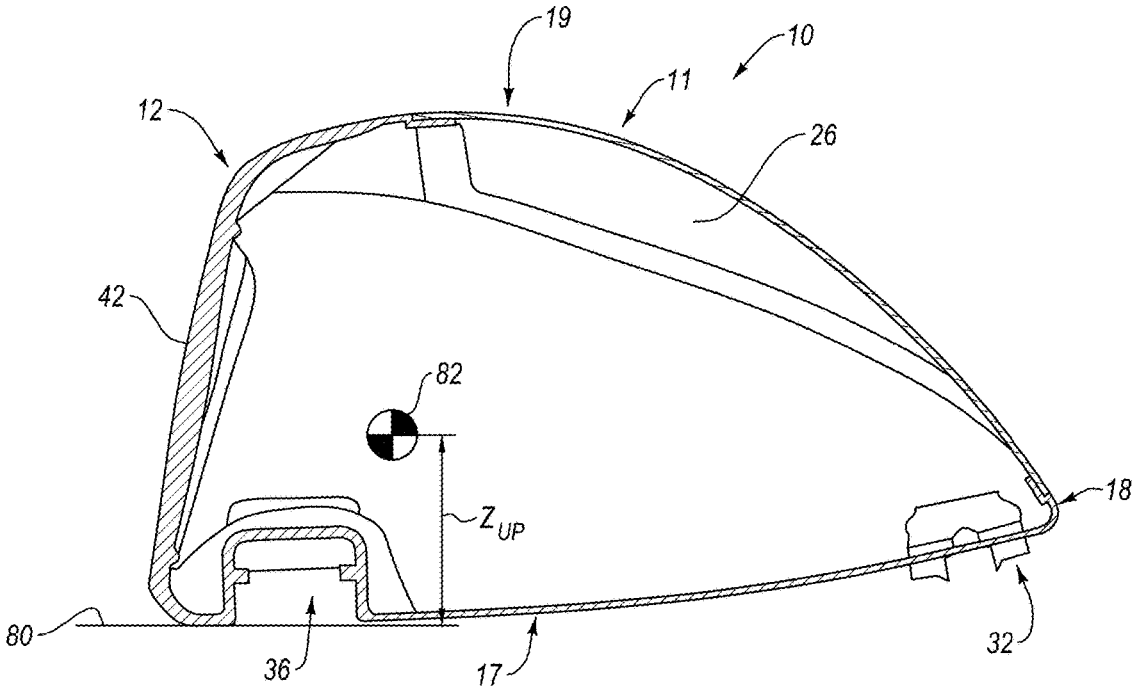
FIG. 13 is a cross-sectional side elevation view of the golf club head of FIG. 11, taken along a longitudinal midplane of the golf club head, according to one or more examples of the present disclosure.
Figure 14:
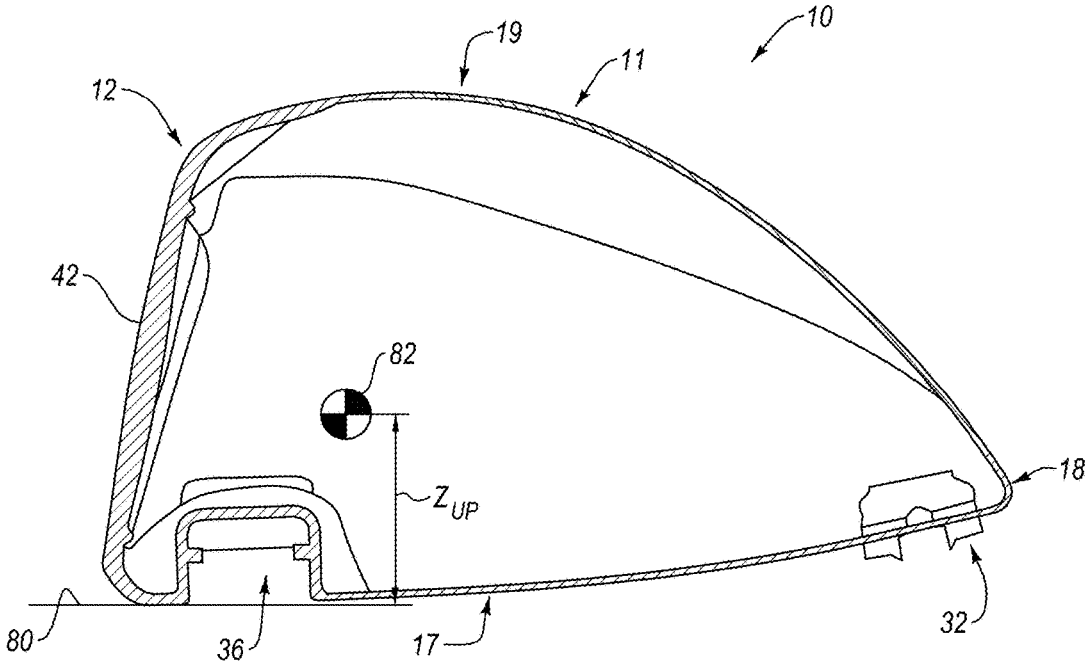
FIG. 14 is a cross-sectional side elevation view of yet another golf club head, taken along a longitudinal midplane of the golf club head, according to one or more examples of the present disclosure.
Figure 15:
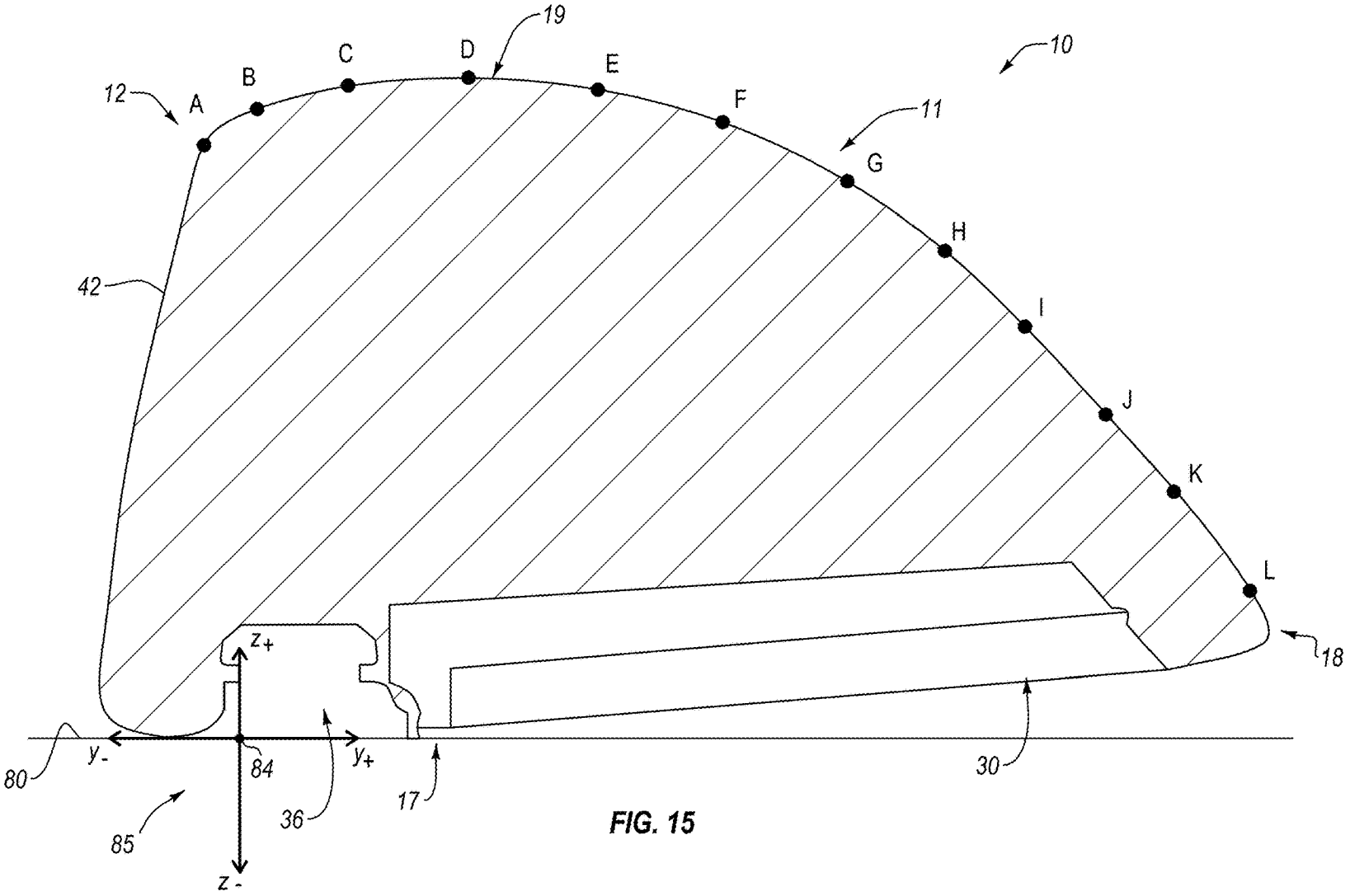
FIG. 15 is a cross-sectional side elevation view of an outer periphery of another golf club head, taken along a longitudinal midplane of the golf club head, according to one or more examples of the present disclosure.

FIGS. 11-16 are examples that show a club head in the address position i.e. the club head is positioned such that the hosel axis is at a 60 degree lie angle relative to a ground plane and the club face is square relative to an imaginary target line. As shown in FIG. 15, positioning the club head in the reference position lends itself to using a club head origin coordinate system 85 for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 85.

In one example, a golf club head 10 is shown in FIGS. 1-10. The golf club head 10 includes a body 11 and a face portion 42 coupled to the body 11. Furthermore, the golf club head 10 defines a toe region 14 and a heel region 16, opposite the toe region 14. The body 11 of the golf club head 10 includes a forward region 12 and a rearward region 18, opposite the forward region 12. The face portion 42 is coupled to the body 11 at the forward region 12 of the body 11. The body 11 of the golf club head 10 additionally includes a sole portion 17, defining a bottom of the golf club head 10, and a crown portion 19, opposite the sole portion 17 and defining a top of the golf club head 10. Also, the body 11 of the golf club head 10 includes a skirt portion 21 that defines a transition region where the body 11 of the golf club head 10 transitions between the crown portion 19 and the sole portion 17. Accordingly, the skirt portion 21 is located between the crown portion 19 and the sole portion 17.

Figure 17:
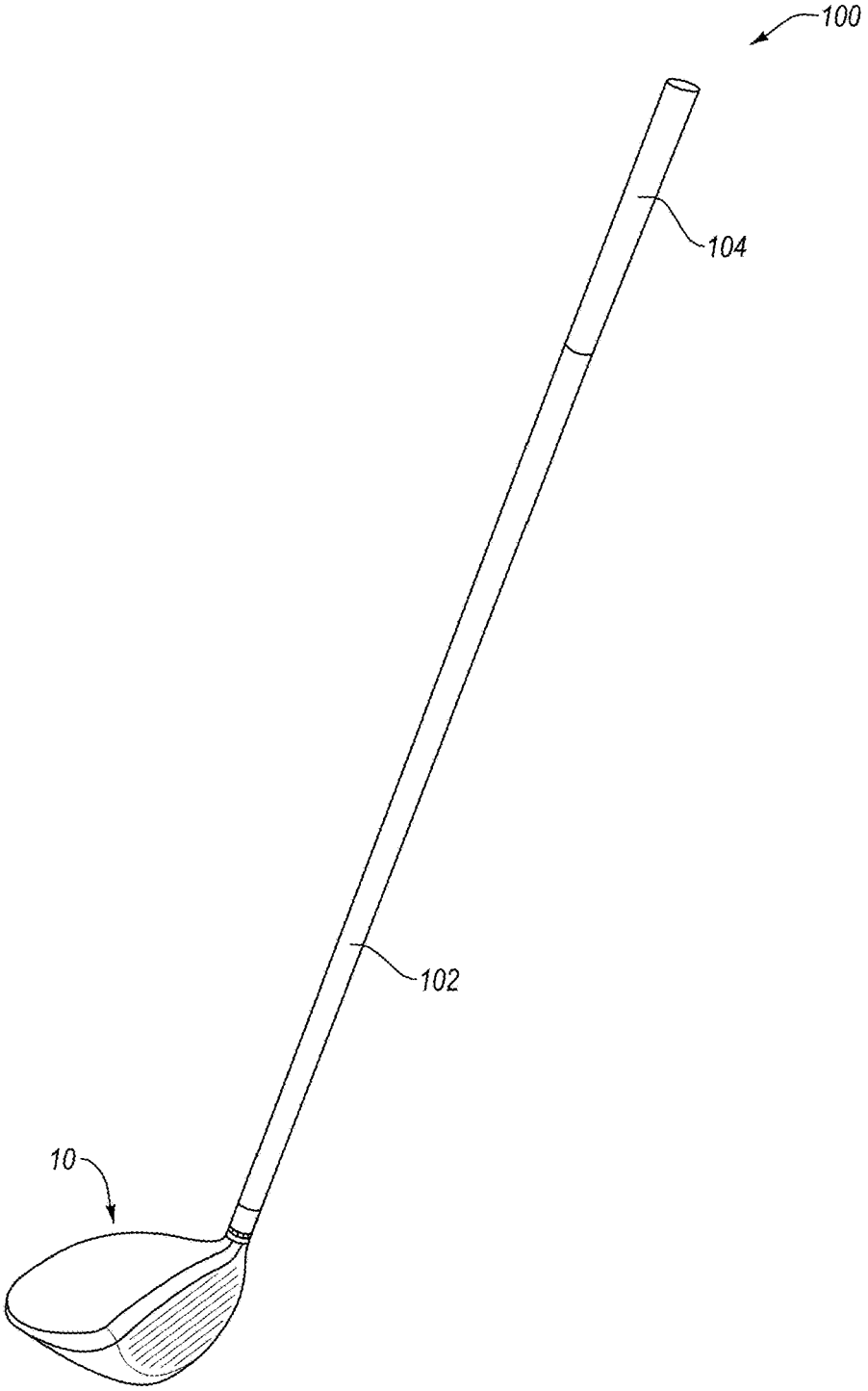
FIG. 17 is a perspective view of a golf club, according to one or more examples of the present disclosure.

The golf club head 10 also includes a hosel 20 extending from the heel region 16 of the golf club head 10. As shown in FIG. 17, a shaft 102 of a golf club 100 may be attached directly to the hosel 20 or, alternatively, attached indirectly to the hosel 20, such as via a flight control technology (FCT) component 22 (e.g., an adjustable lie/loft assembly) coupled with the hosel 20 (see, e.g., FIG. 2). The golf club 100 also includes a grip 104 fitted around a distal end or free end of the shaft 102. The grip 104 of the golf club 100 helps promote the handling of the golf club 100 by a user during a golf swing. The golf club head 100 includes a hosel axis 91, which is coaxial with the shaft 102, defining a central axis of the hosel 20.

In some embodiments, such as shown in FIGS. 1-10, the body 11 of the golf club head 10 includes a frame 24 to which one or more inserts of the body 11 are coupled. For example, the crown portion 19 of the body 11 includes a crown insert 26 coupled to a top side of the frame 24. Similarly, the sole portion 17 of the body 11 includes a sole insert 28 coupled to a bottom side of the frame 24. The golf club head 10 also includes a rear weight track 30 (or rearward weight track 30 or front-to-rear weight track 30) located in the sole portion 17 of the body 11 of the golf club head 10. The rear weight track 30 defines a track to which a weight 32 (or weight assembly 32) is slidably mounted. In some implementations, the weight 32 is slidably mounted to the rear weight track 30 with fastening means, such as a screw 34. In some implementations, the weight 32 has a multi-piece design. For example, the weight 32 may have first and second weight elements 32*a*, 32*b* coupled together to form the weight 32. In some implementations, the weight 32 may be secured to the rear weight track 30 by clamping a portion of the track, such as at least one ledge, such that the fastening means is put in tension i.e. a tension system. Additionally or alternatively, the weight 32 may be secured to the rear weight track 30 by compressing against a portion of the track such that the fastening means is put in compression i.e. a compression system. However, the weight 32 can take forms other than as shown, such as a single-piece design, and can be movably mounted to the rear weight track 30 in ways other than as shown. The rear weight track 30 allows the weight 32 to be selectively loosened and tightened for slidable adjustment forward and rearward along the weight track to adjust the effective CG 82 (see, e.g., FIGS. 9 and 10) of the golf club head is in a forward-to-rearward direction. By adjusting the CG 82 of the golf club head 10 forward or rearward, the performance characteristics of the golf club head 10 are adjusted, which promotes an adjustment to the flight characteristics of a golf ball struck by the golf club head 10, such as the topspin and backspin characteristics of the golf ball.

Figure 18:
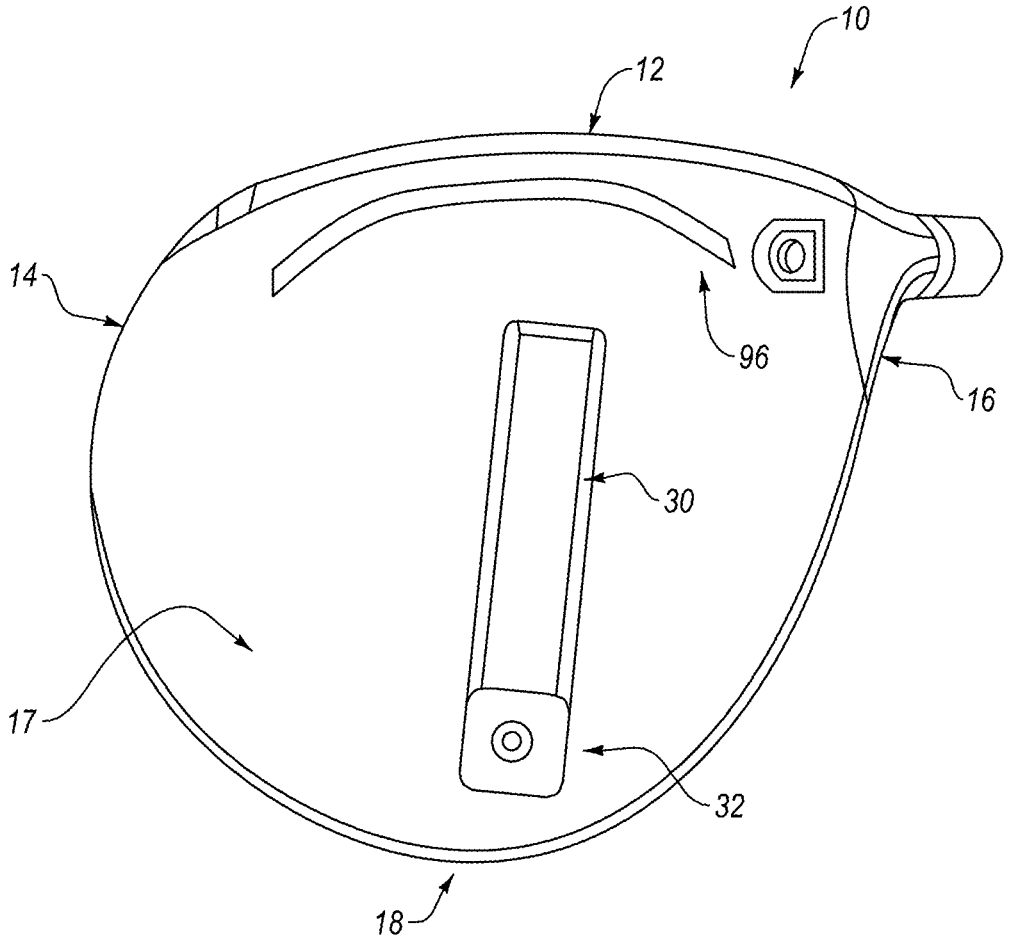
FIG. 18 is a bottom view of another golf club head, according to one or more examples of the present disclosure.
Figure 19:
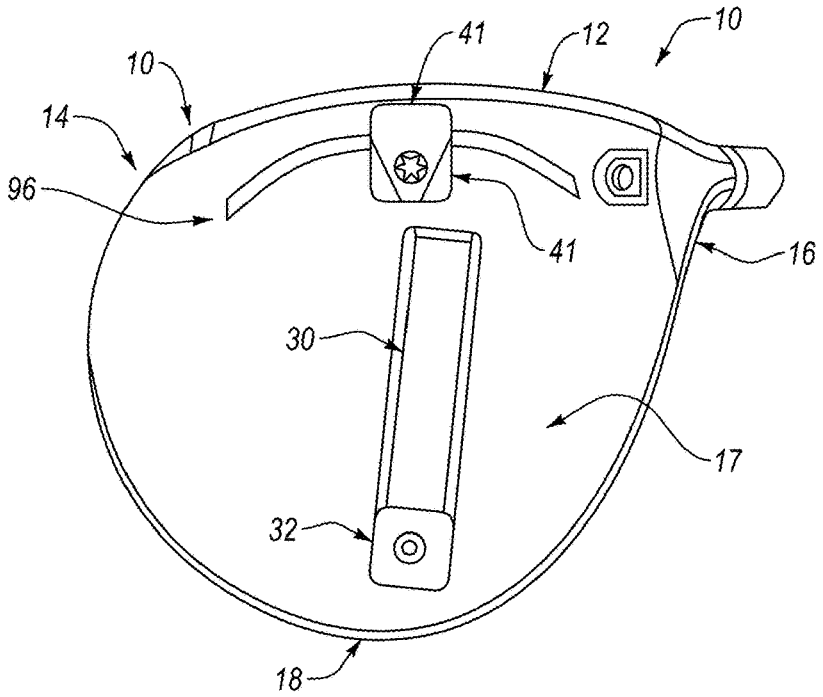
FIG. 19 is a bottom view of yet another golf club head, according to one or more examples of the present disclosure.
Figure 20:
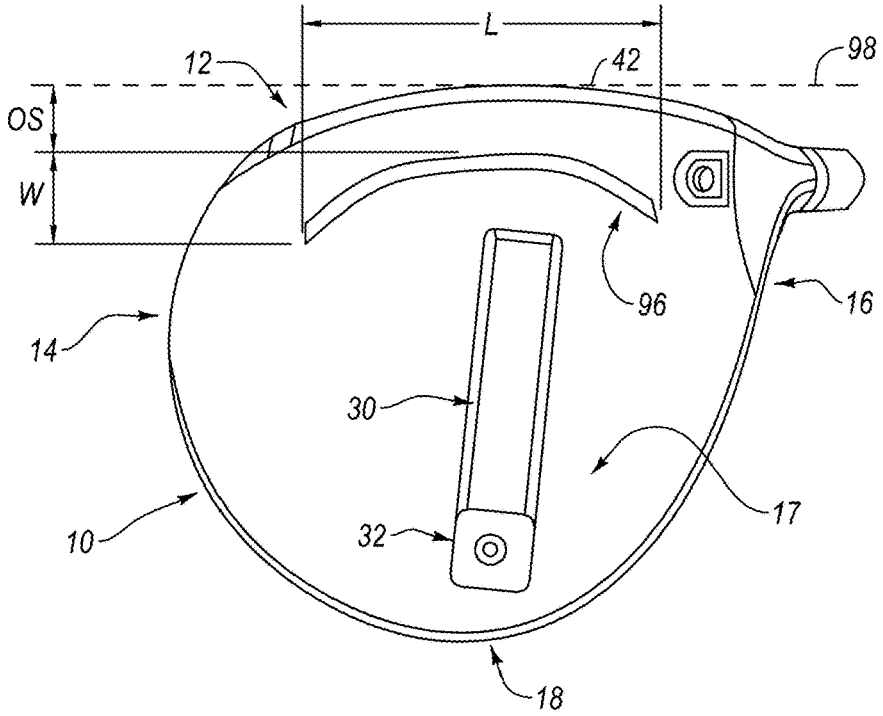
FIG. 20 is a bottom view of the golf club head of FIG. 18, indicating various dimensions associated with a coefficient of restitution (COR) feature of the golf club head, according to one or more examples of the present disclosure.

In some embodiments, as shown in FIGS. 18-20, the rear weight track 30 may be at an angle relative to a midplane of the golf club head 10, as defined below. The particular angle of the rear weight track 30 would depend on the geometry of the golf club head 10. In some embodiments, angling the track 30 may help reduce any draw or fade bias compared to a track parallel the y-axis of golf club head especially when shifting the weight along the rearward track. The angle of the rearward track 30 may be between about 0 degrees and about 180 degrees, such as between about 20 degrees and about 160 degrees, such as between about 40 degrees and about 140 degrees, such as between about 60 degrees and about 120 degrees, such as between about 70 degrees and about 110 degrees.

As discussed in more detail below, a rear weight track 30 provides a user with additional adjustability. Moving the weight closer to the striking face may produce a lower spinning ball due to a lower and more forward CG. This would also allow a user to increase club head loft, which in general higher lofted clubs are considered to be "easier" to hit. Moving the weight rearward towards the rear of the club allows for increased MOI and a higher spinning ball. Clubs with higher MOI are generally considered "easier" to hit. Accordingly, the rear weight track 30 allows for at least both spin and MOI adjustment.

As shown, the rear weight track 30 may include at least one weight assembly in any of various positions along the rear weight track 30, such as forward or rearward. More than one weight may be used in any one of the positions and/or there may be several weight ports strategically placed on the club head body. For example, the golf club head 10 may include a toe weight port and a heel weight port. A user could then move more weight to either the toe or heel to promote either a draw or fade bias. Additionally, splitting discretionary weight between a forward and rearward position produces a higher MOI club, whereas moving all the weight to the forward portion of the club produces a golf club with a low and forward CG. Accordingly, a user could select between a "forgiving" higher MOI club, or a club that produces a lower spinning ball.

Figure 2:
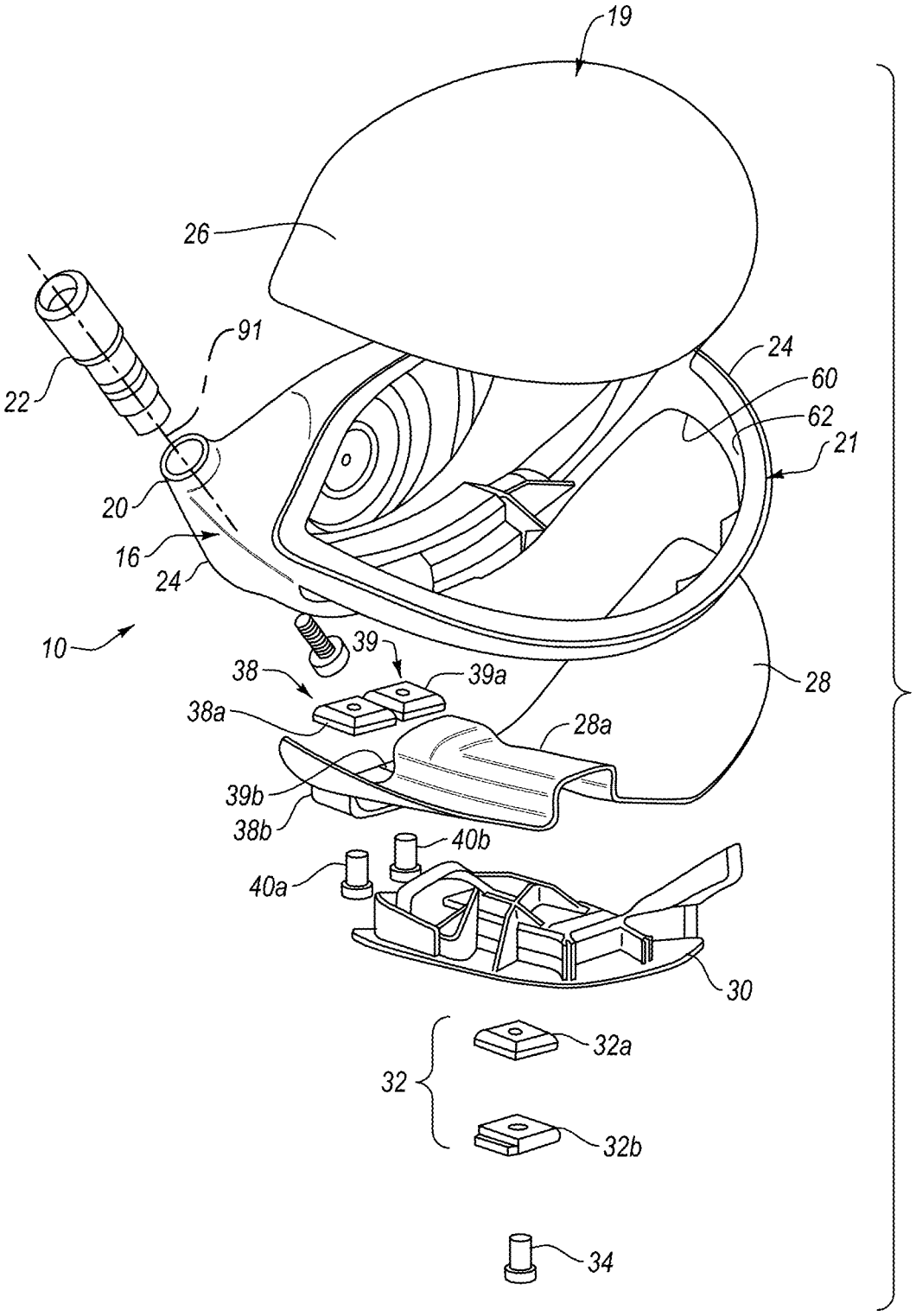
FIG. 2 is an exploded perspective view from a top of the golf club head of FIG. 1, according to one or more examples of the present disclosure.

Referring to FIG. 2, the frame 24 of the body 11 includes a forward or lateral weight track 36 (or forward or lateral channel 36) integrally formed with the frame 24 at the forward region 12 and along the sole portion 17 of the body 11. The lateral weight track 36 extends generally parallel to, but offset from, the face portion 42 of the golf club head 10 and generally perpendicular to the weight track 30. The lateral weight track 36 defines a track or port to which at least one weight may be slidably mounted. In one example, as shown in FIG. 2, the weight includes a first weight 38 (or weight assembly 38) having two pieces 38*a*, 38*b*, and a second weight 39 (or weight assembly 39) having two pieces 39*a*, 39*b*. Each of the first and second weights 38, 39 are fastened by fastening means, such as respective screws 40*a*, 40*b*, to the lateral weight track 36. In some implementations, the first and second weights 38, 39 may be secured to the rear weight track 30 by clamping a portion of the track, such as at least one ledge, such that the fastening means is put in tension i.e. a tension system. Additionally or alternatively, the first and second weights 38, 39 may be secured to the rear weight track 30 by compressing against a portion of the track such that the fastening means is put in compression i.e. a compression system. The first and second weights 38, 39 can take other shapes than as shown, can be mounted in other ways, and can take the form of a single-piece design or multi-piece design (e.g., more than two pieces).

Figure 1:
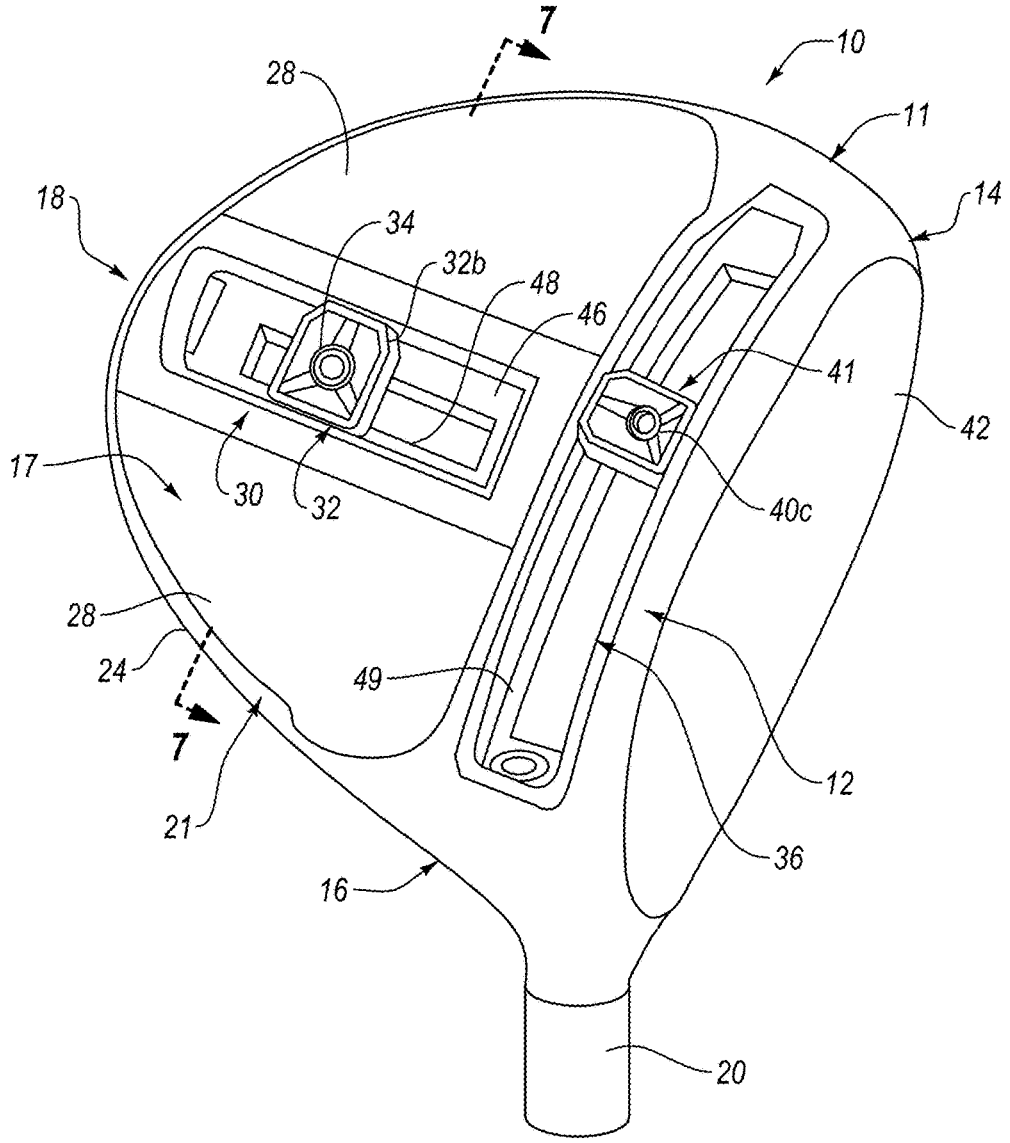
FIG. 1 is a perspective view from a bottom of a golf club head, according to one or more examples of the present disclosure.
Figure 3:
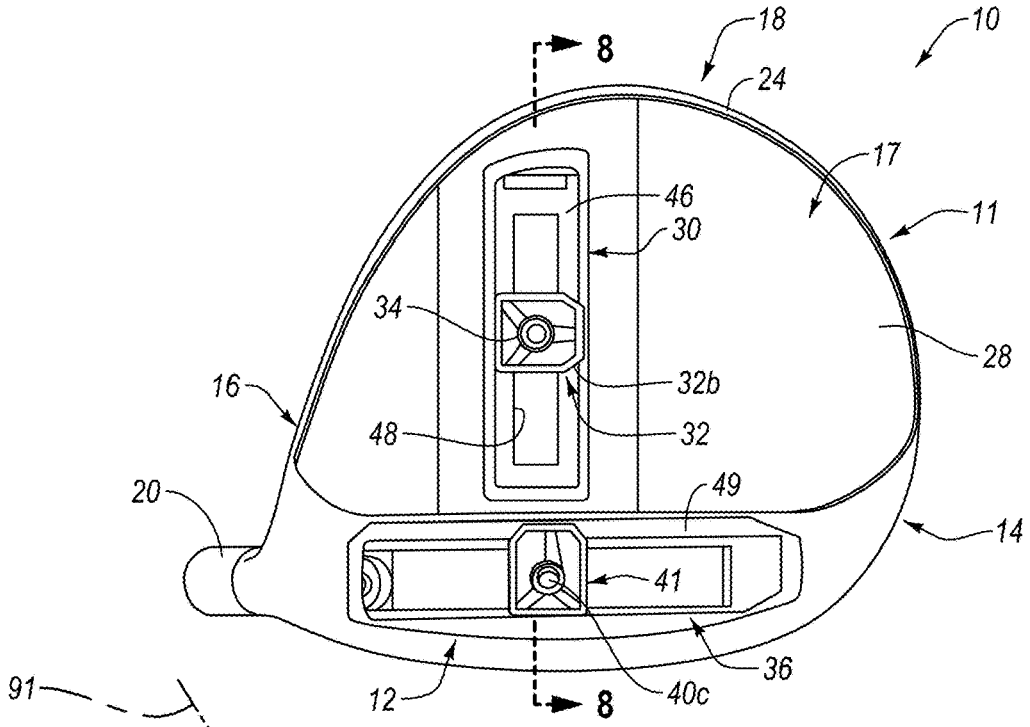
FIG. 3 is bottom view of the golf club head of FIG. 1, according to one or more examples of the present disclosure.

According to another example, as shown in FIGS. 1 and 3, only a single weight 41 (or weight assembly 41) may be slidably mounted to the lateral weight track 36. The weight 41 may include only a single weight element, two weight elements (such as two stacked weight elements 41*a*, 41*b* fastened together by a screw 40*c*), or more than two weight elements.

The lateral weight track 36 allows one or more weights to be selectively loosened and tightened for slidable adjustment laterally, in the heel-to-toe direction, to adjust the effective CG 82 of the golf club head 10 in the heel-to-toe direction. By adjusting the CG 82 of the golf club head 10 laterally, the performance characteristics of the golf club head 10 are adjusted, which promotes an adjustment to the flight characteristics of a golf ball struck by the golf club head 10, such as the sidespin characteristics of the golf ball. Notably, the use of two weights (e.g., first and second weights 38, 39), that are independently adjustable relative to each other, allows for adjustment and interplay between the weights. For example, both weights can be positioned fully in the toe region 14, fully in the heel region 16, spaced apart a maximum distance from each other, with one weight fully in the toe region 14, and the other weight fully in the heel region 16, positioned together in the center or intermediate location of the lateral weight track 36, or in other weight location patterns. Additionally or alternatively, the first and second weights 38, 39 may be secured to the rear weight track 30 such that there may be two or more weights located in the rear weight track 30. Additionally or alternatively, each of the first and second weights 38, 39 may be interchangeable with the weight 32.

Figure 10A:
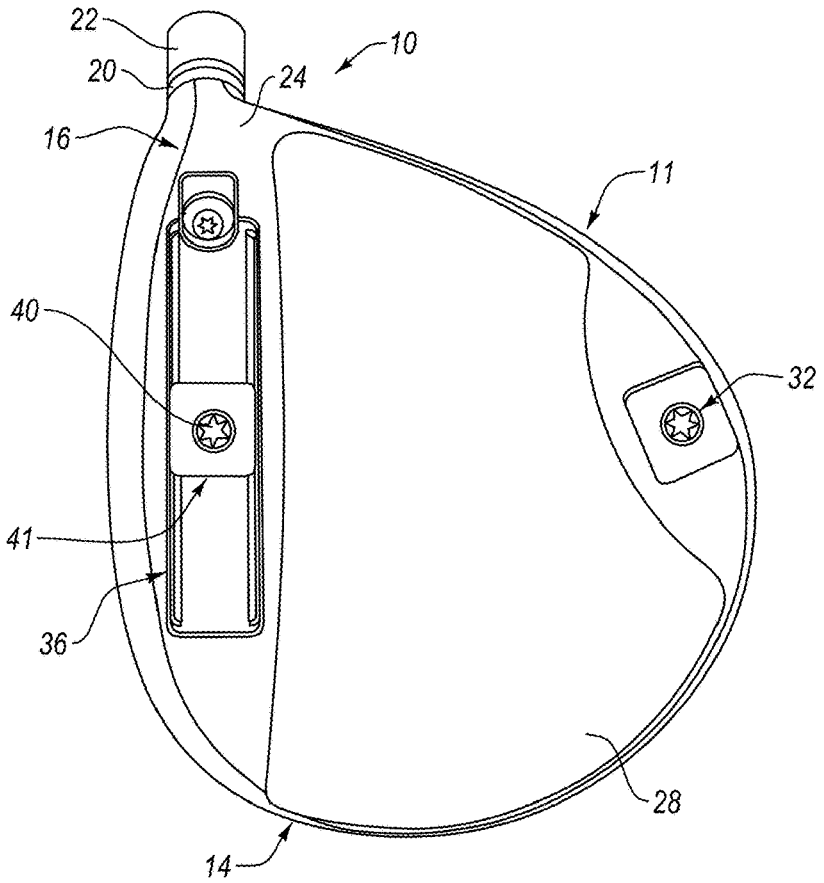
FIG. 10A is a bottom view of the golf club head of FIG. 9A, according to one or more examples of the present disclosure.
Figure 10B:
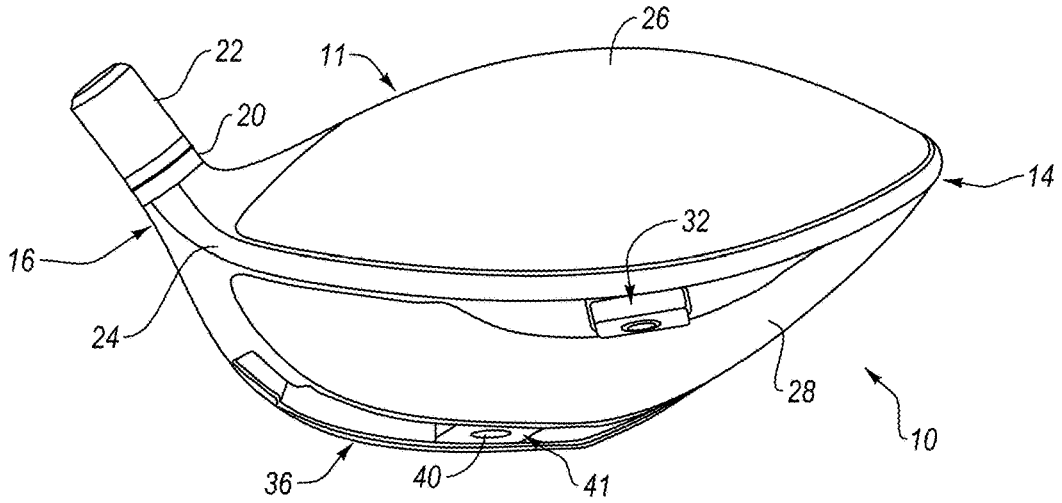
FIG. 10B is a rear view of the golf club head of FIG. 9A, according to one or more examples of the present disclosure.

In some embodiments, as shown in FIGS. 1, 3, and 10A, the lateral weight track or forward channel 36 is offset from the face portion 42 by a forward channel offset distance, which is the minimum distance between a first vertical plane passing through a center 93 of the striking face 43 and the forward channel 36 at the same x-axis coordinate as the center 93 of the striking face 43, between about 5 mm and about 50 mm, such as between about 5 mm and about 35 mm, such as between about 5 mm and about 30 mm, such as between about 5 mm and about 20 mm, or such as between about 5 mm and about 15 mm. Similarly, the rearward track 30 is offset from the face portion 42 by a rearward track offset distance, which is the minimum distance between a first vertical plane passing through the center 93 of the striking face 43 and the rearward track 30 at the same x-axis coordinate as the center 93 of the striking face 43, between about 5 mm and about 50 mm, such as between about 5 mm and about 40 mm, such as between about 5 mm and about 30 mm, or such as between about 10 mm and about 30 mm.

In certain embodiments, both the forward channel 36 and rearward track 30 have a certain channel/track width. Channel/track width may be measured as the horizontal distance between a first channel wall and a second channel wall. For both the forward channel 36 and rearward track 30, the widths may be between about 5 mm and about 20 mm, such as between about 10 mm and about 18 mm, or such as between about 12 mm and about 16 mm. According to some embodiments, the depth of the channel or track (i.e., the vertical distance between the bottom channel wall and an imaginary plane containing the regions of the sole adjacent the front and rear edges of the channel) may be between about 6 mm and about 20 mm, such as between about 8 mm and about 18 mm, or such as between about 10 mm and about 16 mm.

Additionally, both the forward channel 36 and rearward track 30 have a certain channel/track length. Channel/track length may be measured as the horizontal distance between a third channel wall and a fourth channel wall. For both the forward channel 36 and rearward track 30, their lengths may be between about 30 mm and about 120 mm, such as between about 50 mm and about 100 mm, or such as between about 60 mm and about 90 mm. Additionally, or alternatively, the length of the forward channel 36 may be represented as a percentage of the striking face length. For example, the forward channel 36 may be between about 30% and about 100% of the striking face length, such as between about 50% and about 90%, or such as between about 60% and about 80% mm of the striking face length.

In some instances, the forward channel 36 may hold a sliding weight, or it may be a feature to improve and/or increase the coefficient of restitution (COR) across the face. In regards to a COR feature, the channel may take on various forms such as a channel or through slot, as will be described in more detail below.

Each of the golf club heads disclosed herein may have a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. A golf club head of the present application can be configured to have a head volume between about 110 $cm^3$ and about 600 $cm^3$. In more particular embodiments, the head volume may be between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$.

In the case of a driver, the golf club head may have a volume between about 300 $cm^3$ and about 460 $cm^3$, and a total mass between about 145 g and about 245 g. In the case of a fairway wood, the golf club head may have a volume between about 100 $cm^3$ and about 250 $cm^3$, and a total mass between about 145 g and about 260 g. In the case of a utility or hybrid club the golf club head 10 may have a volume between about 60 $cm^3$ and about 150 $cm^3$, and a total mass between about 145 g and about 280 g.

Although in some examples of the golf club head 10, the body 11 does not include inserts (e.g., the body 11 forms a one-piece monolithic construction), according to certain examples of the golf club head 10, the body 11 includes one or more inserts fixedly secured to the frame 24. For example, the frame 24 of the body 11 may have at least one of a sole opening 60, sized and configured to receive a sole insert 28, or a crown opening 62, sized and configured to receive a crown insert 26. More specifically, the sole opening 60 receives and fixedly secures the sole insert 28, which may have the rear weight track 30 joined thereto (as described below). Similarly, the crown opening 62 receives and fixedly secures the crown insert 26. The sole and crown openings 60, 62 are each formed to have a peripheral edge or recess to seat, respectively, the sole insert 28 and crown insert 26, such that the sole and crown inserts 28, 26 are either flush with the frame 24 to provide a smooth seamless outer surface or, alternatively, slightly recessed.

Though not shown, the frame 24 may have a face opening, at a forward region 12 of the body 11, to receive and fixedly secure the face portion 42 of the golf club head 10. The face portion 42 can be fixedly secured to the face opening of the frame 24 by welding, braising, soldering, screws, or other coupling means. The face portion 42 can be made from any of various materials, such as, for example, metals, metal alloys, fiber-reinforced polymers, and the like. In some implementations, the face portion may be integrally formed.

The frame 24 of the body 11 may be made from a variety of different types of materials. According to one example, the frame 24 may be made from a metal material, such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), aluminum and aluminum alloys (including but not limited to 3000 series alloys, 5000 series alloys, 6000 series alloys, such as 6061-T6, and 7000 series alloys, such as 7075), or the like. The frame 24 may be formed by conventional casting, metal stamping, or other known manufacturing processes. In certain examples, the frame 24 may be made of non-metal materials. Generally, the frame 24 provides a framework or skeleton of the golf club head 10 to strengthen the golf club head 10 in areas of high stress caused by the impact of a golf ball with the face portion 42. Such areas include a transition region where the golf club head 10 transitions from the face portion 42 to the crown portion 19, sole portion 17, and skirt portion 21 of the body 11.

In one embodiment, the sole insert 28 and/or crown insert 26 may be made from a polymer or fiber-reinforced polymer (e.g., composite material). The polymer can be any of various polymers, such as thermoplastic or thermoset materials. The fibers of the fiber-reinforced polymer or composite material can be any of various fibers, such as carbon fiber or glass fiber. One exemplary material from which the sole insert 28 and/or crown insert 26 may be made from is a thermoplastic continuous carbon fiber composite laminate material having long, aligned carbon fibers in a PPS (polyphenylene sulfide) matrix or base.

A commercial example of a fiber-reinforced polymer, from which the sole insert 28 and/or crown insert 26 may be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 $g/m^2$.

Another commercial example of a fiber-reinforced polymer, from which the sole insert 28 and/or crown insert 26, is made is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 28 and crown insert 26. After the crown insert 26 and sole insert 28 are formed (separately, in some implementations) by the thermoforming process, each is cooled and removed from the matched die. In some implementations, the crown insert 26 and/or sole insert 28 are shown as having a uniform thickness, which facilitates use of the thermoforming process and ease of manufacture. However, in other implementations the crown insert 26 and/or sole insert 28 may have a variable thickness to strengthen select local areas of the insert by, for example, adding additional plies in select areas to enhance durability, acoustic properties, or other properties of the respective inserts.

As shown in FIG. 2, the crown insert 26 and sole insert 28 each has a complex three-dimensional shape and curvature corresponding generally to a desired shape and curvature of the crown portion 19 and sole portion 17 of the golf club head 10. It will be appreciated that other types of club heads, such as fairway wood-type clubs, may be manufactured using one or more of the principles, methods, and materials described herein.

In an alternative embodiment, the sole insert 28 and/or crown insert 26 can be made by a process other than thermoforming, such as injection molding or thermosetting. In a thermoset process, the sole insert 28 and/or crown insert 26 may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole insert 28 and/or crown insert 26. Each insert is cooled and removed from its respective mold.

The carbon fiber reinforcement material for the sole insert 28 and/or crown insert 26, made by the thermoset manufacturing process, may be a carbon fiber known as "34-700" fiber, available from Grafil, Inc., of Sacramento, Calif., which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, Calif.

In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

According to one embodiment, the weight track 30, which can have a more complex shape with more three-dimensional features than the sole insert 28, may be made from the same, similar, or at least compatible material as the sole insert 28 to allow the rear weight track 30 to be injection molded, overmolded, or insert molded over the sole insert 28 to bond together the rear weight track 30 and sole insert 28. In one example, the crown insert 26, sole insert 28, and rear weight track 30 are made from compatible materials capable of bonding well to one another such as polymeric materials having a common matrix or base, or at least complementary matrices. For example, the crown insert 26 and/or sole insert 28 may be made from continuous fiber composite material well suited for thermoforming while the rear weight track 30 may be made of short fiber composite material well suited for injection molding (including insert molding and overmolding), with each having a common matrix. One example of a material suitable for injection molding is a thermoplastic carbon fiber composite material having short, chopped fibers in a polyphenylene sulfide (PPS) base or matrix. For example, the material of the rear weight track 30 may include 30% short carbon fibers (by volume) having a length of about 1/10 inch, which reinforces the PPS matrix. Another example of a commercial material that may be used for the rear weight track 30 is RTP 1385 UP, made by RTP Company. Other examples include nylon, RTP 285, RTP 4087 UP and RTP 1382 UP.

In one example, the sole insert 28 and rear weight track 30 are bonded together by placing the sole insert 28 in a mold and injection molding the track 30 over the sole insert 28. The injection molding process creates a strong fusion-like bond between the sole insert 28 and rear weight track 30 due to their material compatibility.

In an alternative example, in which the sole insert 28 may be formed using a thermosetting material, the sole insert 28 and rear weight track 30 are not compatible materials and will not bond well if left untreated. Accordingly, before the injection molding, insert molding, or overmolding step, the sole insert 28 preferably may be coated with a heat activated adhesive, such as, for example, ACA 30-114, manufactured by Akron Coating & Adhesive, Inc. ACA 30-114 is a heat-activated water-borne adhesive having a saturated polyurethane with an epoxy resin derivative and adhesion promoter designed from non-polar adherents. It will be appreciated that other types of heat-activated adhesives also may be used. After the coating step, the sole insert 28 may be then placed in a mold and the material of the rear weight track 30 may be overmolded (or injection molded) over the sole insert 28 as described above. During the injection molding step, heat activates the adhesive coating on the sole insert 28 to promote bonding between the sole insert 28 and the weight track 30.

After the sole insert 28 and rear weight track 30 are bonded together, and the crown insert 26 is formed, they are joined to the frame 24 in a manner that creates a strong integrated construction adapted to withstand normal stress, loading, and wear and tear expected of commercial golf clubs. For example, each of the sole insert 28 and crown insert 26 may be bonded to the frame 24 using epoxy adhesive, with the crown insert 26 seated in and overlying the crown opening 62 and the sole insert 28 seated in and overlying the sole opening 60. Alternative attachment methods include bolts, rivets, snap fit, adhesives, and other known joining methods or any combination thereof may be used to couple the crown insert 26 and the sole insert 28 with the frame 24.

Figure 4:
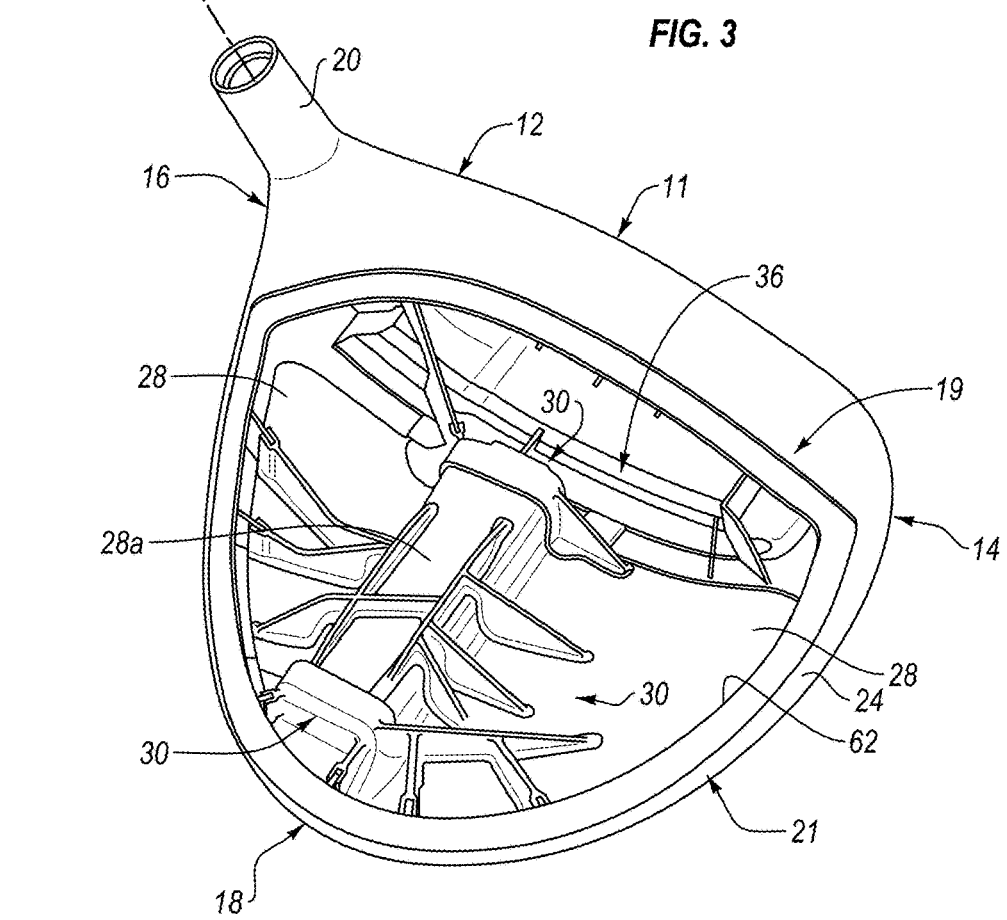
FIG. 4 is a perspective view from a top of the golf club head of FIG. 1, shown with a crown insert removed, according to one or more examples of the present disclosure.

FIG. 4 shows the head with the crown insert 26 removed, and provides a view of the hollow interior of the head from the top. Additionally, FIG. 4 illustrates how the rear weight track 30 includes internal ribs, supports and other features overmolded on the sole insert 28. For example, the rear weight track 30 may include various supports wrapping over a central ridge 28*a* of the sole insert, fore-aft supporting ribs along the top of the ridge 28*a*, and lateral ribs extending outwardly from the central ridge 28*a*. It can be seen that the overmolding process allows the weight track and other intricate features and details to be incorporated into the design of the golf club head 10. For example, in addition to the performance benefits provided by the weight track 30, the various ribs and features shown in FIG. 4 can provide structural support and additional rigidity for the golf club head 10 and also modify and even fine tune the acoustic properties of the golf club head 10. The sound and modal frequencies emitted by the golf club head 10 when it strikes the ball are very important to the sensory experience of the golfer and provides functional feedback as to where the ball impact occurs on the striking face 43 (and whether the ball is well struck).

Figure 5:
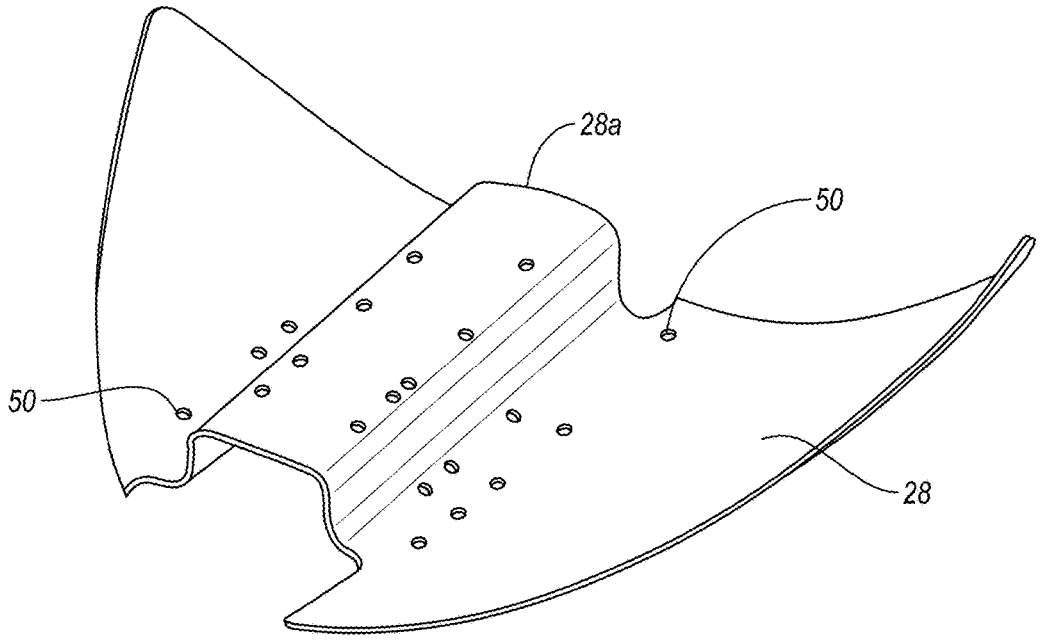
FIG. 5 is a perspective view of a sole insert of the golf club head of FIG. 1, according to one or more examples of the present disclosure.

FIG. 5 shows the sole insert 28, including its central rib or ridge 28*a*, before the rear weight track 30 has been overmolded thereto. The ridge 28*a* may be centrally located on the sole insert and extends generally from front to back to provide additional structural support for the sole of the golf club head. The ridge 28*a* also provides an elongate weight recess or port on its outer surface within which to seat the fore-aft weight track 30. The sole insert may include a plurality of through holes 50 in various locations to provide a flow path for injection mold melt during the injection molding step and create a mechanical interlock between the sole insert 28 and overmolded weight track 30, thereby forming the sole insert unit.

Figure 6:
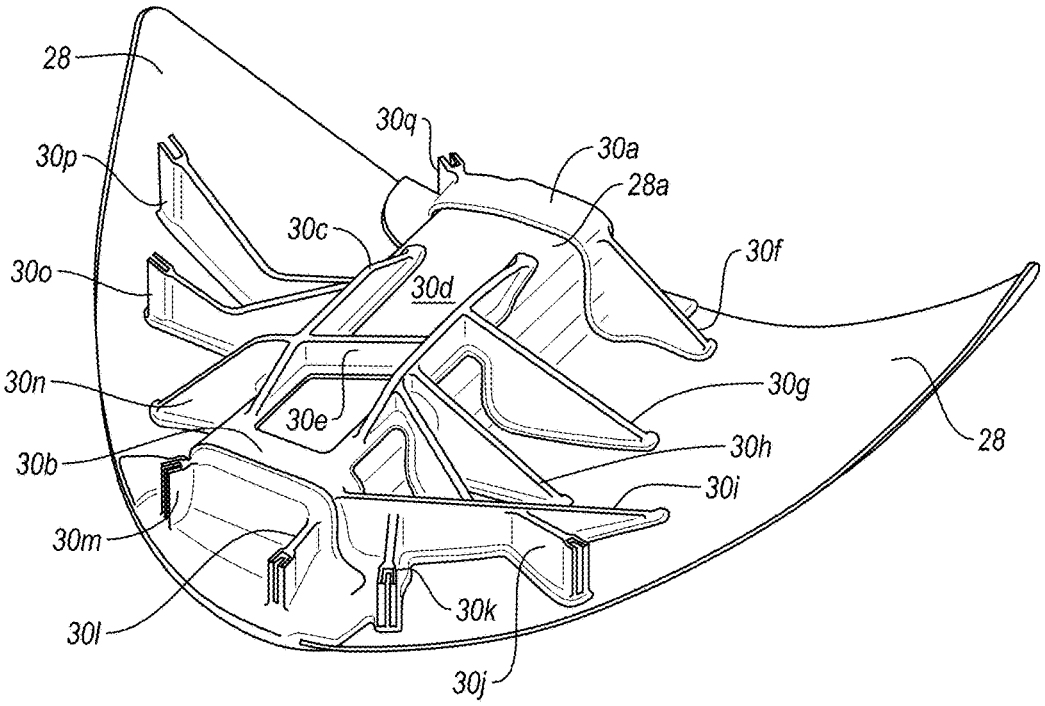
FIG. 6 is a perspective view of a sole insert and a weight track of the golf club head of FIG. 1, according to one or more examples of the present disclosure.

FIG. 6 shows in greater detail the sole insert 28 with the overmolded rear weight track 30 joined thereto. It can be seen (especially in the context of the other figures) that the rear weight track 30 wraps around both sides (interior and exterior) of the sole insert 28. In addition to a weight installation channel 48 and peripheral ledge (or rail) 46 overmolded on the outer surface of the sole insert 28, the rear weight track 30 also preferably includes one or more ribs and other features on the interior surface of the sole insert. For example, FIG. 6 shows reinforcing supports 30*a*, 30*b* draped over opposite ends of the ridge 28*a*, parallel fore-aft extending ribs 30*c*, 30*d* tracking along the top of the ridge 28*a*, cross-rib 30*e* connecting the ribs 30*c*, 30*d*, and various lateral and other ribs 30*f*, 30*g*, 30*h*, 30*i*, 30*j*, 30*k*, 301, 30*m*, 30*n*, 30*o*, 30*p*, and 30*q*, which are all interconnected to form a reinforcing network or matrix of supporting ribs and supports to reinforce the sole insert 28 and the golf club head 10. In some embodiments, movement of the at least one weight member within the rear weight track 30 produces a change in a head origin z-axis coordinate of a center-of-gravity of the golf club head of less than between about 0.5 mm and about 2.0 mm (e.g., about 1.0 mm) throughout the adjustability range of the at least one weight member.

Because the ribs are injection molded they can have a wide variety of shapes, sizes, orientations, and locations on the sole insert to adjust and fine tune acoustic properties of the golf club head. It can be seen in FIG. 6 that the rib network adds rigidity in both the lateral and longitudinal directions and thereby imparts strategically located stiffness to the golf club head. In this regard, some of the ribs, such as ribs 30*j*, 30*k*, 30*l*, 30*m*, 30*o*, 30*p*, and 30*q*, have forked ends to engage mating structural elements on the frame 24, thereby aligning the sole insert 28 for attachment to the frame 24 as well as providing a strong mechanical bond between the sole insert 28 unit and frame 24.

Figure 7:
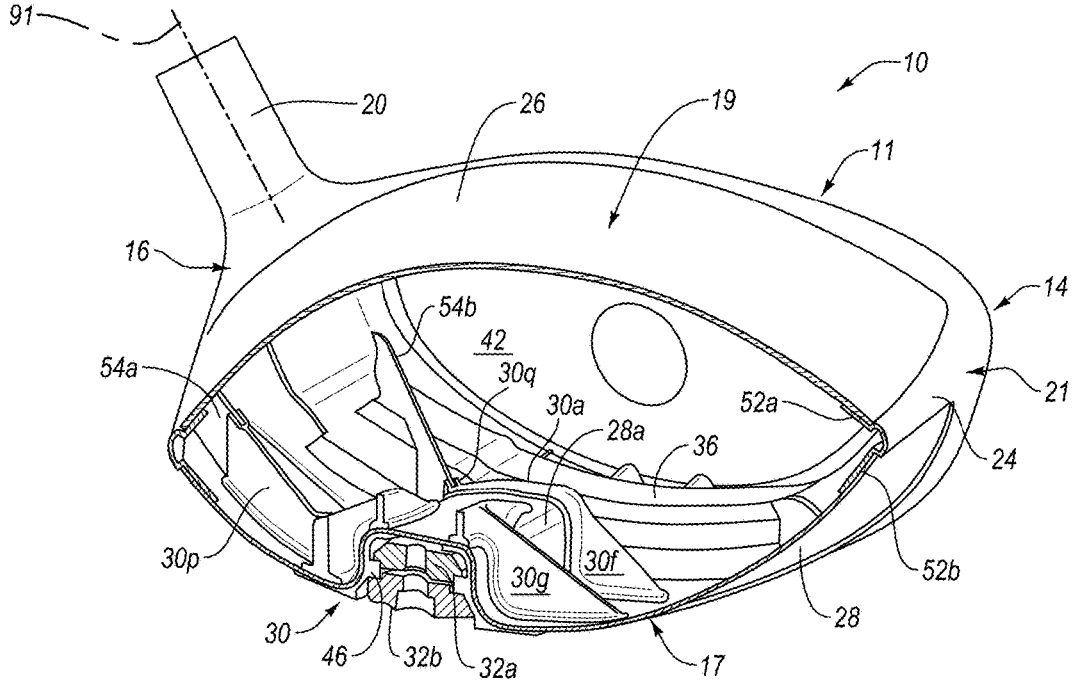
FIG. 7 is a cross-sectional perspective view from a back of the golf club head of FIG. 1, taken along line 7-7 of FIG. 1, according to one or more examples of the present disclosure.

Referring to FIG. 7, the frame 24 preferably includes a recessed seat or ledge 52*a* extending around the crown opening 62 to seat the crown insert 26. Similarly, the frame 24 includes a seat or ledge 52*b* around the sole opening 60 to receive the sole insert 28. The weight elements 32*a*, 32*b* of the weight 32 are shown seated in their respective channels and separated by rail 46. Weight elements 32*a*, 32*b* are shown having aligned bores to receive the screw 34 (see, e.g., FIGS. 1 and 2). The bore of the weight element 32*a* may be threaded such that loosening of the screw 34 separates the weight elements to allow sliding movement forward and rearward within the weight track 30, while tightening the screw 34 pulls the weights together into locking engagement with the rail 46 to prevent sliding movement during play on the golf course.

Figure 8:
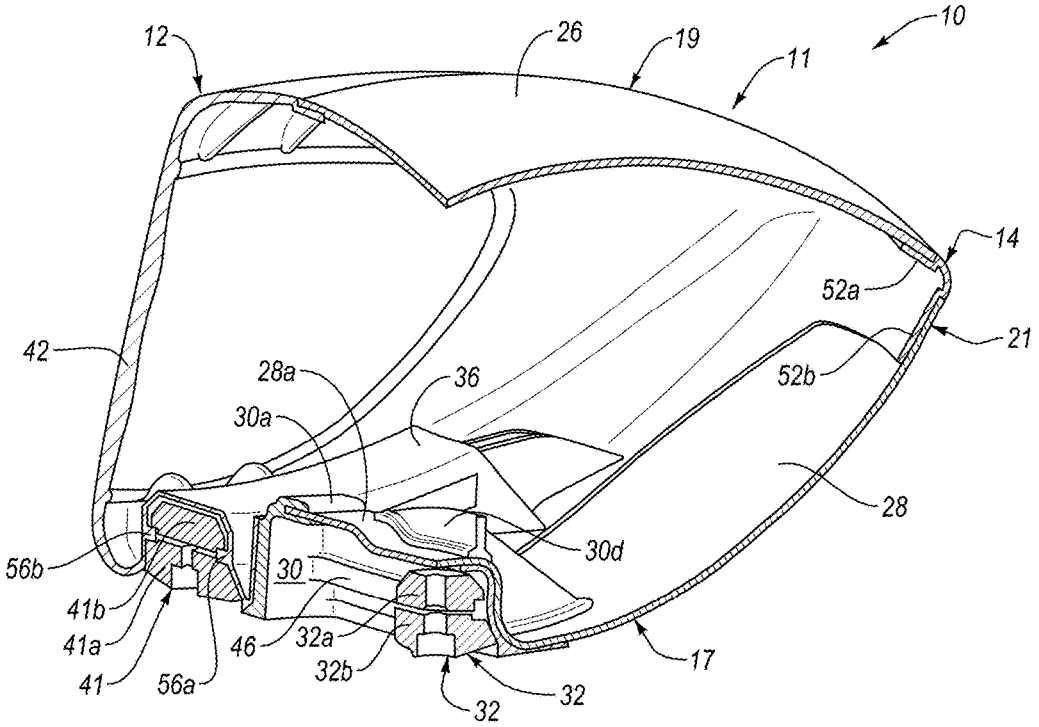
FIG. 8 is a cross-sectional perspective view from a back of the golf club head of FIG. 1, taken along line 7-7 of FIG. 1 and line 8-8 of FIG. 3, according to one or more examples of the present disclosure.
Figure 9A:
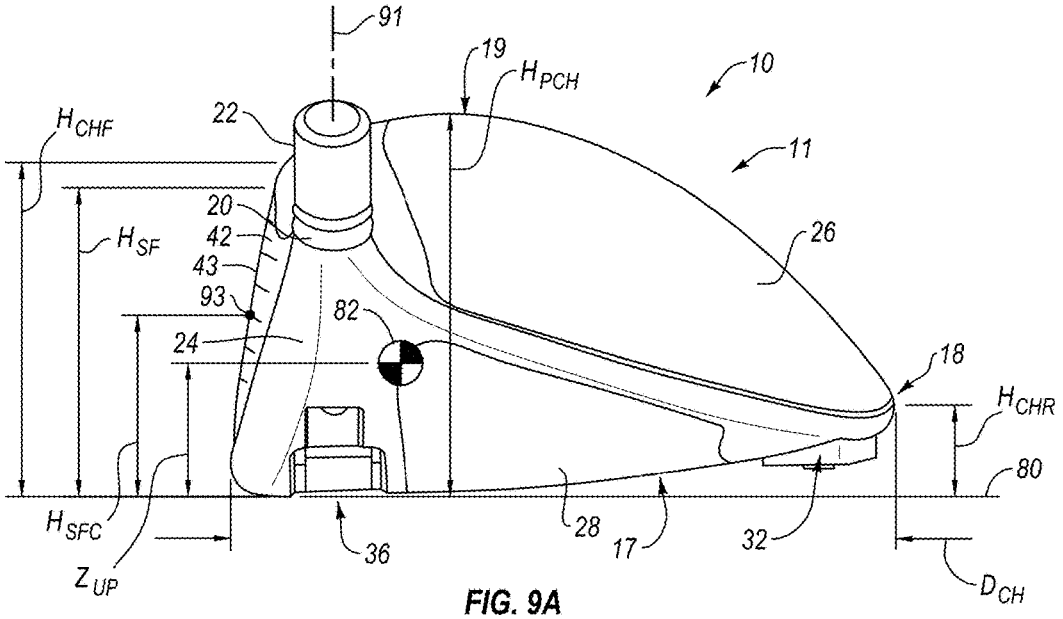
FIG. 9A is an elevational side view from a heel side of another golf club head, according to one or more examples of the present disclosure.
Figure 9B:
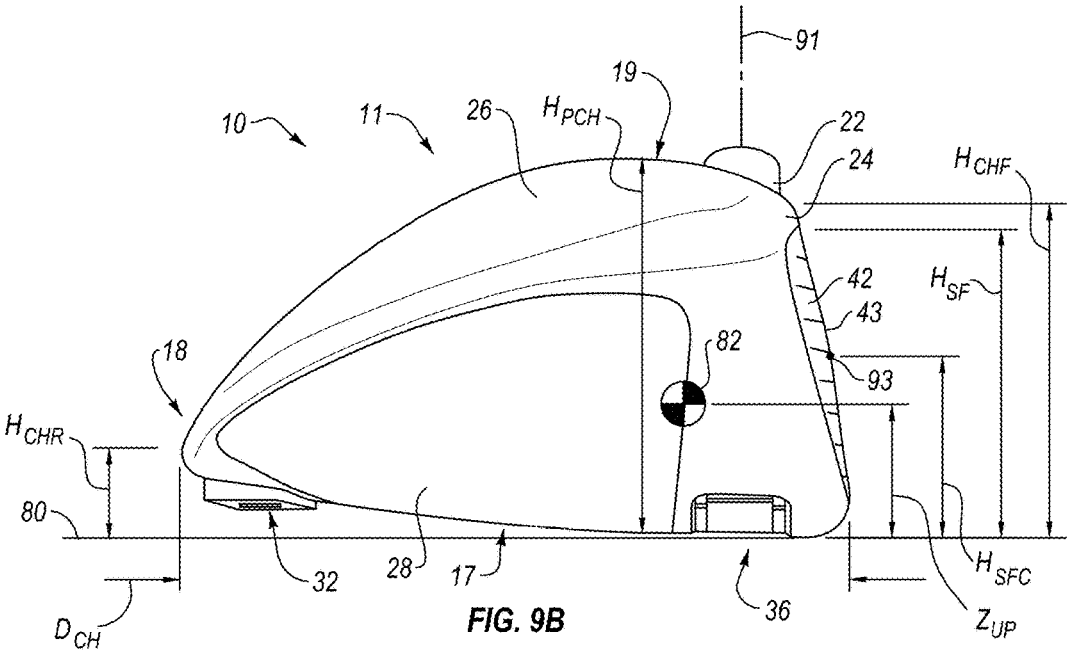
FIG. 9B is an elevational side view from a toe side of the golf club head of FIG. 9A, according to one or more examples of the present disclosure.

As shown in FIG. 8, the rear weight track 30 and a two-piece weight 32 (with weight elements 32*a*, 32*b*) is similar to the weight track 36 and two-piece weight 41 (which includes weight elements 41*a*, 41*b*).

Similar to that mentioned above, in some embodiments, the width of the channels or sliding weight tracks (i.e., the distance between a first channel wall and a second channel wall adjacent to the locations of a first ledge and a second ledge) may be between about 8 mm and about 20 mm, such as between about 10 mm and about 18 mm, or such as between about 12 mm and about 16 mm. Also in line with that mentioned above, in certain embodiments, the depth of the channel (i.e., the vertical distance between a bottom channel wall and an imaginary plane containing the regions of the sole adjacent the ledges of the channel) may be between about 6 mm and about 20 mm, such as between about 8 mm and about 18 mm, or such as between about 10 mm and about 16 mm. Further to that mentioned above, according to some embodiments, the length of the channels (i.e., the horizontal distance between a first end of the channel and a second end of the channel) may be between about 30 mm and about 120 mm, such as between about 50 mm and about 100 mm, or such as between about 60 mm and about 90 mm.

In the embodiments shown, the weight assembly includes three components: an inner member, an outer member, and a fastening bolt. The outer member may be located within an outer portion of the interior channel volume, engaging the outward-facing surfaces of the ledges. The inner member may be located within an inner portion of the interior channel volume, engaging the inward-facing surfaces of the ledges. The fastening bolt has a threaded shaft that extends through a center aperture of the outer member and engages mating threads located in a center aperture of the mass member. This is a tension system for securing the weight assembly. Alternatively, the washer could have the mating threads in a center aperture, and the fastening bolt could go through a center aperture of the mass member and be tightened by a drive on the exposed outer surface of the bolt.

In this embodiment, the head of the bolt would be captured on the inner surface of the mass member holding it in place during tightening.

In some embodiments, the washer may be heavier than mass member, and vice versa. Or, the washer and the mass member may have similar masses. An advantage of making the washer heavier than the mass member is an even lower CG. The washer and/or mass member may have a mass in the range of 1 g to 50 g.

The composite sole and weight track disclosed in various embodiments herein overcome manufacturing challenges associated with conventional club heads having titanium or other metal weight tracks, and replace a relatively heavy weight track with a light composite material (freeing up discretionary mass which can be strategically allocated elsewhere within the golf club head). For example, additional ribs can be strategically added to the hollow interior of the golf club head and thereby improve the acoustic properties of the head. Ribs can be strategically located to strengthen or add rigidity to select locations in the interior of the head. Discretionary mass in the form of ribs or other features also can be strategically located in the interior to shift the effective CG 82 fore or aft, toe-ward or heel-ward or both (apart from any further CG 82 adjustments made possible by slidable weight features). Additionally, composite sole and crown inserts 28, 26 provide structural support and stiffness to the golf club head 10, as well as free up discretionary mass that can be allocated elsewhere on the golf club head 10.

As shown in FIGS. 9, 10, 13, and 14, in some embodiments, the golf club head 10 is similar to the golf club head of FIGS. 1-8, with like numbers referring to like elements, but does not include a weight track 30, extending in a forward-to-rearward direction, that allows slidable adjustment of the weight 32 forwardly and rearwardly. Rather, the golf club head 10 in FIGS. 9, 10, 13, and 14 includes a weight 32 in a fixed position at a heel region 16 of the golf club head 10. Accordingly, the golf club head 10 includes a port, formed in the sole portion 17, for receiving and retaining the weight 32, but does not include a rear weight track 30 in the sole portion 17. The mass of the weight 32 can be any of various masses. Moreover, the weight 32 can be replaced with another weight 32 of a different mass. But, the position of the weight 32 on the golf club head 10 is fixed. The golf club head 10 of FIGS. 11 and 12 also is similar to the golf club head 10 of FIGS. 1-10, 13, and 14, with like number referring to like elements.

Figure 11:
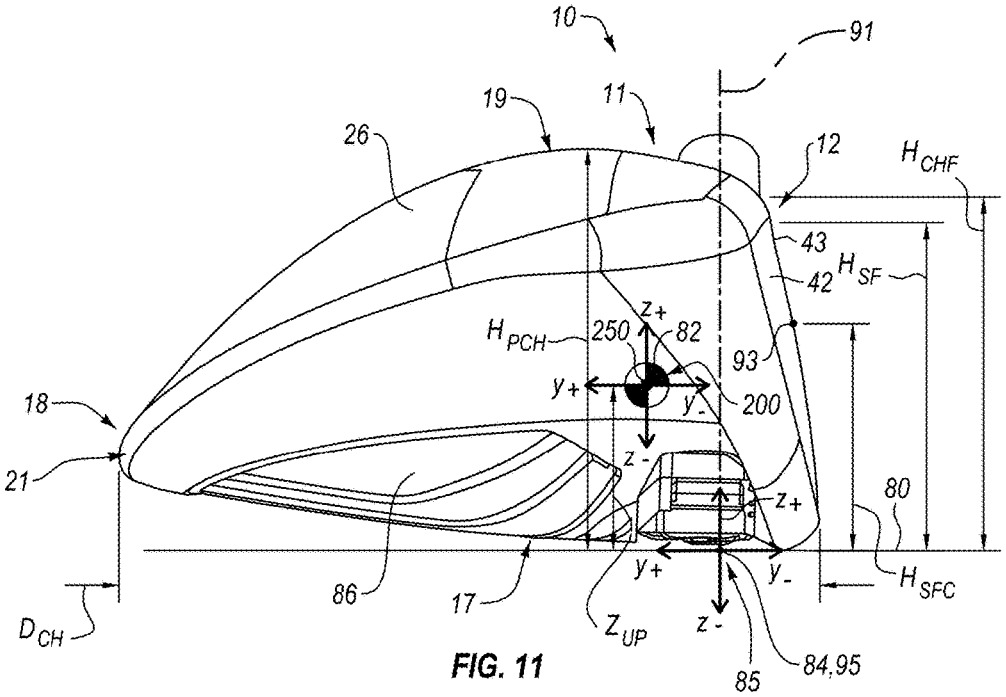
FIG. 11 is an elevational side view from a toe side of a golf club head, according to one or more examples of the present disclosure.
Figure 12:
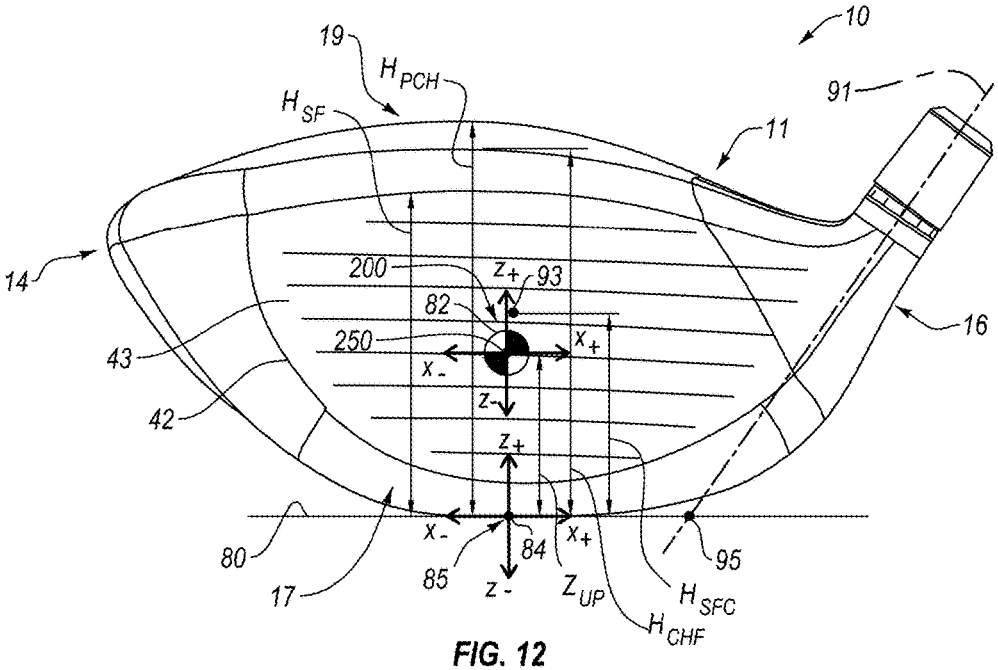
FIG. 12 is an elevational side view from a heel side of the golf club head of FIG. 11, according to one or more examples of the present disclosure.

Additionally, in contrast to the golf club head 10 of FIGS. 1-10, the sole portion 17 of the golf club head 10 of FIGS. 11-13 does not include a sole insert 28 made from a fiber-reinforced polymer. Rather, in one implementation, the sole portion 17 of the golf club head 10 of FIGS. 11-13 includes a sole insert made from a metal or metal alloy, such as titanium, and in another implementation, the sole portion 17 includes a one-piece monolithic construction, made from a metal or metal alloy, such as titanium, instead of a separately attachable sole insert. Accordingly, in at least one embodiment, the crown portion 19 of the golf club head 10 of FIGS. 11-13, may be made from a first material, such as a fiber-reinforced polymer, and the sole portion 17 may be made from a metal or metal alloy, such as titanium. Moreover, in such an embodiment, more than between about 60% and 80% (e.g., about 70%) of the crown portion 19 of the body 11 of the golf club head 10 has a thickness less than about 0.75 mm.

Moreover, in some implementations, in contrast to the golf club head 10 of FIGS. 1-13, the crown portion 19 of the golf club head 10 of FIG. 14 does not include a crown insert 26 made from a fiber-reinforced polymer. Rather, in one implementation, the crown portion 19 of the golf club head 10 of FIG. 14 includes a crown insert made from a metal or metal alloy, such as titanium, and in another implementation, the crown portion 19 includes a one-piece monolithic construction, made from a metal or metal alloy, such as titanium, instead of a separately attachable sole insert. Additionally, the golf club head 10 of FIG. 14 does not include a sole insert 28 made from a fiber-reinforced polymer. Instead, the sole portion 17 of the golf club head 10 of FIG. 14 includes a sole insert made from a metal or metal alloy, such as titanium, and in another implementation, the sole portion 17 includes a one-piece monolithic construction, made from a metal or metal alloy, such as titanium, instead of a separately attachable sole insert. Accordingly, in at least one embodiment, an entirety of the golf club head 10 of FIG. 14, may be made from a metal or metal alloy, such as titanium. Moreover, in such an embodiment, more than between about 60% and 80% (e.g., about 70%) of the crown portion 19 of the body 11 of the golf club head 10 has a thickness less than about 0.75 mm.

Based on the foregoing, the body 11 of the golf club head 10 of the present disclosure has at least one of a crown portion 19 at least partially made from a fiber-reinforced polymer, a sole portion 17 at least partially made from a fiber-reinforced polymer, or a crown portion 19 and a sole portion 17 made entirely from a metal or metal alloy. For example, in certain embodiments, the body 11 of the golf club head 10 has both a crown portion 19 and sole portion 17 at least partially made from a fiber-reinforced polymer, in other embodiments, the body 11 of the golf club head 10 has a crown portion 19 at least partially made from a fiber-reinforced polymer and a sole portion 17 entirely made from a metal or metal alloy, and in yet other embodiments, the body 11 of the golf club head 10 has both a crown portion 19 and sole portion 17 made entirely from a metal or metal alloy. However, as will be explained in more detail below, notwithstanding the variability of the composition of the crown portion 19 and sole portion 17 of the golf club head 10 of the present disclosure, the same type of profile of the crown portion 19 can be common among the various embodiments of the golf club head 10 to cooperatively, along with the composition of the crown portion 19 and sole portion 17, promote certain performance characteristics of the golf club head 10.

As represented only in the golf club head 10 of FIGS. 9-12, but applicable to the golf club head 10 of all FIGS. 1-16, the CG 82 of the golf club head 10 of the present disclosure is the average location of the weight of the golf club head 10, or the point at which the entire weight of the golf club head 10 may be considered as concentrated, so that if supported at this point, the golf club head 10 would remain in equilibrium in any position.

In FIGS. 9-16, the golf club head 10 is in an address position such that the hosel axis 91 is at an angle of approximately 60 degrees relative to an imaginary ground plane 80 and the face angle is substantially square relative to an imaginary target line. The target line may be defined as the horizontal component of a vector normal to the center 93 of the striking face 43. The length (heel-to-toe) and height (sole-to-crown) of the club head are measured according to USGA procedures with the head in the address position and at a 60 degree lie angle. The ground plane 80, as used herein, is assumed to be a level plane. As defined herein, a midplane of the golf club head 10 is a plane that is perpendicular to the ground plane 80 and passes through the center 93 of the striking face 43. Furthermore, when the golf club head 10 is in the address position on the ground, the hosel axis 91 intersects the ground plane 80 at a ground plane intersection point 95.

When the golf club head 10 is in the address position on the ground plane 80, a maximum height $H_{SF}$ of the striking face 43 of the face portion 42 may be at least about 50 mm, such as at least about 52 mm, such as at least about 54 mm, or such as at least about 56 mm. Additionally, a minimum height $H_{SFC}$ from the ground plane to the center 93 of the striking face 43 may be at least about 27 mm, such as at least about 28 mm, such as at least about 29 mm, such as at least about 30 mm, or such as at least about 35 mm. The center 93 may be the geometric center of the striking face 43 defined as the intersection of the midpoints of the height and width of the striking face 43.

Referring to the golf club head 10 of FIGS. 9-12, but applicable to the golf club head 10 of all FIGS. 1-16, a crown height $H_{CHF}$ of a forewardmost point of the crown portion 19 of the body 11 may be greater than about 52 mm, such as greater than about 54 mm, such as greater than about 56 mm, such as greater than about 58 mm, or such as greater than about 60 mm. A peak crown height $H_{PCH}$ of the crown portion 19 may be at least about 62 mm, such as at least about 64 mm, such as at least about 66 mm, or such as at least about 68 mm. Similarly, a crown height $H_{CHR}$ of a rearwardmost point of the crown portion 19 along a mid-plane may be less than about 23 mm, such as less than about 18 mm, or such as less than about 15 mm. In some implementations, the crown height $H_{CHR}$ of the rearwardmost point of the crown portion 19 may be between 8 mm and 23 mm, such as between 10 mm and 20 mm, such as between 11 mm and 18 mm, or such as between 11 mm and 16 mm.

Again, referring to the golf club head 10 of FIGS. 9-14, but applicable to the golf club head 10 of all FIGS. 1-16, a minimum distance Zup of the CG 82 away from the ground plane 80 may be less than about 27.5 mm, such as less than about 26.5 mm, such as less than about 25.5 mm, or such as less than about 24.5 mm.

The configuration of the crown portion 19, including one or more of the materials from which the crown portion 19 is made or the relatively dramatic profile of the crown portion 19, as will be explained in more detail below, relative to the other portions of the golf club head 10 promotes a relatively low minimum distance Zup of the CG 82 relative to the peak crown height $H_{PCH}$ of the crown portion 19 of the golf club head 10. Such a relationship between minimum distance Zup of the CG 82 relative to the peak crown height $H_{PCH}$ of the crown portion 19 may be achieved by the extra discretionary mass made available, by using a lighter, stiffer material to form at least the crown portion 19 as described above, for placement lower on the golf club head 10. The relationship between the minimum distance Zup of the CG 82 and the peak crown height $H_{PCH}$ of the crown portion 19 can be expressed as the difference between the minimum distance Zup of the CG 82 and half of the peak crown height $H_{PCH}$ (i.e., Zup−0.5$H_{PCH}$).

Figure 21:
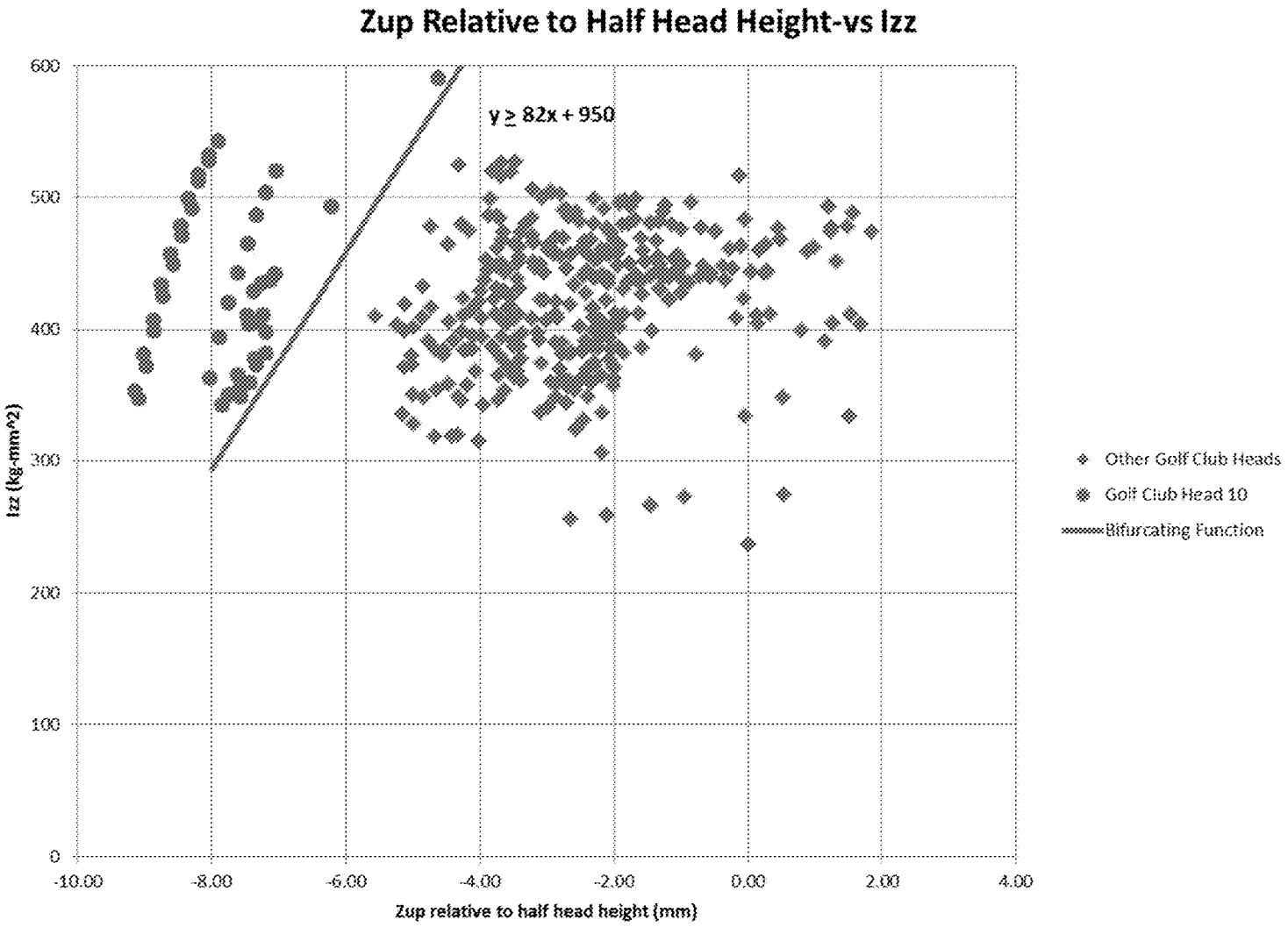
FIG. 21 is a chart showing values for the difference between the minimum distance Zup of the center-of-gravity and half of the peak crown height versus the moment of inertia about the z-axis for some golf club heads of the present disclosure and other golf club heads, according to one or more examples of the present disclosure.

According to some implementations, when the golf club head 10 is in the address position on the ground plane 80, the difference between the minimum distance Zup of the CG 82 and half of the peak crown height $H_{PCH}$ may be less than about −5.75 mm, such as less than about −6.0 mm, such as less than about −6.5 mm, or such as less than about −7.0 mm. In yet further implementations, values for the difference between the minimum distance Zup of the CG 82 and half of the peak crown height $H_{PCH}$ versus the moment of inertia about the z-axis (Izz) for some golf club heads 10 of the present disclosure and other golf club heads, when in the address position on the ground plane 80, are shown in FIG. 21.

Table 1 below lists some but not all of the exemplary data points used to generate the chart shown in FIG. 21. Many of the data points were generated by sweeping a slidable weight from a front portion of a track to a rear portion of a track. Instead of a sliding weight track weight ports could be positioned at the front and rear of the club head to achieve a similar overall change in the extreme positions, but weight ports would not allow for the incremental adjustment as shown in FIG. 21. To achieve incremental adjustment using weight ports would require a significant number of weight ports, which requires additional structure to house the weights and reduces the available discretionary mass. As already explained, the other parameter that varied were the materials used to construct club head 10. For example, in one embodiment the body was formed completely from titanium, in an alternative embodiment the body was formed from titanium and the crown was formed from a composite material, and in yet another alternative embodiment the body was formed from titanium and the crown and sole were formed from a composite material having a density between 1 g/cc and 2 g/cc.

TABLE 1

| | Composite crown and composite sole. | | Composite crown and Ti sole. | | Ti crown and Ti sole. | |
|---|---|---|---|---|---|---|
| Half Head Height (mm) | 33 | 33 | 33 | 33 | 33 | 33 |
| Zup (mm) | 23.91 | 25.09 | 23.86 | 24.96 | 24.97 | 25.96 |
| Zup-Half Head Height (mm) | −9.09 | −7.91 | −9.14 | −8.04 | −8.03 | −7.04 |
| CG Project from Half Head Ht (mm) | −4.7 | −0.3 | −4.7 | −0.6 | −3.3 | 0.3 |
| Izz (kg-mm^2) | 347 | 543 | 353 | 532 | 363 | 520 |
| Delta 1 (mm) | 9.6 | 28.1 | 10.3 | 27.3 | 11.5 | 26.7 |

Various parameters may be adjusted to obtain multiple combinations of head height, Zup, Delta 1, Izz, and CG projection. For example, Table 2 below shows data for an alternative design and data for a large volume club head having a volume of about 800 cc. This enables the inventors to design golf club heads that fall on the left side of the bifurcating function shown in FIG. 21 i.e. golf club heads that have an Izz that is greater than or equal to 82*(Zup−0.5*head height)+950 kg-mm^2 or y≥82x+950. Similarly, the inventors may also design golf club heads that fall on the left side of the bifurcating function shown in FIG. 22 i.e. golf club heads that have an Izz_greater than or equal to 58.3*(CGprojection relative to half head height)+483.3 kg-mm^2 or y≥58.3x+483.3.

TABLE 2

| | Alternate Embodiment Club Head 10 | Large volume club head 10 |
|---|---|---|
| Half Head Height (mm) | 33 | 38 |
| Zup (mm) | 26.73 | 33.27 |
| Zup - Half Head Height (mm) | −6.22 | −4.63 |
| CG Project from Half Head Ht (mm) | −0.5 | 1.4 |

TABLE 2-continued

| | Alternate Embodiment Club Head 10 | Large volume club head 10 |
|---|---|---|
| Izz (kg-mm^2) | 493 | 591 |
| Delta 1 (mm) | 21 | 14.9 |

Referring to the golf club head 10 of FIGS. 9-12, but applicable to the golf club head 10 of all FIGS. 1-16, an overall forward-to-rearward depth $D_{ch}$ of the golf club head 10 may be greater than about 85 mm, such as greater than about 95 mm, such as greater than about 105 mm, or such as greater than about 115 mm.

Figure 16:
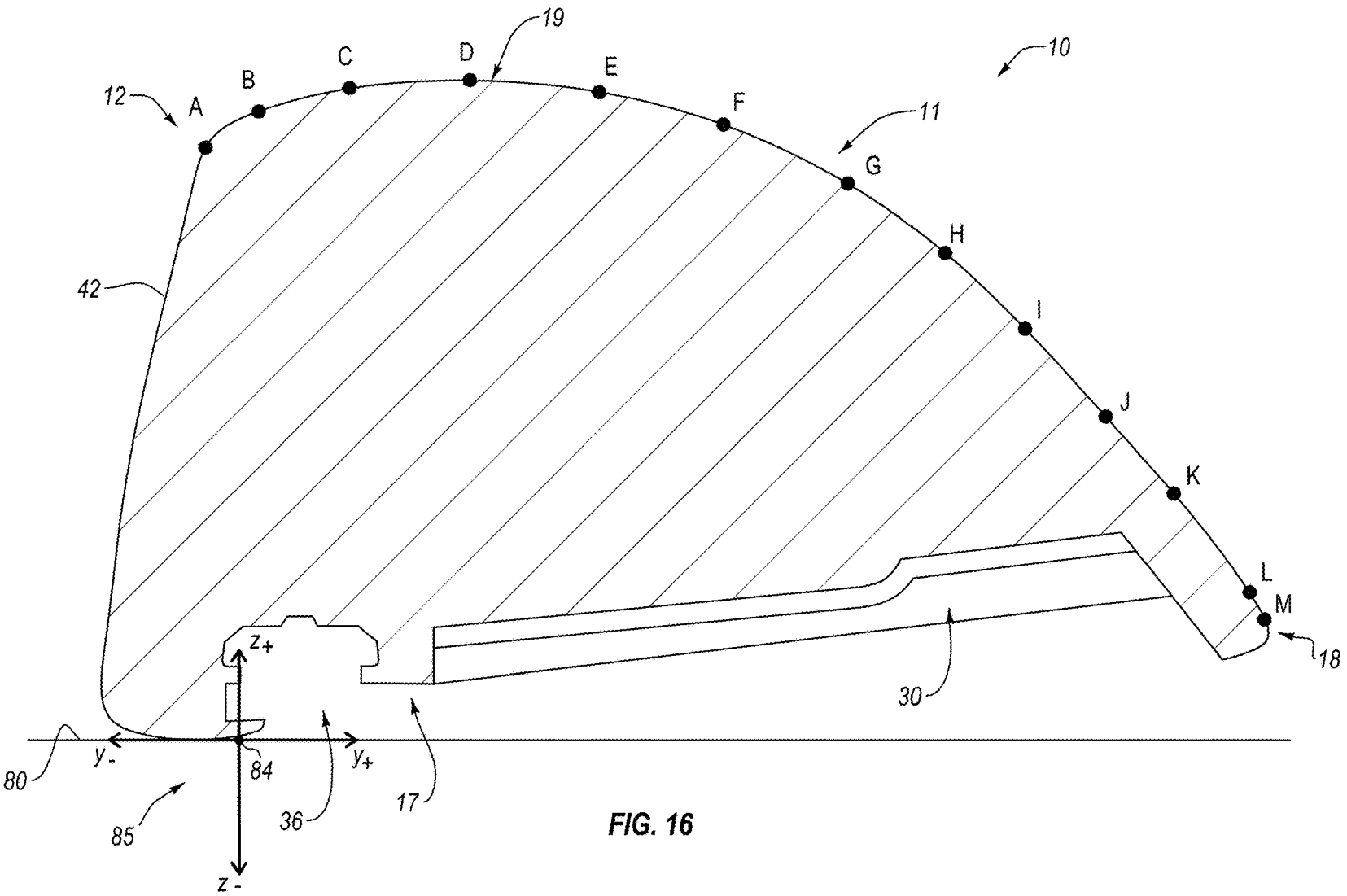
FIG. 16 is a cross-sectional side elevation view of an outer periphery of yet another golf club head, taken along a longitudinal midplane of the golf club head, according to one or more examples of the present disclosure.

Additionally, as shown in FIGS. 15 and 16, a club head origin coordinate system 85, centered around a club head origin 84, can be defined such that the location of various features of the golf club head, including the CG and points on the crown portion 19, can be determined with respect to the club head origin 84. Unless otherwise indicated, the club head origin 84, as defined herein, is the ground plane intersection point 95 projected, in a direction parallel to the ground plane 80 and perpendicular to the midplane, onto the midplane (see, e.g., FIGS. 11 and 12). The y-axis of the club head origin coordinate system 85 passes through the club head origin 84 and extends parallel to or along the midplane. As indicated, the y-axis extends from the club head origin 84 in the positive direction toward the rearward region 18 and extends from the club head origin 84 in the negative direction toward the forward region 12. The z-axis of the club head origin coordinate system 85 passes through the club head origin 84 and extends perpendicularly relative to the y-axis and ground plane 80 and parallel to or along the midplane. As indicated, the z-axis extends from the club head origin 84 in the positive direction toward the crown portion 19, or in a vertically upward direction, and extends from the club head origin 84 in the negative direction in a vertically downward direction. 2. The x-axis of the club head origin coordinate system 85 passes through the club head origin 84 and extends perpendicularly relative to the midplane, y-axis, and z-axis. As indicated, the x-axis extends from the club head origin 84 in the positive direction toward the heel region 16 and extends from the club head origin 84 in the negative direction toward the toe region 14. Thus, for example, and using millimeters as the unit of measure, a CG 82 that is located 3.2 mm from the head origin 84 toward the toe region 14 of the golf club head 10 along the x-axis, 21.7 mm from the head origin 84 toward the rearward region 18 of the golf club head 10 along the y-axis, and 32.1 mm from the head origin 84 toward the crown portion 19 of the golf club head 10 along the z-axis can be expressed as having a head origin x-axis coordinate CGx of −3.2 mm, a Delta 1 coordinate of 21.7 mm as measured along the y-axis, and a Zup coordinate of 32.1 mm as measured along the z-axis.

The CG 82 can also be used to define a CG coordinate system 200 with the CG 82 as the origin of the CG coordinate system 200. For example, as illustrated in FIGS. 11 and 12, the CG coordinate system 200 defined with respect to the CG 82 (i.e., having an origin 250 at the CG 82) includes three axes: a CG z-axis extending through the origin 250 in a generally vertical direction relative to the ground plane 80 when the club head 10 is at normal address position; a CG x-axis extending through the origin 250 in a toe-to-heel direction generally parallel to the striking face 43 (e.g., generally tangential to the striking face 43 at the center 93 of the striking face 43), and generally perpendicular to the CG z-axis; and a CG y-axis extending through the origin 250 in a front-to-back direction and generally perpendicular to the CG x-axis and to the CG z-axis. The CG x-axis and the CG y-axis both extend in generally horizontal directions relative to the ground plane 80 when the club head 10 is at normal address position. The CG x-axis extends in a positive direction from the origin 250 to the heel region 16 of the club head 10. The CG y-axis extends in a positive direction from the origin 250 towards the rearward region 18 of the golf club head 10. The CG z-axis extends in a positive direction from the origin 250 towards the crown portion 19. Thus, the axes of the CG coordinate system 200 are parallel to corresponding axes of the club head origin coordinate system 85. In particular, the CG z-axis is parallel to the z-axis of the club head origin coordinate system 85, the CG x-axis is parallel to x-axis of the club head origin coordinate system 85, and the CG y-axis is parallel to y-axis of the club head origin coordinate system 85.

The profile or shape of the crown portion 19 of the golf club head 10 of the present disclosure is distinct relative to conventional golf club heads. For example, the crown portion 19 has a more dramatic and rapid rise in a height of the crown portion 19, from a forewardmost point or boundary of the crown portion 19 (e.g., immediately adjacent the face portion 42) in a forward-to-rearward direction, relative to the drop in height of the crown portion 19 in the forward-to-rearward direction, than conventional golf club heads. In some implementations, the crown portion 19 can be defined as having a bulbous shape nearer the forewardmost point of the crown portion 19 than the rearwardmost point of the crown portion 19. The profile of the crown portion 19 can be defined according to the height of the crown portion 19 from the ground plane 80 (i.e., crown height), when the golf club head 10 is in the address position on the ground plane 80, relative to a location on the y-axis of the club head origin coordinate system 85. The crown height can be equal to the position of the crown portion 19 relative to or on the z-axis of the golf club head origin coordinate system 85. Referring to FIGS. 15 and 16, the crown heights of the golf club head 10 at different locations (e.g., A-L in FIG. 15 and A-M in FIG. 16) along the y-axis of the club head origin coordinate system 85 are represented. Generally, the peak crown height $H_{PCH}$ of the golf club head 10 is the highest maximum crown height of the golf club head 10 at any location on the golf club head 10 or the distance away from the ground plane 80, in the vertical direction (i.e., z-direction), to the highest point on the golf club head 10 when the golf club head 10 is in the address position on the ground plane 80.

According to one particular embodiment, the maximum crown heights of the golf club head 10 of FIG. 15 at locations A-L on the crown portion 19 with a y-axis coordinate, in the club head origin coordinate system 85, are indicated in Table 3 below. It is noted that the y-axis coordinates associated with the maximum crown heights of Tables 3 and 4 are not necessarily associated with an x-axis coordinate, in the club head origin coordinate system 85, of zero. For example, the location of the maximum crown heights may be off-center relative to the y-axis in the club head origin coordinate system 85, such that x-axis coordinate associated with the y-axis coordinates in the Tables 3 and 4, may be a negative number less than zero (e.g., toe-ward of the origin of the club head origin coordinate system 85) or a positive number greater than zero (e.g., heel-ward of the origin of the club head origin coordinate system 85).

TABLE 3

| Location | Y-axis (mm) | Crown Height (mm) |
|---|---|---|
| A | −6.2555 | 54.0163 |
| B | 0 | 60.5771 |
| C | 10 | 63.1802 |
| D | 20 | 64.1542 |
| E | 30 | 63.4926 |
| F | 40 | 61.2104 |
| G | 50 | 57.2966 |
| H | 60 | 51.7161 |
| I | 70 | 44.2926 |
| J | 80 | 34.908 |
| K | 90 | 23.5885 |
| L | 98 | 11.8734 |

According to another embodiment, the maximum crown heights of the golf club head 10 of FIG. 16 at locations A-M on the crown portion 19 with a y-axis coordinate, in the club head origin coordinate system 85, are indicated in Table 4 below.

TABLE 4

| Location | Y-axis (mm) | Crown Height (mm) |
|---|---|---|
| A | −5.197 | 53.9296 |
| B | 0 | 59.4379 |
| C | 10 | 61.8235 |
| D | 20 | 62.7604 |
| E | 30 | 62.2704 |
| F | 40 | 60.3488 |
| G | 50 | 56.9642 |
| H | 60 | 52.0567 |
| I | 70 | 45.5121 |
| J | 80 | 37.2585 |
| K | 90 | 27.3727 |
| L | 100 | 15.6311 |
| M | 102 | 13.0849 |

The crown heights and y-axis locations of the Tables 3 and 4, presented above, can be analogous to the crown heights and y-axis locations of other embodiments of the golf club head 10. For example, in some embodiments, the crown heights for the golf club head 10 may fall within a range of 52-60 mm at a head origin y-axis coordinate of about −5 mm; a range of 56-62 mm at a head origin y-axis coordinate of about 0 mm; a range of 59-66 mm at a head origin y-axis coordinate of about 10 mm; a range of 61-68 mm at a head origin y-axis coordinate of about 20 mm; a range of 61-68 mm at a head origin y-axis coordinate of about 30 mm; a range of 59-66 mm at a head origin y-axis coordinate of about 40 mm; a range of 56-63 mm at a head origin y-axis coordinate of about 50 mm; a range of 51-57 mm at a head origin y-axis coordinate of about 60 mm; a range of 44-51 mm at a head origin y-axis coordinate of about 70 mm; a range of 34-42 mm at a head origin y-axis coordinate of about 80 mm; a range of 22-31 mm at a head origin y-axis coordinate of about 90 mm; a range of 9-24 mm at a head origin y-axis coordinate of about 100 mm. Importantly, the above ranges are provided as examples of various ranges of heights at various y-axis coordinate locations. Further examples and methods of defining crown height are provided below that may have differing ranges than those specified directly above.

In view of Tables 3 and 4 and the ranges above, and according to at least one implementation, a ratio of the peak crown height to a height of a forwardmost point of the crown portion from the ground plane, when the golf club head is in the address position on the ground plane, may be greater than about 1.00. In other implementations a ratio of the peak crown height to a height of a forwardmost point of the crown portion from the ground plane may be greater than about 1.12, such as greater than about 1.13, such as greater than about 1.14, such as greater than about 1.15, or such as greater than about 1.16. Additionally, according to Tables 3 and 4 and the ranges above, in at least one implementation, a ratio of the peak crown height to a height of a rearwardmost point of the crown portion from the ground plane, when the golf club head is in the address position on the ground plane, may be greater than about 2.8. In other implementations, a ratio of the peak crown height to a height of a rearwardmost point of the crown portion from the ground plane may be greater than about 3.1, such as greater than about 3.3, such as greater than about 3.5, such as greater than about 3.7, such as greater than about 3.9, such as greater than about 4.1, such as greater than about 4.3, such as greater than about 4.5, or such as greater than about 4.7. In addition, the rearwardmost point of the crown ($H_{RCH}$) will generally be less than Zup, such as at least 3 mm less than Zup, such as at least 5 mm less than Zup, such as at least 7 mm less than Zup, such as at least 9 mm less than Zup, or such as at least 11 mm less than Zup. For example, an exemplary embodiment may satisfy the following inequalities $H_{PCH}/H_{RCH}>3.3$, $Zup>H_{RCH}$, and $Zup-0.5*H_{PCH}<-5.75$ and other combinations of the inequalities discussed above.

Figure 23:
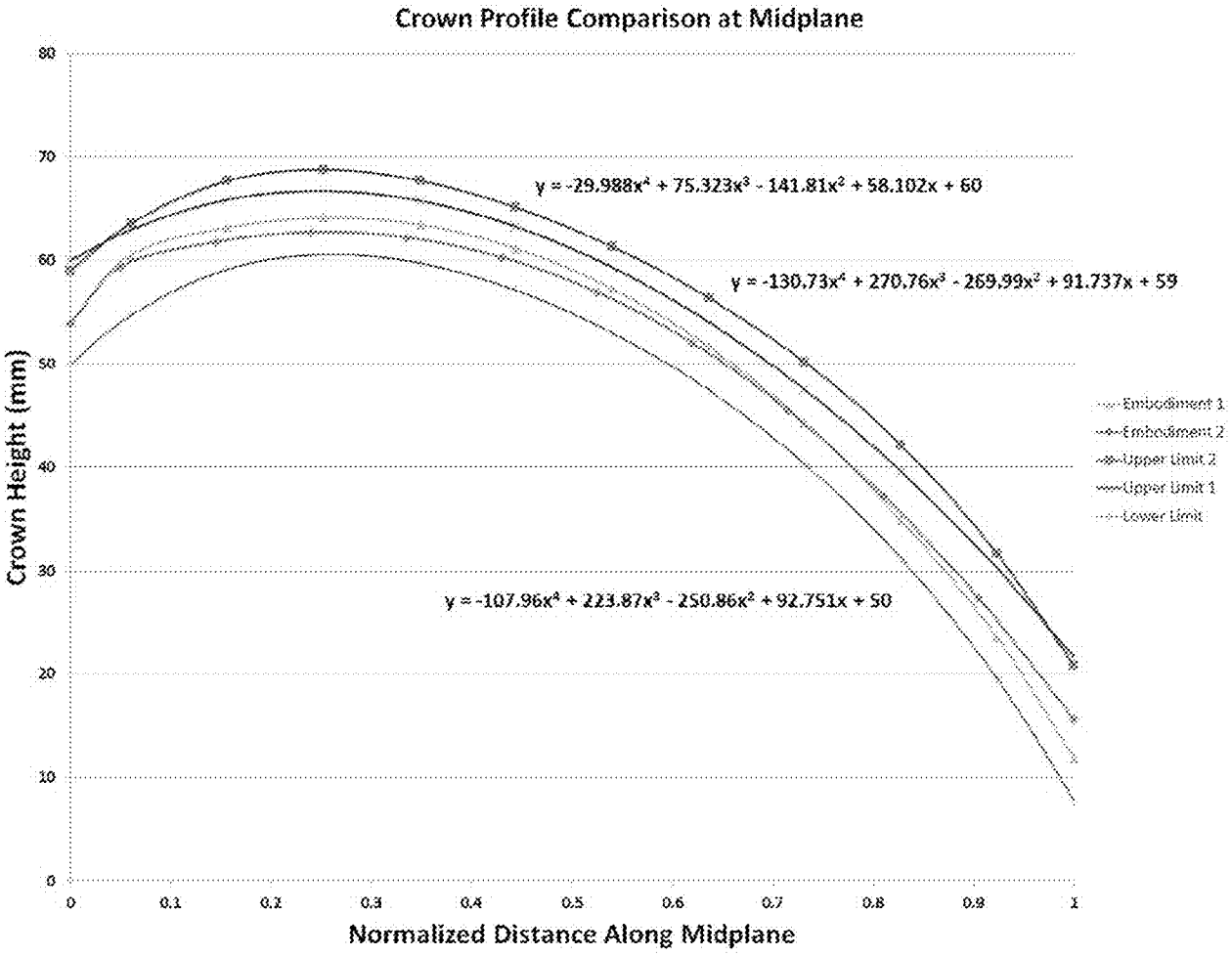
FIG. 23 is a chart showing values for crown height versus normalized location on a crown portion along a midplane for some golf club heads of the present disclosure, according to one or more examples of the present disclosure.

According to one specific embodiment, and referring to FIG. 23, the profile of the crown portion 19 of the golf club head 10 expressed in terms of the crown height $H_{CH}$ (in millimeters) of a percentage of the crown portion 19 of the golf club head 10, along a plane (e.g., midplane) passing through a center of the striking face of the face portion and perpendicular to the ground plane and when the golf club head is in the address position on the ground plane, being between, Equation 1 and Equation 2 as follows:

$$H_{CH}=-130.73x^4+270.76x^3-269.99x^2+91.737x+59 \quad (1)$$

$$H_{CH}=-107.96x^4+223.87x^3-250.86x^2+92.751x+50 \quad (2)$$

where x is a normalized forward-to-rearward depth (e.g., distance) of the crown portion 19 of the golf club head. In one implementation, the percentage of the crown portion 19 of the golf club head 10 having a crown height $H_CH$ along the midplane between Equation 1 (e.g., a second upper limit) and Equation 2 (e.g., a lower limit) may be at least 90%, at least 95%, or 100%. The normalized forward-to-rearward depth of the crown portion 19 of the golf club head 10 has a value between 0 and 1, and can be determined by applying the following equation $$(x_i-x_{min})/(x_{max}-x_{min}) \quad (3)$$

where $x_i$ is the depth of the crown portion 19 of the golf club head 10, $x_{min}$ is the start of the crown portion 19 of the golf club head 10, and thus has a value of zero, and $x_{max}$ is the maximum or overall depth of the crown portion 19 of the golf club head 10. Accordingly, a normalized value of zero corresponds with the transition from the face portion 42 to the crown portion 19 and a normalized value of one corresponds with the transition from the crown portion 19 to the skirt portion 21.

According to another specific embodiment, and again referring to FIG. 23, the profile of the crown portion 19 of the golf club head 10 expressed in terms of the crown height $H_{CH}$ (in millimeters) of a percentage of the crown portion 19 of the golf club head 10, along a plane (e.g., midplane) passing through a center of the striking face of the face portion and perpendicular to the ground plane and when the golf club head is in the address position on the ground plane, being between, Equation 4 below and Equation 2 above:

$$H_{CH}=-29.988x^4+75.323x^3-141.81x^2+58.102x+60 \quad (4)$$

where x is a normalized forward-to-rearward depth of the crown portion 19 of the golf club head. In one implementation, the percentage of the crown portion 19 of the golf club head 10 having a crown height $H_{CH}$ along the midplane between Equation 4 (e.g., a first upper limit) and Equation 2 may be at least 90%, at least 95%, or 100%.

As shown in FIG. 23, 100% of the profiles, along the midplanes, of the crown portions of embodiment 1 of the golf club head described herein (see, e.g., FIGS. 1-10B) and embodiment 2 of the golf club head described herein (see, e.g., FIGS. 24-33*b*) fit between Equation 1 and Equation 2, and between Equation 4 and Equation 2.

In yet another embodiment, the profile of the crown portion 19 of the golf club head 10 expressed in terms of the crown height $H_{CH}$ (in millimeters) of a percentage of the crown portion 19 of the golf club head 10, along the midplane when the golf club head is in the address position on the ground plane, meets the following equation $$-0.0088y^2+0.4467y+x \quad (5)$$

where y is a forward-to-rearward depth of the golf club head 10 i.e. $D_{CH}$ and x may be a value between about 56 and about 62 mm. In one implementation, the percentage of the crown portion 19 of the golf club head 10 having a crown height $H_{CH}$ along the midplane that meets Equation 5 may be at least 90%, at least 95%, or 100%. Values for $D_{CH}$ are specified above.

As shown in FIGS. 9A, 9B, 11, 13-16, and 23, an entirety of the exterior surface of the crown portion 19 if the golf club head 10 described herein may be convex. In other words, in some embodiments, the crown portion 19 of the golf club head 10 described herein may not include any points of inflection.

Further, as used herein, Delta 1 (i.e., D1) is a measure of how far rearward in the body 11 of the golf club head 10 the CG 82 is located. More specifically, Delta 1 is the distance between the CG 82 and the hosel axis along the y-axis of the club head origin coordinate system 85.

It has been observed that smaller values of Delta 1 result in lower projected CGs on the striking face 43 of the golf club head 10. Having the CG project at or near the center face 93 of the golf club head 10 provides better energy transfer for shots struck at center face 93. However, reducing Delta 1 also reduces the forgiveness of the club head 10 (i.e. the moment of inertia about the z-axis (Izz) and the x-axis (Ixx)). Thus, a golf club head designer must find a balance between a low CG projection and club head "forgiveness" or moment of inertia. In the past, golf club head designers have favored a golf club head with a higher moment of inertia over one with a low CG projection. As a result, nearly all USGA conforming golf club heads with large volumes (375 $cm^3$-470 $cm^3$) have a CG that projects well above (6 mm-10 mm) the center face of the golf club head. As defined herein, the CG projection or projected CG point is the point on the striking face 43 that intersects with a line that is normal to a tangent line of the striking face 43 (at the geometric center 93 of the striking face 43) and that passes through the CG 82. This projected CG point can also be referred to as the "zero-torque" point because it indicates the point on the striking face 43 that is centered with the CG 82. Thus, if a golf ball makes contact with the striking face 43 at the projected CG point, the golf club head will not twist about any axis of rotation since no torque is produced by the impact of the golf ball.

By incorporating the geometry described above, the golf club head 10 can achieve a relatively low CG projection (e.g., <4 mm above center face 93), while achieving a relatively high moment of inertia (e.g., Ixx>220 kg-mm^2 and Izz>350 kg-mm^2). The rapidly descending crown shape, the large difference between Zup and half of the peak crown height $H_{PCH}$, crown thickness, and crown material all play a role in achieving a relatively low CG projection and a relatively high moment of inertia. The crown shape allows less of the crown to be above the center face 93 of the golf club head 10, and the crown thickness along with the less dense crown material means the weight above the center face 93 of the golf club head 10 is less of a penalty because it is lighter. Adjusting the location of the discretionary mass in a golf club head, as described above, can provide the desired Delta 1 value. For instance, Delta 1 can be manipulated by varying the mass in front of the CG 82 (e.g., closer to the striking face 43) with respect to the mass behind the CG 82 (e.g., closer to the rearward region 18). That is, by increasing the mass behind the CG with respect to the mass in front of the CG 82, Delta 1 can be increased. In a similar manner, by increasing the mass in front of the CG 82 with the respect to the mass behind the CG 82, Delta 1 can be decreased.

As mentioned above, the position of the CG 82 relative to the head origin of the golf club head 10, expressed in terms of the location of the CG 82 on the club head origin coordinate system 85 centered at the head origin 84 (e.g., CGx (i.e., the position of the CG 82 on the x-axis of the club head origin coordinate system), Delta 1 (i.e., the position of the CG 82 on the y-axis of the club head origin coordinate system), and Zup (i.e., the position of the CG 82 on the z-axis of the club head origin coordinate system)), can be a characteristic of the golf club head 10 that affects the performance of the golf club head 10. The head origin can be the head origin 84 and the club head origin coordinate system can be the club head origin coordinate system 85 as shown in FIGS. 15 and 16. However, in other embodiments, the head origin of the golf club head 10 can be defined in other ways. For example, the CGx and Zup values in Tables 5-7 below are based on a club head origin coordinate system centered at a head origin located at a geometric center of the striking face 43 of the golf club head 10 with x-axis, y-axis, and z-axis parallel to the x-axis, y-axis, and z-axis of the club head origin coordinate system 85.

In addition to the position of the CG 82 of a golf club head 10 with respect to a head origin of the golf club head 10, another property of the golf club head 10 is a projected CG point on the striking face 43 of the golf club head 10. The projected CG point (CG Proj) is the point on the striking face 43 that intersects a line normal to the tangent line of the striking face 43 and passing through the CG 82. Moreover, the projected CG point can also be referred to as a "zero-torque" point because it indicates the point on the striking face 43 that is centered with the CG 82. Thus, if a golf ball makes contact with the striking 43 at the projected CG point, the golf club head 10 will not twist about any axis of rotation since no torque is produced by the impact of the golf ball. A negative number for this property indicates that the projected CG point is below the geometric center of the face.

As introduced above, the moment of inertia (MOI) of the golf club head 10 (i.e., a resistance to twisting) is typically measured about each of the three main axes of a club head origin coordinate system with the CG 82 of the golf club head 10 acting as the origin of the coordinate system. These three axes include a CG z-axis extending through the CG 82 in a generally vertical direction relative to the ground plane 80, when the golf club head 10 is in the address position on the ground plane 80; a CGx-axis extending through the CG 82 in a toe-to-heel direction generally parallel to the striking face 43 and generally perpendicular to the CG z-axis, when the golf club head 10 is in the address position on the ground plane 80; and a CG y-axis extending through the CG 82 in a forward-to-rearward direction and generally perpendicular to the CG x-axis and to the CG z-axis, when the golf club head 10 is in the address position on the ground plane 80. The CG x-axis and the CG y-axis both extend in generally horizontal directions relative to the ground plane 80 and the CG z-axis extends in a generally vertical direction relative to the ground plane 80, when the golf club head 10 is in the address position on the ground plane 80. Thus, the axes of the CG origin coordinate system of the golf club head 10 are parallel to corresponding axes of the club head origin coordinate system (e.g., club head origin coordinate system 85) of the golf club head 10.

The golf club head 10 has an MOI about the CG z-axis (Izz), an MOI about the CG x-axis (Ixx), and a moment of inertia about the CG y-axis (Iyy). The MOI about the CG z-axis, or Izz, and the MOI about the CG x-axis, or Ixx, affects the forgiveness of the golf club head 10 or the ability of the golf club head 10 to reduce negative effects of off-center strikes of a golf ball on the striking face 43. A further description of the coordinate systems for determining CG positions and MOI can be found in U.S. Patent Application Publication No. 2012/0172146 A1, published Jul. 5, 2012, which is incorporated herein by reference.

The moment of inertia about the CG x-axis (Ixx) is calculated by the following equation:

$$Ixx=\int(y^2+z^2)dm \tag{6}$$

where y is the distance from a CG xz-plane of the golf club head 10 to an infinitesimal mass dm and z is the distance from a CG xy-plane of the golf club head 10 to the infinitesimal mass dm. The CG xz-plane is a plane defined by the CG x-axis and the CG z-axis. Similarly, the CG xy-plane is a plane defined by the CG x-axis and the CG y-axis.

The moment of inertia about the CG z-axis (Izz) is calculated by the following equation:

$$Izz=\int(x^2+y^2)dm \tag{7}$$

where x is the distance from a CG yz-plane of the golf club head 10 to an infinitesimal mass dm and y is the distance from the CG xz-plane of the golf club head 10 to the infinitesimal mass dm. The CG yz-plane is a plane defined by the CG y-axis and CG z-axis.

Values of CGx, Delta 1, Ixx, Iyy, CG Proj, and the difference between Zup and half of the peak crown height $H_{PCH}$ for various alternative combination of masses of the front and back weights of the golf club head 10 (with the front weight aligned with a midpoint of the striking face 43 and the back weight at the rearward region 18 of the golf club head 10) having a profile of the crown portion 19 as presented above, according to one embodiment, are shown in Tables 5-7 below. The values indicated in Table 5, below, are for a golf club head 10 having a crown portion 19 with a crown insert 26 made from a fiber-reinforced polymer and a sole portion 17 with a sole insert 28 made from a fiber-reinforced polymer (e.g., the golf club head 10 of FIGS. 1-10), with a volume of 452 $cm^3$, when measured with an open front weight track, and with a total combined mass of the front and back weights of 44 grams.

TABLE 5

| Front Mass (g) | Back Mass (g) | CGx (mm) | Delta 1 (mm) | $I_{XX}$ (kg-mm$^2$) | $I_{ZZ}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 44 | 0 | 0.41 | 9.6 | 225 | 347 | −4.7 | −9.09 | 0.65 |
| 39.8 | 4.1 | 0.22 | 11.3 | 248 | 372 | −4.3 | −8.98 | 0.67 |
| 35.1 | 9.1 | 0 | 13.4 | 274 | 399 | −3.8 | −8.86 | 0.69 |
| 30 | 14 | −0.24 | 15.5 | 299 | 425 | −3.3 | −8.72 | 0.70 |
| 24.9 | 19 | −0.46 | 17.6 | 321 | 449 | −2.8 | −8.57 | 0.71 |
| 20.1 | 24 | −0.69 | 19.6 | 342 | 471 | −2.3 | −8.45 | 0.73 |
| 15 | 29 | −0.92 | 21.7 | 361 | 492 | −1.8 | −8.3 | 0.73 |
| 9.9 | 34.4 | −1.17 | 24 | 380 | 512 | −1.3 | −8.19 | 0.74 |
| 4.9 | 39.3 | −1.4 | 26 | 396 | 528 | −0.8 | −8.05 | 0.75 |
| 0 | 44.2 | −1.62 | 28.1 | 409 | 543 | −0.3 | −7.91 | 0.75 |

The values indicated in Table 6, below, are for a golf club head 10 having a crown portion 19 with a crown insert 26 made from a fiber-reinforced polymer and a sole portion 17 made entirely from a metal, such as titanium (e.g., the golf club head 10 of FIGS. 11-13), with a volume of 452 $cm^3$, when measured with an open front weight track, and with a total combined mass of the front and back weights of 40.6 grams.

TABLE 6

| Front Mass (g) | Back Mass (g) | CGx (mm) | Delta 1 (mm) | $I_{XX}$ (kg-mm$^2$) | $I_{ZZ}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 40.5 | 0.0 | −0.09 | 10.3 | 226 | 353 | −4.7 | −9.14 | 0.64 |
| 35.7 | 5.0 | −0.31 | 12.3 | 253 | 381 | −4.2 | −9.02 | 0.66 |
| 30.5 | 10.0 | −0.54 | 14.4 | 279 | 407 | −3.7 | −8.87 | 0.69 |
| 25.4 | 15.3 | −0.78 | 16.6 | 304 | 434 | −3.1 | −8.75 | 0.70 |
| 20.3 | 20.3 | −1.02 | 18.8 | 326 | 457 | −2.6 | −8.61 | 0.71 |
| 15.2 | 25.3 | −1.25 | 20.9 | 346 | 478 | −2.1 | −8.46 | 0.72 |
| 10.0 | 30.7 | −1.49 | 23.1 | 366 | 499 | −1.6 | −8.35 | 0.73 |
| 4.9 | 35.7 | −1.72 | 25.2 | 382 | 517 | −1.1 | −8.2 | 0.74 |
| 0.0 | 40.6 | −1.95 | 27.3 | 396 | 532 | −0.6 | −8.04 | 0.74 |

The values indicated in Table 7, below, are for a golf club head 10 having a crown portion 19 and a sole portion 17 made entirely from a metal, such as titanium (e.g., the golf club head 10 of FIG. 14), with a volume of 452 $cm^3$, when measured with an open front weight track, and with a total combined mass of the front and back weights of 36.1 grams.

TABLE 7

| Front Mass (g) | Back Mass (g) | CGx (mm) | Delta 1 (mm) | $I_{XX}$ (kg-mm$^2$) | $I_{ZZ}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 36.1 | 0 | −0.28 | 11.5 | 238.0 | 363 | −3.3 | −8.03 | 0.66 |
| 30.6 | 5.64 | −0.54 | 13.9 | 267 | 394 | −2.8 | −7.89 | 0.68 |
| 25.4 | 10.75 | −0.78 | 16 | 292 | 420 | −2.3 | −7.75 | 0.70 |
| 20.3 | 15.75 | −1.01 | 18.1 | 314 | 443 | −1.8 | −7.61 | 0.71 |
| 15.2 | 20.75 | −1.24 | 20.2 | 335 | 465 | −1.2 | −7.46 | 0.72 |
| 10.0 | 26.15 | −1.48 | 22.5 | 355 | 487 | −0.7 | −7.34 | 0.73 |
| 4.9 | 31.15 | −1.71 | 24.6 | 371 | 504 | −0.2 | −7.2 | 0.74 |
| 0.0 | 36.05 | −1.94 | 26.7 | 386 | 520 | 0.3 | −7.04 | 0.74 |

Tables 5-7 above illustrate how placement of discretionary mass (e.g., front mass and back mass) can be used to alter various club head parameters including CGx, Delta 1, Ixx, Izz, CG projection, and Zup $-0.5H_{PCH}$. For example, Tables 5-7 focus on how moving weight (e.g., mass) along the y-direction impacts the various parameters. Minimal CGx movement is shown in the tables because the forward weight (i.e., front mass) was left stationary. However, the forward weight may easily be moved along the sliding weight track in either a heel or toe direction to have a more significant impact on CGx.

In some embodiments, the golf club head 10 has a CG 82 with a head origin x-axis coordinate (CGx) between about −10 mm and about 10 mm, such as between about −4 mm and about 9 mm, such as between about −3 mm and about 8 mm, or such as between about −2 mm to about 5 mm.

In some embodiments, the golf club head 10 has a Delta 1 greater than about 9.0 mm and less than about 30 mm, such as between about 11 mm and about 27 mm, such as between about 13 mm and about 25 mm, or such as between about 15 mm and about 23 mm. In some embodiments, the golf club head 10 has at least one movable weight (e.g., back mass) that can be moved from the front of the golf club head 10 to the rear of the golf club head 10 using either front and rear weight ports or a sliding weight track allowing for a Max change (Max Δ) in Delta 1 that may be greater than 2 mm, such as greater than 3 mm, such as greater than 4 mm, such as greater than 5 mm, such as greater than 6 mm, such as greater than 7 mm, or such as greater than 8 mm. In some embodiments, the golf club head 10 has at least one movable weight that can be moved from the front of the golf club to the rear of the golf club using either front and rear weight ports or a sliding weight track allowing for a Max Δ Delta 1 from a first weight position to a second weight position that may be between 1.7 mm and 18.5 mm, such as between 2 mm and 6 mm, or such as between about 2.5 mm and about 5 mm. As illustrated by the tables above several other ranges are possible to achieve.

In addition, Tables 5-7 illustrate the movement of the CG 82 in the x, y, and z directions as the at least one weight location may be adjusted on the club head. As shown there, adjusting the weight front to back has little effect on CGx which ranges from 0.41 mm when the weight is in the forward position to −1.6 mm when the weight is in the rear position, providing a Max ΔCGx of 2.0 mm. In addition, the range of adjustment for CGz is from −5.9 mm when the weight is in the forward position to −4.7 mm when the weight is in the rear position, providing a Max ΔCGz of 1.2 mm. However, if less weight is being moved then the change in CGz will decrease, in some embodiments Max ΔCGz may be less than 1 mm, such as less than 0.8 mm, such as less than 0.7 mm, such as less than 0.6 mm, or such as less than 0.6 mm.

Another important relationship is the ratio of Ixx to Izz. Generally, it is desirable to have the ratio of Ixx to Izz be at least 0.55. As shown in Tables 5-7, the various embodiments were able to achieve a higher ratio than this. As shown, Ixx/Izz may be at least 0.59, such as at least 0.62, such as at least 0.65, such as at least 0.68, such as at least 0.71, or such as at least 0.74. Generally, it is desirable to have Ixx be at least 200 kg-mm^2 and preferably at least 250 kg-mm^2, and Izz be at least 350 kg-mm^2 and preferably at least 400 kg-mm^2. As shown in Tables 5-7, the various embodiments were able to achieve a higher moment of inertia values than this. As shown, Ixx may be at least 225 kg-mm^2, such as at least 250 kg-mm^2, such as at least 275 kg-mm^2, such as at least 300 kg-mm^2, such as at least 325 kg-mm^2, such as at least 350 kg-mm^2, such as at least 375 kg-mm^2, such as at least 390 kg-mm^2, or such as at least 400 kg-mm^2. Similarly, as shown in Tables 5-7 Izz may be at least 325 kg-mm^2, such as at least 350 kg-mm^2, such as at least 375 kg-mm^2, such as at least 400 kg-mm^2, such as at least 425 kg-mm^2, such as at least 450 kg-mm^2, such as at least 475 kg-mm^2, such as at least 490 kg-mm^2, or such as at least 510 kg-mm^2.

As shown in Tables 5-7 and described above, the various embodiments were able to achieve a Zup relative to half head height of less than at least −5.75 mm, such as less than at least −6.0 mm, such as less than at least −6.25 mm, such as less than at least −6.5 mm, such as less than at least −6.75 mm, such as less than at least −7.0 mm, such as less than at least −7.25 mm, such as less than at least −7.50 mm, such as less than at least −7.75 mm, such as less than at least −8.0 mm, such as less than at least −8.25 mm, such as less than at least −8.50 mm, such as less than at least −8.75 mm, or such as less than at least −9.0 mm. As shown in Tables 5-7, the various embodiments were able to achieve a CG projection relative to half head height of less than at least 0.5 mm, such as less than at least 0.0 mm, such as less than at least −0.50 mm, such as less than at least −0.75 mm, such as less than at least −1.0 mm, such as less than at least −1.25 mm, such as less than at least −1.50 mm, such as less than at least −1.75 mm, such as less than at least −2.0 mm, such as less than at least −2.25 mm, such as less than at least −2.5 mm, such as less than at least −2.75 mm, such as less than at least −3.0 mm, such as less than at least −3.25 mm, such as less than at least −3.5 mm, such as less than at least −3.75 mm, such as less than at least −4.0 mm, such as less than at least −4.25 mm, or such as less than at least −4.5 mm.

Figure 22:
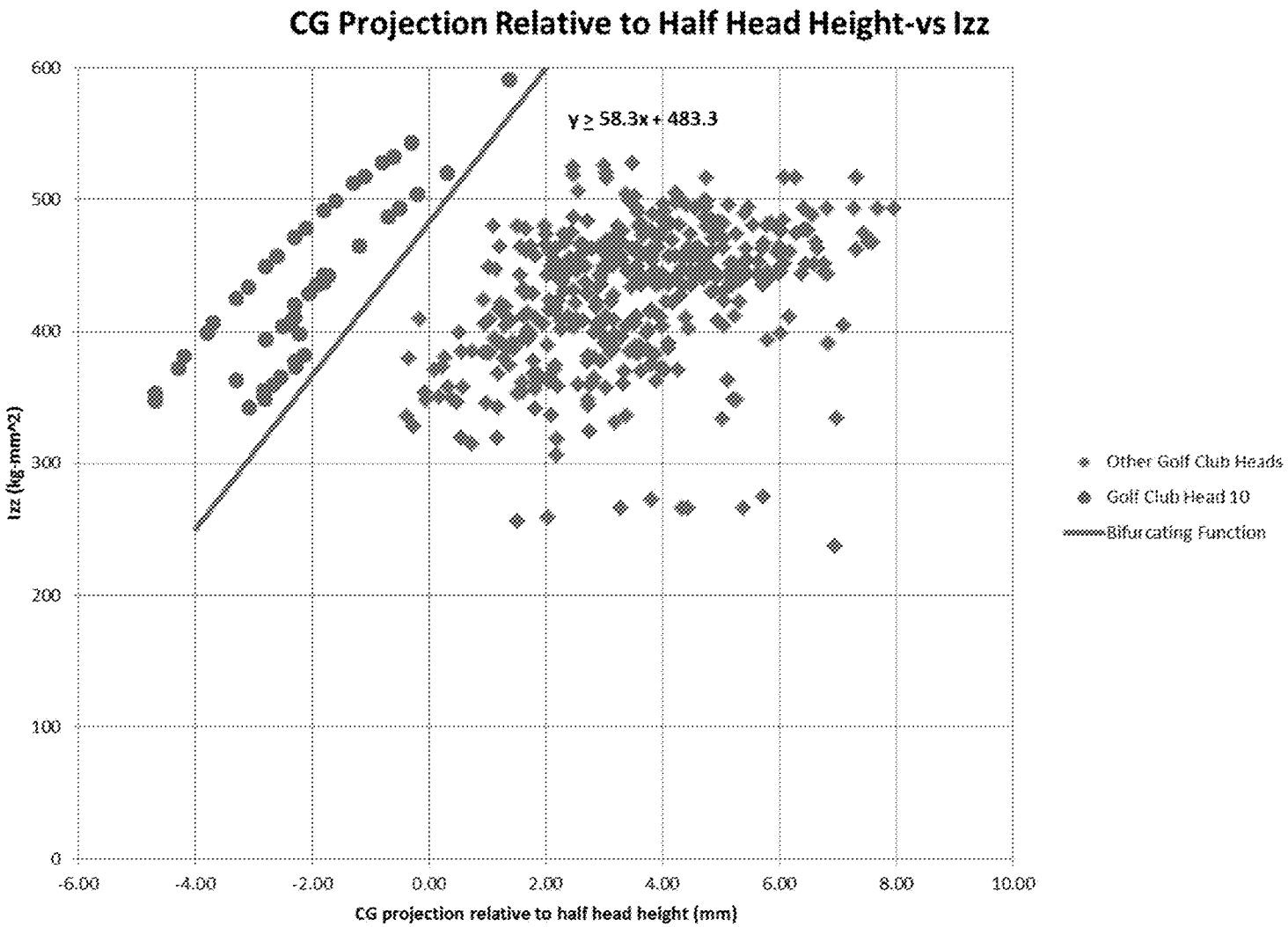
FIG. 22 is a chart showing values for projected center-of-gravity relative to half of the peak crown height versus the moment of inertia about the z-axis for some golf club heads of the present disclosure and other golf club heads, according to one or more examples of the present disclosure.

In some implementations, values for projected CG relative to half of the peak crown height versus the moment of inertia about the z-axis (Izz) for some golf club heads 10 of the present disclosure and other golf club heads, when in the address position on the ground plane 80, are shown in FIG. 22. As defined herein, projected CG relative to half of the peak crown height is defined as the minimum distance of the CG projection of the golf club head 10 away from the ground plane 80 minus half of the peak crown height.

In some embodiments of a golf club head 10 having a weight assembly, such as weight assembly 41, that is adjustably positioned within a substantially heel to toe channel, such as weight track 36 (see, e.g., FIG. 1), the weight assembly can have an origin x-axis coordinate between about −50 mm and about 65 mm, depending upon the location of the weight assembly within the toe channel. In specific embodiments, the weight assembly can have an origin x-axis coordinate between about −45 mm and about 60 mm, or between about −40 mm and about 55 mm, or between about −35 mm and about 50 mm, or between about −30 mm and about 45 mm, or between about −25 mm and about 40 mm, or between about −20 mm and about 35 mm. Thus, in some embodiments, the weight assembly is provided with a maximum x-axis adjustment range (Max Δx) that may be greater than 50 mm, such as greater than 60 mm, such as greater than 70 mm, such as greater than 80 mm, such as greater than 90 mm, such as greater than 100 mm, or such as greater than 110 mm. The heel-toe channel may be designed to be relatively flat such that large adjustments of the weight within the channel would only have a minimal impact on Delta 1 and Zup. For example, throughout the adjustability range of a heel to toe channel, Delta 1 and Zup may change less than 1 mm, less than 0.8 mm, less than 0.7 mm, or less than 0.6 mm.

On the other hand, in some embodiments of the golf club head 10 having a weight assembly, such as weight assembly 32, that is adjustably positioned within a substantially front-to-back channel, such as weight track 30, the weight assembly can have an origin y-axis coordinate between about 10 mm and about 120 mm. More specifically, in certain embodiments, the weight assembly can have an origin y-axis coordinate between about 20 mm and about 110 mm, between about 20 mm and about 100 mm, between about 20 mm and about 90 mm, between about 20 mm and about 80 mm, between about 20 mm and about 70 mm, or between about 20 mm and about 60 mm. Thus, in some embodiments, the weight assembly is provided with a maximum y-axis adjustment range (Max Δy) that may be greater than 40 mm, such as greater than 50 mm, such as greater than 60 mm, such as greater than 70 mm, such as greater than 80 mm, such as greater than 90 mm, or such as greater than 100 mm. The front-to-back channel may be also designed to be relatively flat such that large adjustments of the weight within the channel would only have a minimal impact on CGx and Zup. For example, throughout the adjustability range of a front-to-back channel CGx and Zup may change less than 1 mm, less than 0.8 mm, less than 0.7 mm, or less than 0.6 mm.

Additionally, or alternatively, as described above, a front-to-back channel may be angled relative to the striking face 43 to promote either a draw or fade bias by shifting CGx heelward or toeward. For example, a weight assembly in a front-to-back channel that may be angled between about 15 degrees and 45 degrees relative to the striking face 43 and the y-plane can have an origin y-axis coordinate between about 10 mm and about 90 mm and an origin x-axis coordinate between about −40 mm and about 40 mm, such as a x-axis coordinate between about −20 mm and about 40 mm, such as a x-axis coordinate between about 0 mm and about 40 mm, or such as a x-axis coordinate between about −10 mm and about 40 mm. In the example of an angled sliding weight track, the weight track may still be designed such that movement of the weight throughout the adjustability range has minimal impact on Zup, such as Zup may change less than 1 mm, less than 0.8 mm, less than 0.7 mm, or less than 0.6 mm.

As mentioned above, the golf club head 10 may have a rearwardly positioned weight assembly, such as weight assembly 32 of FIGS. 9A-10B, that may be fixed and a forwardly positioned weight assembly, such as weight assembly 41 that may be slidable. In some embodiments, the mass of the at least one fixed weight assembly or at least one slidable weight assembly may be between about 5 g and about 25 g, such as between about 7 g and about 20 g, or such as between about 9 g and about 15 g. In some alternative embodiments, the mass of the at least one fixed weight assembly or at least one slidable weight assembly may be between about 5 g and about 45 g, such as between about 9 g and about 35 g, such as between about 9 g and about 30 g, or such as between about 9 g and about 25 g.

In some embodiments, the golf club head 10 can be configured to have constraints relating to the product of the mass of the weight assembly and the relative distances that the weight assembly can be adjusted in the origin x-direction and/or origin y-direction. One such constraint can be defined as the mass of the weight assembly (MWA) multiplied by the maximum x-axis adjustment range (Max Δx). According to some embodiments, the value of the product of MWA×(Max Δx) may be between about 250 g·mm and about 4950 g·mm. In specific embodiments, the value of the product of MWA×(Max Δx) may be between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

In some embodiments, the golf club head 10 can be configured to have constraints relating to the product of the mass of the weight assembly and the relative distances that the weight assembly can be adjusted in the origin x-direction and/or origin y-direction. One such constraint can be defined as the mass of the weight assembly (MWA) multiplied by the maximum y-axis adjustment range (Max Δy). According to some embodiments, the value of the product of MWA×(Max Δy) may be between about 250 g·mm and about 4950 g·mm. In specific embodiments, the value of the product of MWA×(Max Δy) may be between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

According to some embodiments, the golf club head 10 of the present disclosure includes at least one coefficient of restitution (COR) feature located on the sole portion of the body 11 of the golf club head 10. The COR of the golf club head 10 is a measurement of the energy loss or retention between the golf club head 10 and a golf ball when the golf ball is struck by the golf club head 10. Desirably, the COR of the golf club head 10 is high to promote the efficient transfer of energy from the golf club head 10 to the ball during impact with the ball. Accordingly, the COR feature of the golf club head 10 promotes an increase in the COR of the golf club head 10.

In some implementations of the golf club head 10, the COR feature is one or more of a channel, slot, or some other member configured to increase the COR of the golf club head 10. Generally, the COR feature, such as the channel or slot, increases the COR of the golf club head 10 by increasing or enhancing the perimeter flexibility of the striking face 43 of the golf club head 10. According to certain implementations, the COR feature may be located in the forward region 12 of the sole portion 17 of the body 11, adjacent to or near to a forwardmost edge of the sole portion 17.

Further details concerning the channel of the COR feature of the golf club head 10 can be found in U.S. patent application Ser. Nos. 13/338,197, 13/469,031, 13/828,675, filed Dec. 27, 2011, May 10, 2012, and Mar. 14, 2013, respectively, and incorporated herein by reference in their entirety. Additional details concerning the slot of the COR feature of the golf club head 10 can be found in U.S. patent application Ser. No. 13/839,727, filed Mar. 15, 2013, and incorporated herein by reference in its entirety. Yet further details concerning the COR feature of the golf club head 10 can be found in U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

Referring to FIG. 18, the golf club head 10, in one embodiment, includes a rear weight track 30 and a COR feature in the form of a forward slot 96. The forward slot 96 allows for greater perimeter flexibility thereby maintaining and/or increasing COR across the striking face 43 of the golf club head 10. Additionally, or alternatively, toe and heel weight ports may be included in this embodiment.

According to another embodiment, as shown in FIG. 19, the golf club head includes a rear weight track 30, a forward slot 96, and a forward weight 41. The forward slot 96 enhances the COR across the striking face 43 of the golf club head 10. The forward weight 41, which can be a non-sliding weight non-movably fixed on the forward region 12 of golf club head 10, provides additional weight in the forward region 12 of the golf club head 10. The forward weight 41 overhangs the forward slot 96 in one implementation. As discussed above, the forward weight 41 can allow for a high MOI club by moving the sliding weight 32 to the rearward position, or a low and forward CG golf club by moving the sliding weight 32 to the forward position. Additionally, or alternatively, toe and heel weight ports may be included in this embodiment.

The forward slot 96 shown in FIGS. 18 and 19, may be a through-slot as discussed above and in U.S. patent application Ser. No. 13/839,727. As indicated in FIG. 20, the forward slot 96 may have a width (W), length (L), and perimeter. In some embodiments, the width of the forward slot 96 may be between about 5 mm and about 20 mm, such as between about 10 mm and about 18 mm, such as between about 12 mm and about 16 mm, or it may be larger or smaller. The length of the forward slot 96 may be between about 30 mm and about 120 mm, such as between about 50 mm and about 100 mm, such as between about 60 mm and about 90 mm, or it may be larger or smaller. Additionally, or alternatively, the length of the slot may be represented as a percentage of a length of the striking face 43. For example, the forward slot 96 may be between about 30% and about 100% of the striking face length, such as between about 50% and about 90%, or such as between about 60% and about 80% mm of the length of the striking face 43. The perimeter of the forward slot 96 may be between about 70 mm and about 280 mm, such as between about 120 mm and about 240 mm, such as between about 160 mm and about 200 mm, or it may be larger or smaller.

Referring still to FIG. 20, an offset (OS) between a vertical plane 98 intersecting the center 93 of the striking face 43 and the forward slot 96 at the same x-axis coordinate as the center 93 of the striking face 43 may be between about 5 mm and about 25 mm, such as between about 8 mm and about 18 mm, or such as between about 10 mm and about 15 mm.

The forward slot 96 may be made up of curved sections, or several segments that may be a combination of curved and straight segments. Furthermore, the forward slot 96 may be machined or cast into the head. Although shown in the sole portion 17 of the golf club head 10, the forward slot 96 may be incorporated into the crown portion 19 of the golf club head 10.

The forward slot 96 or channel may be filled with a material to prevent dirt and other debris from entering the slot or channel and possibly the cavity of the golf club head 10 when the slot is a through-slot. The filling material may be any relatively low modulus materials including polyurethane, elastomeric rubber, polymer, various rubbers, foams, and fillers. The plugging material should not substantially prevent deformation of the golf club head 10 when in use as this would counteract the perimeter flexibility.

The golf club head 10 of the present disclosure may include other features to promote the performance characteristics of the golf club head 10. For example, the golf club head 10, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 10 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 10 includes aerodynamic shape features similar to those described in more detail in U.S. Patent Application Publication No. 2013/0123040A1, the entire contents of which are incorporated herein by reference in their entirety.

In certain implementations, the golf club head 10 includes removable shaft features similar to those described in more detail in U.S. Pat. No. 8,303,431, the contents of which are incorporated by reference herein in in their entirety.

According to yet some implementations, the golf club head 10 includes adjustable loft/lie features similar to those described in more detail in U.S. Pat. No. 8,025,587; U.S. Pat. No. 8,235,831; U.S. Pat. No. 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 10 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

According to certain implementations, the golf club head 10 includes variable thickness face portion features similar to those described in more detail in U.S. patent application Ser. No. 12/006,060; and U.S. Pat. Nos. 6,997,820; 6,800,038; and 6,824,475, which are incorporated herein by reference in their entirety.

In some implementations, the golf club head 10 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club, such as golf club head 10, includes one or more of the following steps: (1) forming a frame having a sole opening, forming a composite laminate sole insert, injection molding a thermoplastic composite head component over the sole insert to create a sole insert unit, and joining the sole insert unit to the frame; (2) providing a composite head component, which is a weight track capable of supporting one or more slidable weights; (3) forming a sole insert from a thermoplastic composite material having a matrix compatible for bonding with a weight track; (4) forming a sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (5) forming both a sole insert and a weight track from thermoplastic composite materials having a compatible matrix; (6) forming a sole insert from a thermosetting material, coating a sole insert with a heat activated adhesive, and forming a weight track from a thermoplastic material capable of being injection molded over the sole insert after the coating step; (7) forming a frame from a material selected from the group consisting of titanium, one or more titanium alloys, aluminum, one or more aluminum alloys, steel, one or more steel alloys, and any combination thereof; (8) forming a frame with a crown opening, forming a crown insert from a composite laminate material, and joining the crown insert to the frame such that the crown insert overlies the crown opening; (9) selecting a composite head component from the group consisting of one or more ribs to reinforce the head, one or more ribs to tune acoustic properties of the head, one or more weight ports to receive a fixed weight in a sole portion of the golf club head, one or more weight tracks to receive a slidable weight, and combinations thereof; (10) forming a sole insert and a crown insert from a continuous carbon fiber composite material; (11) forming a sole insert and a crown insert by thermosetting using materials suitable for thermosetting, and coating the sole insert with a heat activated adhesive; (12) forming a frame from titanium, titanium alloy or a combination thereof to have a crown opening, a sole insert, and a weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the frame such that the crown insert overlies the crown opening.

Additionally, or alternatively, the body 11 and/or the frame 24 may be made of from the following materials: carbon steel, stainless steel (e.g. 17-4 PH stainless steel), alloy steel, Fe—Mn—Al alloy, nickel-based ferroalloy, cast iron, super alloy steel, aluminum alloy, magnesium alloy, copper alloy, titanium alloy or mixtures thereof. The sole insert, crown insert, and/or sliding weight track may be formed of a non-metal material with a density less than about 2 g/cm$^3$, such as between about 1 g/cm$^3$ to about 2 g/cm$^3$. The nonmetal material may be preferably comprised of a polymer or polymer reinforced composite. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyetherimide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Besides, during forming the sole insert, crown insert, and/or sliding weight track, organic short fibers, such as fiberglass, carbon fiber, or metallic fiber, can be added into the engineering plastic, so as to enhance the structural strength of the sole insert, crown insert, and/or sliding weight track. Preferably, however, the reinforcements are continuous long fibers, rather than short fibers. The most preferable thermoset would be continuous long fiber graphite epoxy composite. The most preferable thermoplastics would be either PPS or PSU polymer with continuous long fiber graphite reinforcements. One of the advantages of epoxy and PSU is both are relatively stiff with relatively low damping which produces a better sounding or more metallic sounding golf club compared to other polymers which may be overdamped. Additionally, PSU requires less post processing in that it does not require a finish or paint to achieve a final finished golf club head.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysulfones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O-C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

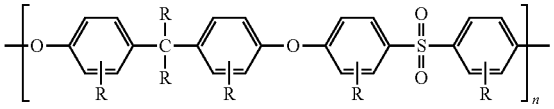

or

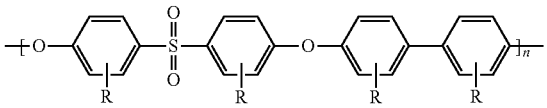

or

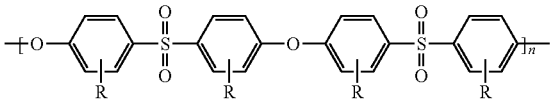

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

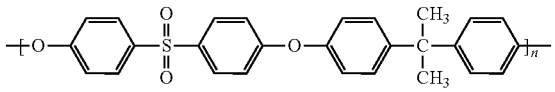

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

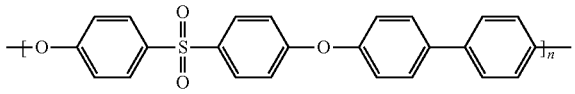

and the abbreviation PPSF and sold under the tradenames RADEL® resin; and (c) a N condensation polymer made from 4,4'-dichlorodiphenyl sulfone in the presence of base and having the principle repeating structure

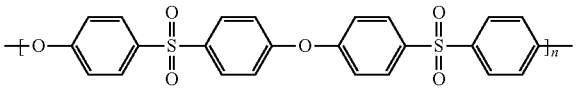

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

According to some embodiments, to use the adjustable weight systems of the golf club head 10 shown in FIGS. 1-11 and 18-20, a user will use an engagement end of a tool (such as the torque wrench) to loosen the fastening bolt of the weight assembly. Once the fastening bolt is loosened, the weight assembly may be adjusted by either sliding the weight assembly in a channel or by repositioning the weight assembly at different locations on the club head. Once the weight assembly is in the desired location, the fastening bolt may be tightened until the weight assembly is secured to the club head. In the case of a sliding weight, the weight fastening bolt may be tightened until the clamping force, between a washer and a mass member of the weight system, upon a front ledge and/or rear ledge of a weight track or channel is sufficient to restrain the weight assembly in place. In some embodiments, the golf club head may include locking projections located on the front ledge and/or rear ledge and locking notches located on the washer that cooperate to increase the locking force provided by the washer and the mass member. In other embodiments, the golf club head may include locating projections located on the front ledge and/or rear ledge and locating notches located on the washer. The locating projections or bumps are sized to have a width smaller than the width of the notches or recesses in the outer weight member or washer such that the outer weight member can move a limited amount when placed over one of the bumps. In this manner, the projections or bumps serve as markers or indices to help locate the position of the weight assembly along the channel, but do not perform a significant locking function. Instead, the weight assembly may be locked into place at a selected position along the channel by tightening the bolt.

Figure 24:
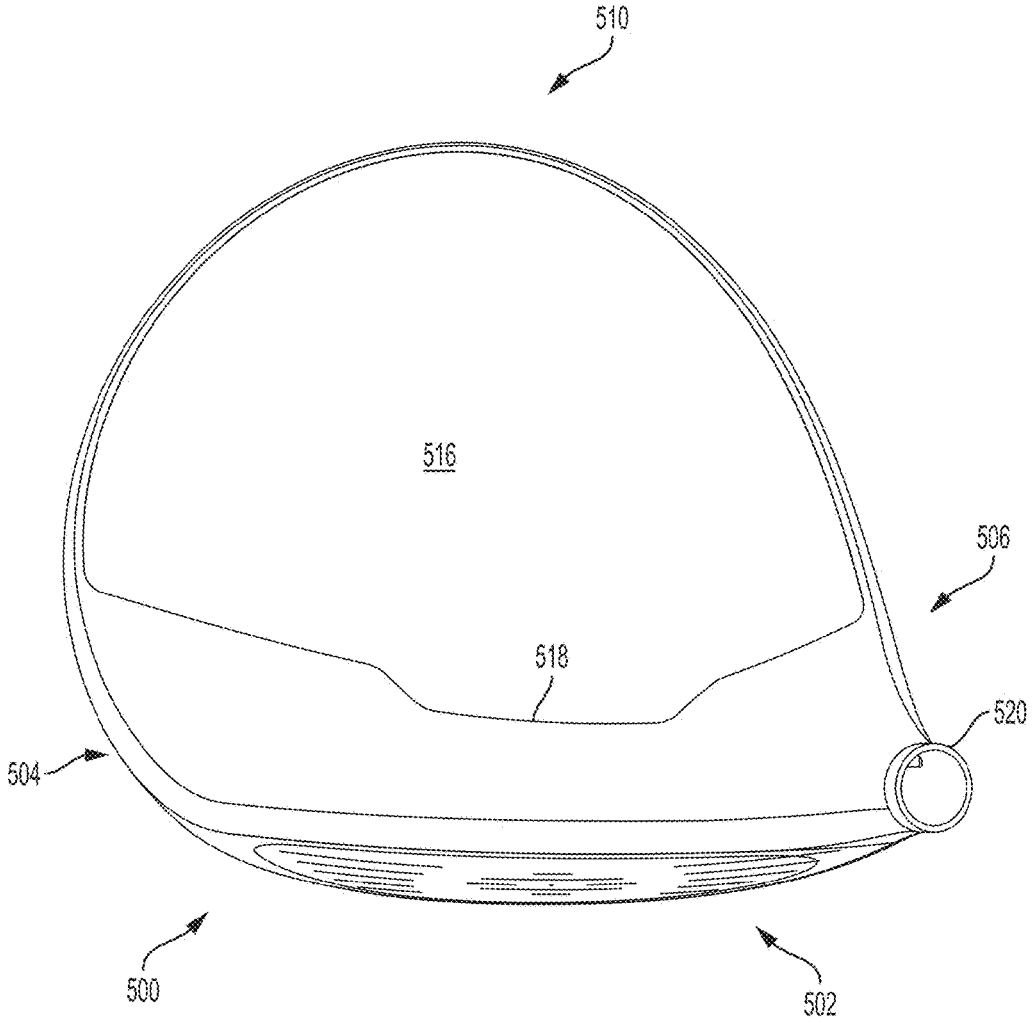
FIG. 24 is a top plan view of another golf club head, according to one or more examples of the present disclosure.
Figure 25:
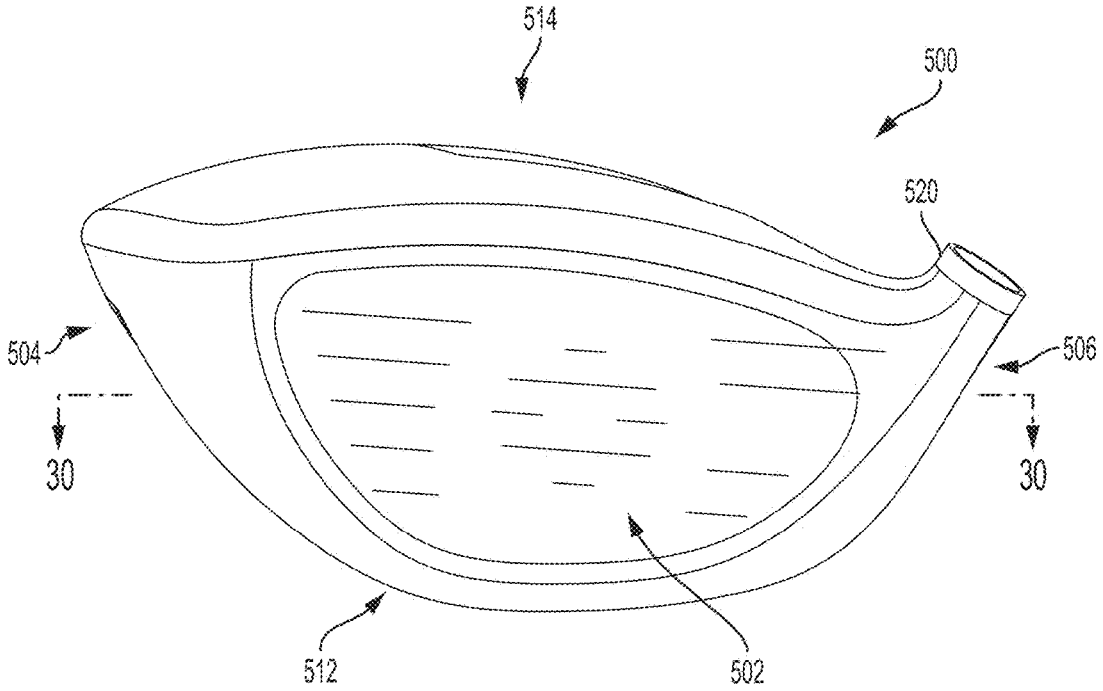
FIG. 25 is a front elevation view of the golf club head of FIG. 24, according to one or more examples of the present disclosure.

An additional embodiment of a golf club head 500 is shown in FIGS. 24-33. Referring to FIGS. 24 and 25, the head 500 includes a forward face 502, toe 504, heel 506 opposite the toe 504, and a rear or aft section 510 opposite the face 502. The head also includes a sole 512 at the bottom of the club head and crown 514 at the top, which create a surface area expanse between the toe, heel, face and aft section to form a golf club head having a generally hollow interior. The embodiment described in FIGS. 23-33 is well-suited for metal-wood type club heads, especially driver-type club heads, having a hollow interior. The volume of the club head 500 is in the range previously described and, for example, one preferred driver-type head may have a volume typical of metal-wood drivers, such as between about 375 $cm^3$ to 500 $cm^3$.

FIG. 24 further illustrates that the crown 514 includes a crown insert 516, which preferably covers a substantial portion of the crown's surface area as, for example, at least 40%, at least 60%, at least 70% or at least 80% of the crown's surface area. The crown's outer boundary generally terminates where the crown surface undergoes a significant change in radius of curvature as it transitions to the head's sole or face. In one example, the crown insert 516 is set back from the face 502 and has a forwardmost edge that generally extends between the toe and heel and defines a centrally located notch 518 which protrudes toward the face 502. The head further includes a hosel 520 on the heel side to which a golf shaft may be attached.

Figure 26:
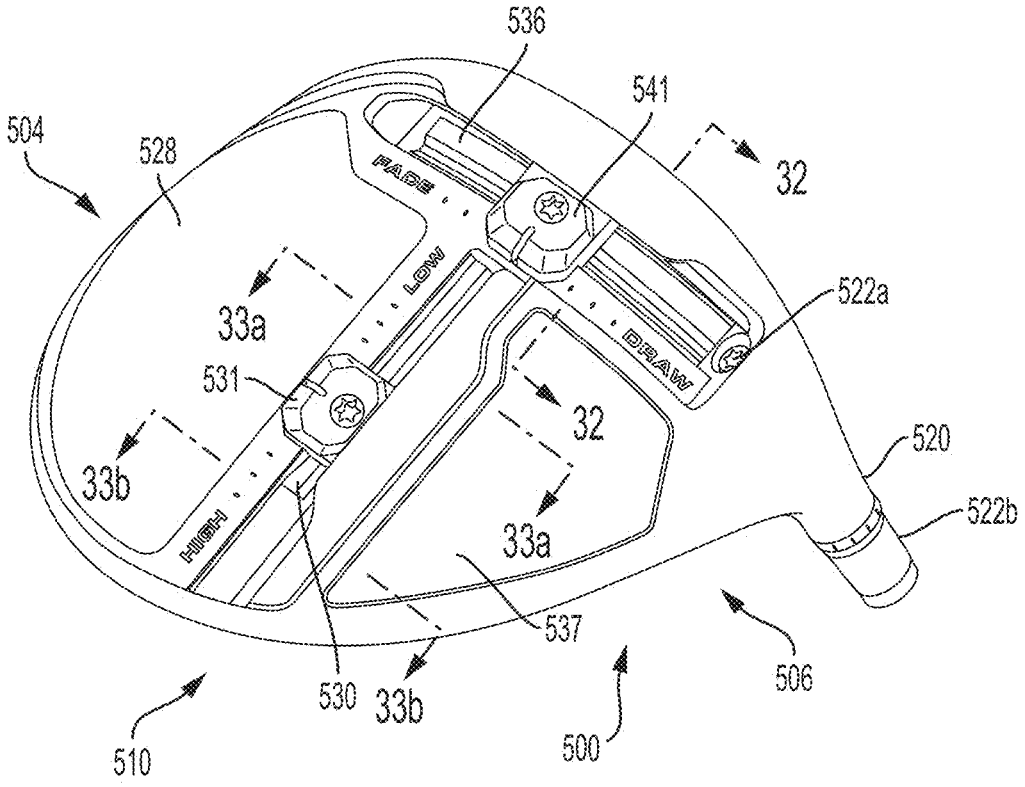
FIG. 26 is a bottom perspective view of the golf club head of FIG. 24, according to one or more examples of the present disclosure.

The bottom perspective view of FIG. 26 shows the head in one example having an adjustable FCT component 522*a*, 522*b*, as previously described, front-to-back weight track 530, and lateral weight track 536. The weight tracks 530, 536 preferably are an integral part of the frame formed by casting, metal stamping, or other known processes as described above with respect to the frame 24. The frame may be made from materials also described above with reference to frame 24 and other embodiments, but in one preferred embodiment may be made from a metal material or other material which provides a strong framework for the club head in areas of high stress. In contrast with the FIG. 2 embodiment, FIG. 26 illustrates that the sole has a heel-side portion 537 on the heel side of rear weight track 30 which may be an integral (preferably cast) part of the frame.

As described above, the lateral weight track 536 defines a track proximate and generally parallel to the face 502 for mounting one or more one-piece or multi-piece slidable weights 541. The weight(s) may be laterally adjusted in the heel-toe direction to modify the performance characteristics of the head as previously described. Similarly, the weight track 530 defines a front-to-back weight track for mounting one or more one-piece or multi-piece slidable weight(s) 531. The weight(s) 531 may be slidably adjusted fore and aft to shift the CG of the club head in the front-to-rear direction, as previously described, and thereby modify the performance characteristics of the head (especially spin characteristics and height of golf balls launched by the head). FIG. 26 also illustrates that the sole 512 includes a sole insert 528 located on a toe-side of the sole and one side of the weight track 530. The sole insert 528 (as well as the crown insert 516) may be made from a lightweight material as, for example, one of the polymers described above and in one preferred example one of the polysulfone compositions. The sole insert covers a portion of the sole's surface area as, for example, at least 10%, at least 20%, at least 40% or at least 50% of the total sole surface area, and may be located entirely on one side of the weight track 530.

Figure 27:
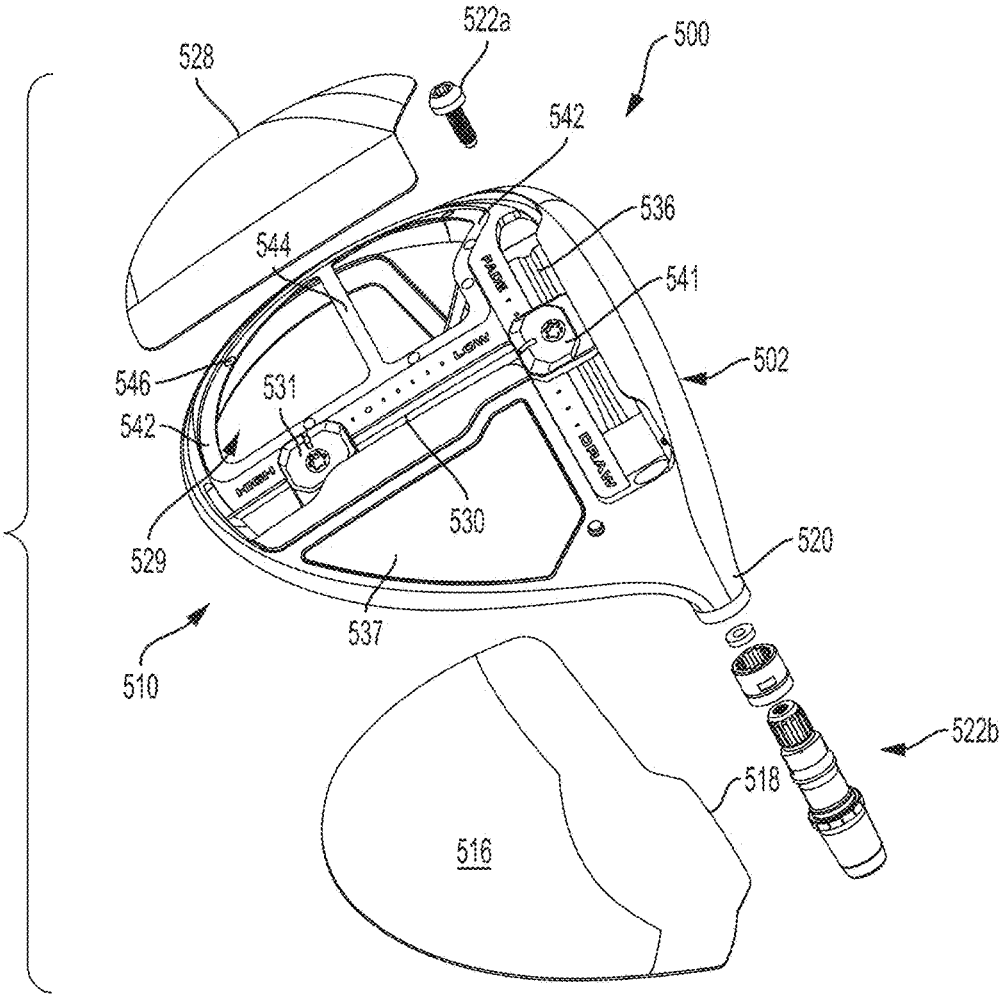
FIG. 27 is a bottom perspective exploded view of the golf club head of FIG. 24, according to one or more examples of the present disclosure.

FIG. 27 is an exploded view of the head 500 showing the crown insert 516 and sole insert 528 separated from the frame of the head. The frame provides an opening 529 in the sole which reduces the mass of the head's frame or skeletal support structure. The frame includes a recessed ledge 542 along the periphery of the opening 529, and cross-support 544 to seat and support the sole insert 528. The sole insert 528 has a geometry and size compatible with the opening 529, and may be secured to the frame by adhesion or other secure fastening technique so as to cover the opening 529. The ledge 542 may be provided with indentations 546 along its length to receive matching protrusions or bumps on the underside of the sole insert 528 to further secure and align the sole insert on the frame.

FIG. 27 provides a more detailed illustration of FCT component 522*b*, which is secured to the hosel 520 by FCT component 522*a*. Component 522*b* mounts the golf shaft to the head and may be adjustably rotated to change the orientation of the club head relative to a standard address position of the golf shaft.

Figure 28:
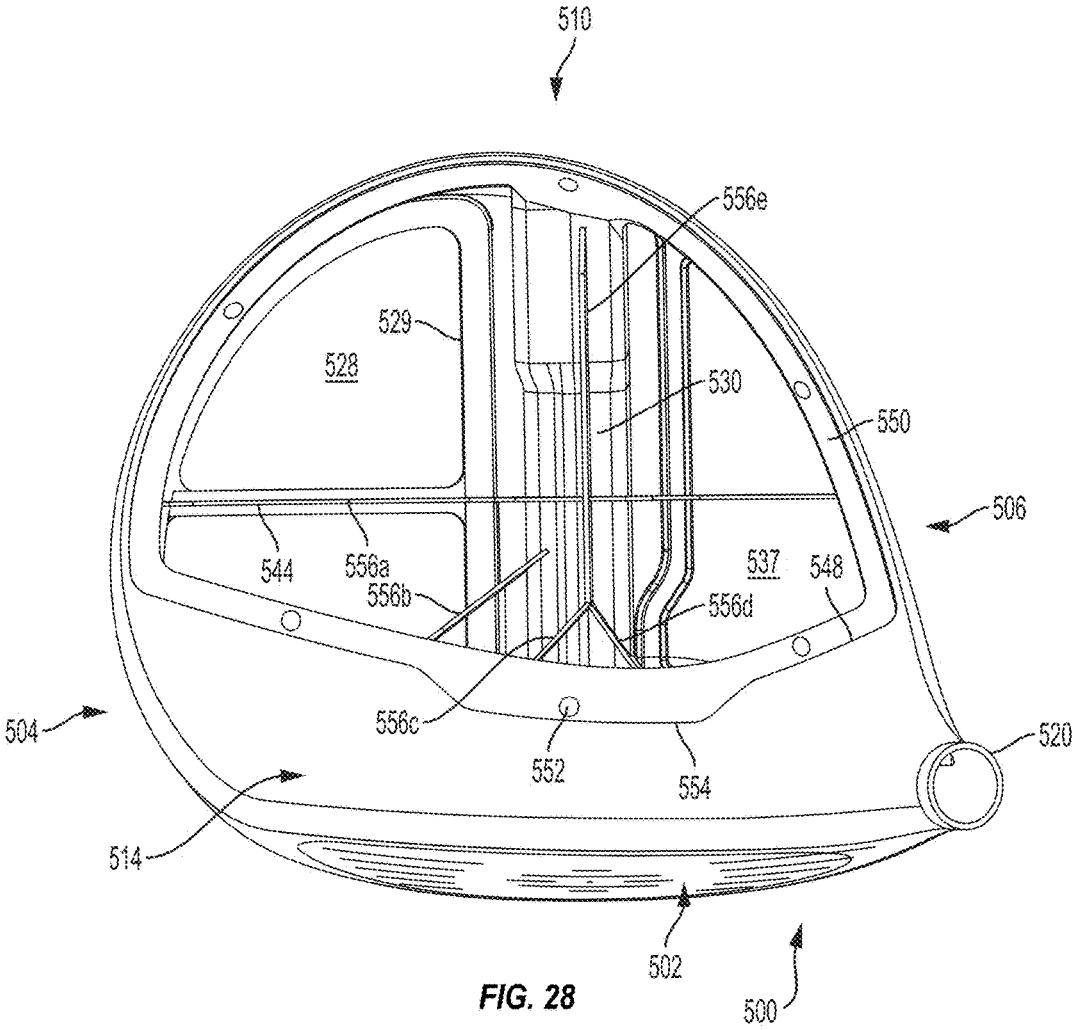
FIG. 28 is a top plan view of the golf club head of FIG. 24, shown with a crown insert removed, according to one or more examples of the present disclosure.

FIG. 28 is a top plan view of the head with the crown insert 516 removed, revealing internal structural elements of the head and its frame. Like the sole, the crown also has an opening 548 which reduces the mass of the frame, and more significantly, reduces the mass of the crown, a region of the head where increased mass has the greatest impact on raising (undesirably) the CG of the head. Along the periphery of the opening 548, the frame includes a recessed ledge 550 to seat and support the crown insert 516. The crown insert 516 (not shown in FIG. 28) has a geometry and size compatible with the crown opening 548 and may be secured to the frame by adhesion or other secure fastening technique so as to cover the opening 548. The ledge 550 may be provided with indentations 552 along its length to receive matching protrusions or bumps on the underside of the crown insert to further secure and align the crown insert on the frame. As with the sole insert, the ledge 550 alternately may be provided with protrusions to match indentations provided on the crown insert.

Typically, the ledge 550 may be made from the same metal material (e.g., titanium alloy) as the body and, therefore, can add significant mass to the golf club head 500. In some embodiments, in order to control the mass contribution of the ledge 550 to the golf club head 500, the width W can be adjusted to achieve a desired mass contribution. In some embodiments, if the ledge 550 adds too much mass to the golf club head 500, it can take away from the decreased weight benefits of a crown insert 516 made from a lighter composite material (e.g., carbon fiber or graphite). In some embodiments, the width of the ledge 550 may range from about 3 mm to about 8 mm, preferably from about 4 mm to about 7 mm, and more preferably from about 5.5 mm to about 6.5 mm. In some embodiments, the width of the ledge may be at least four times as wide as a thickness of the crown insert. In some embodiments, the thickness of the ledge 550 may range from about 0.4 mm to about 1 mm, preferably from about 0.5 mm to about 0.8 mm, and more preferably from about 0.6 mm to about 0.7 mm. In some embodiments, the depth of the ledge 550 may range from about 0.5 mm to about 1.75 mm, preferably from about 0.7 mm to about 1.2 mm, and more preferably from about 0.8 mm to about 1.1 mm. Although the ledge 550 may extend or run along the entire interface boundary between the crown insert 516 and the golf club head 500, in alternative embodiments, it may extend only partially along the interface boundary.

The periphery of opening 548 is proximate to and closely tracks the periphery of the crown on the toe-, aft-, and heel-sides of the head. The face-side of the opening 548 preferably is spaced farther from the face 502 (i.e., forward-most region of the head) than the heel-, toe- and aft-sides of the opening are spaced from the skirt of the head. In this way, the head has additional frame mass and reinforcement in the crown area just rearward of the face 502. This area and other areas adjacent to the face along the toe, heel and sole support the face and are subject to the highest impact loads and stresses due to ball strikes on the face. As previously described, the frame may be made of a wide range of materials, including high strength titanium, titanium alloys, or other metals.

The opening 548 has a notch 554 which matingly corresponds to the crown insert notch 518 to help align and seat the crown insert on the crown.

FIG. 28 also illustrates sole insert opening 529, interior surface of sole insert 528, cross support 544, interior surface of front-to-back weight track 530, and interior surface of the heel-side sole portion 537. Various ribs 556*a, b, c, d, e, f* are shown located in the interior of the head to provide structural reinforcement and acoustic-modifying elements.

Figure 29:
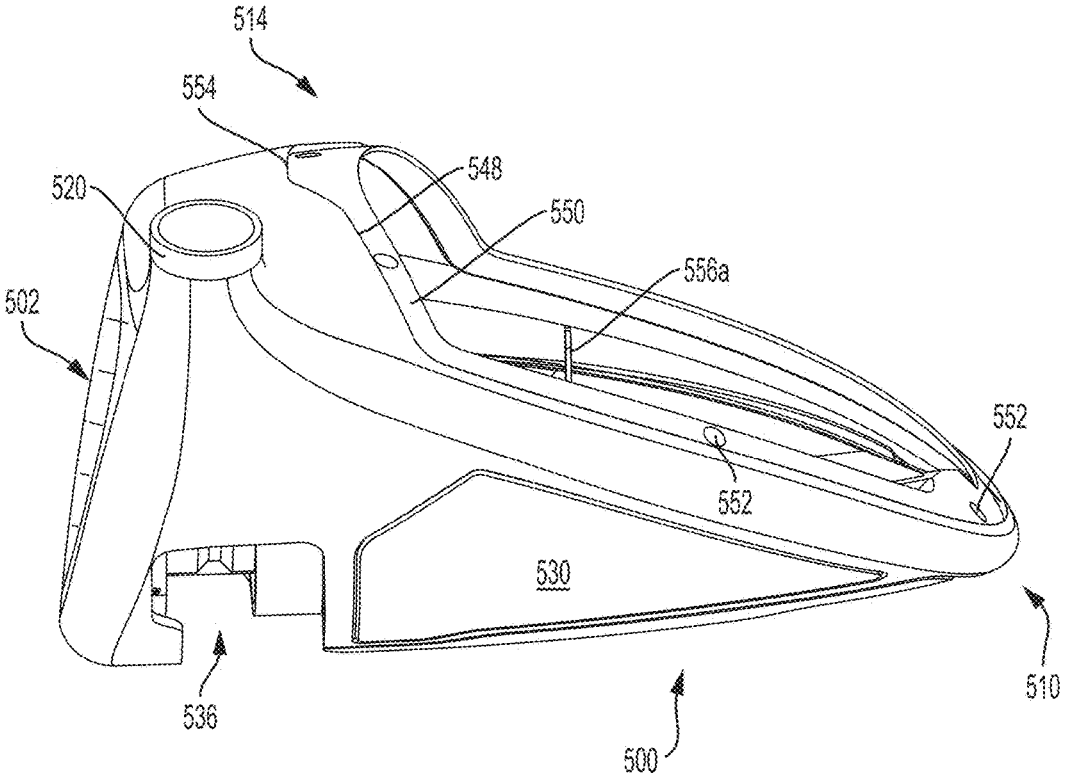
FIG. 29 is a side elevation view of the golf club head of FIG. 24, shown with the crown insert removed, according to one or more examples of the present disclosure.

FIG. 29 is a side elevation view with the crown insert removed. It illustrates how the sole wraps upon the heel-side of the head to meet the crown 514 at the skirt interface between the sole and crown. The crown opening 548 is shown encompassing a substantial portion of the surface area of the crown, such as well over 50% of the crown's surface area in the illustrated example.

Figure 30:
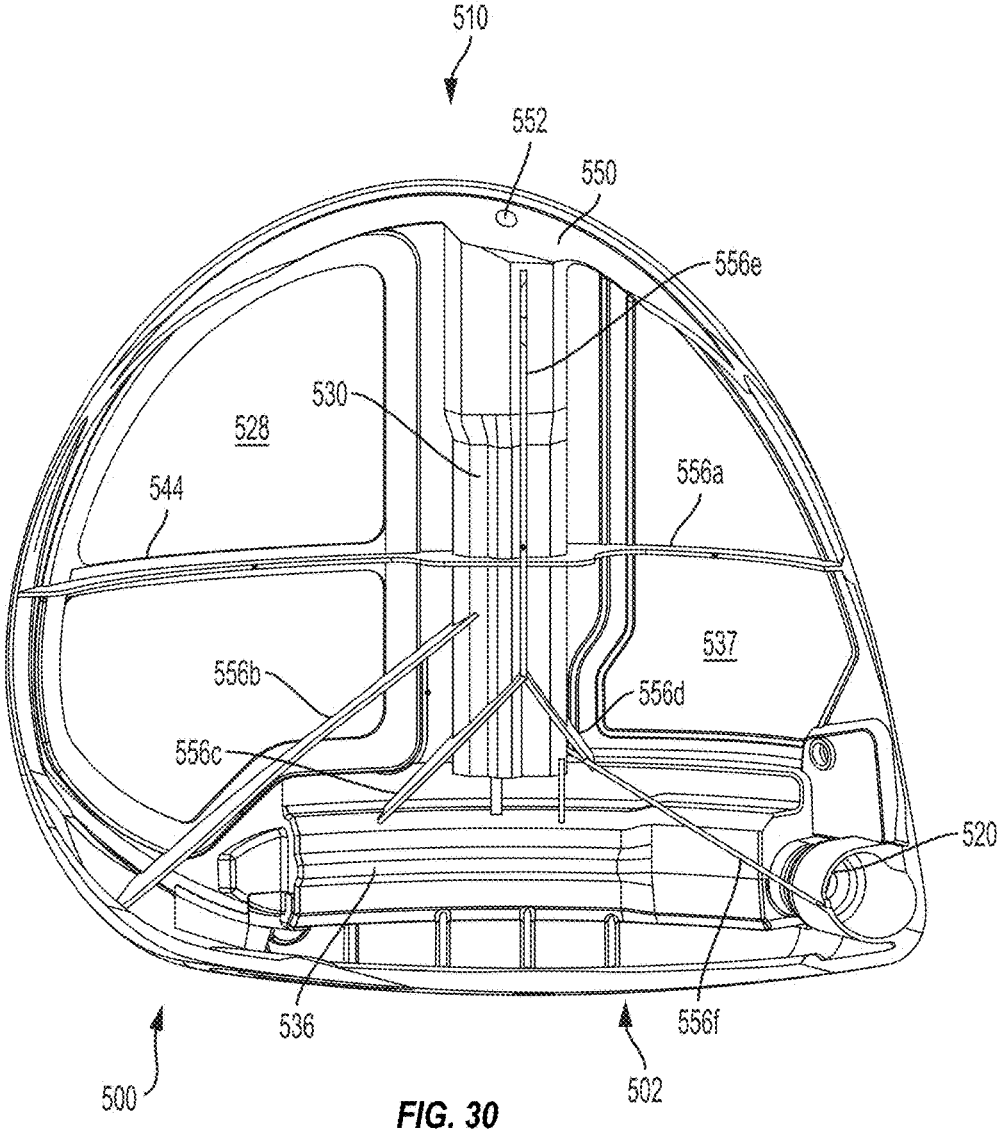
FIG. 30 is a cross-sectional top plan view of the golf club head of FIG. 24 taken along line 30-30 of FIG. 25, according to one or more examples of the present disclosure.

FIG. 30 is a horizontal cross-section of the club, below the level of the crown, showing some of the internal structure apparent in FIG. 28 but in more detail. Cross rib 556 spans the internal width of the head from toe to heel and braces weight track 530. Rib 556*e* extends in the fore-to-aft direction and may be secured to a top interior surface of weight track 530. Diagonal ribs 556*c, d* are secured at opposite ends to the weight tracks 530, 536. An additional rib 556*f* is shown joined to the hosel 520 at one end and to the weight track 530 at the other end.

Figure 31:
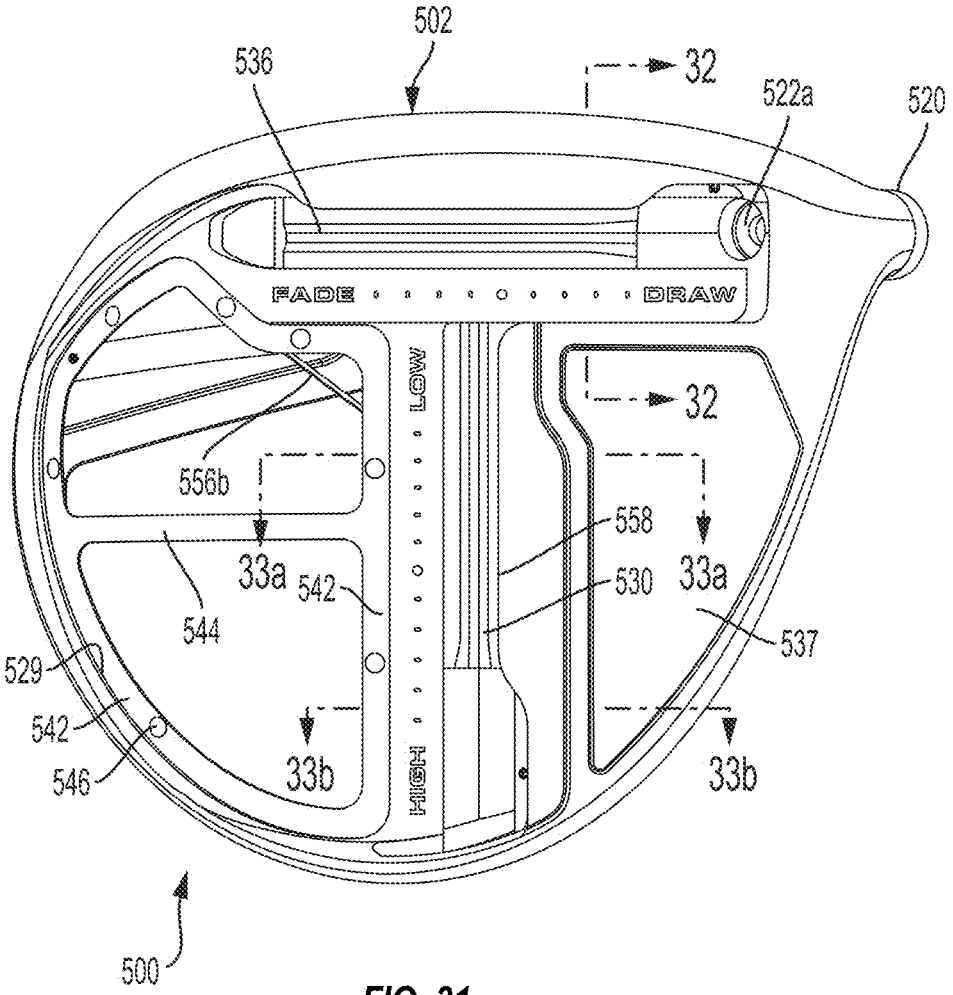
FIG. 31 is a bottom plan view of the golf club head of FIG. 24, shown with a sole insert panel removed, according to one or more examples of the present disclosure.

FIG. 31 is a bottom plan view of the head with the sole insert removed. With reference to FIGS. 26 and 31, and explained further below, the sole of the present embodiment is a two tier or drop sole construction, in which one portion of the sole is dropped or raised, depending on perspective, relative to the other portion of the sole. The sole insert 528 on the toe-side of the weight track 530 is raised (when the club head is in the address position) relative to the heel-side portion 537 of the sole. The heel-side portion 537 also can be considered a drop sole part of the sole, since it is dropped or closer to the ground when the club head is in the address position. The heel-side portion 537 has an edge or portion 558 which extends over or overhangs a portion of the weight track 530. Though the front-to-back weight(s) are not shown in FIG. 31, it will be appreciated that the overhang portion 558 helps to capture the weight(s) in the weight track 530 by providing a narrow opening or channel through which the weights may be inserted into or removed from the weight track. At the same time, the weight(s) are free to be slidably moved and re-set in the weight track by loosening and then tightening the adjustment screw (see FIG. 26) which secures the weight(s) to the weight track.

Figure 32:
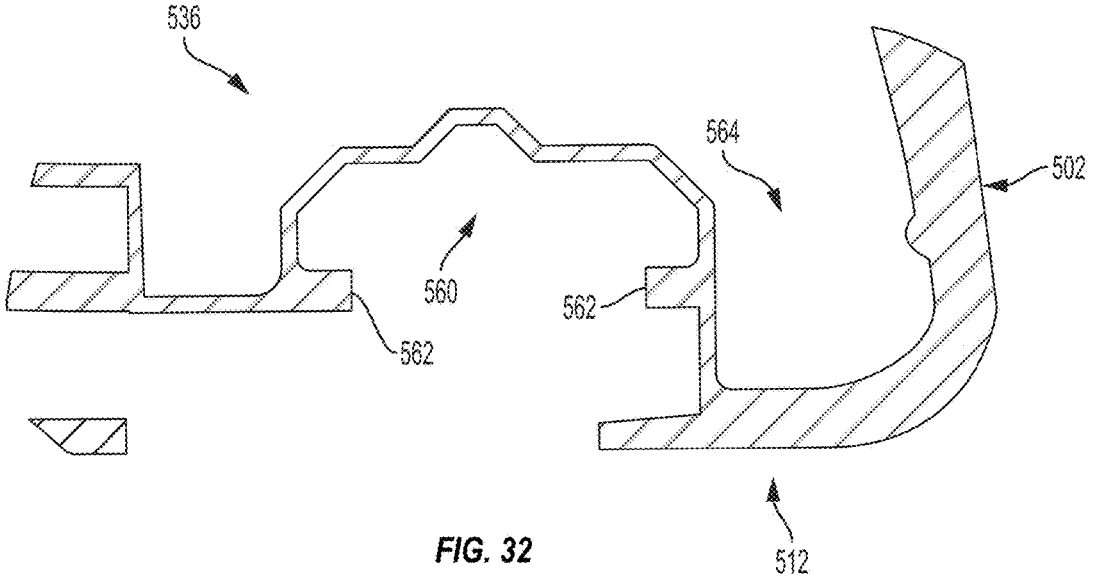
FIG. 32 is a cross-sectional view of a detail of a side-to-side weight track of the golf club head of FIG. 24 taken along line 32-32 of FIG. 31, according to one or more examples of the present disclosure.

FIG. 32 is a fore-aft vertical cross-section of lateral weight track 536 taken along line 32-32 of FIG. 31. The weight track 536 includes a laterally (heel-toe) extending channel 560 to receive one or more compatibly shaped one-piece or multi-piece weights (not shown) for adjustable sliding movement in the heel-toe direction. Opposing rails or lips 562 help retain the weight(s) in the channel. The weight track extends generally parallel and proximate to the face 502 but preferably is set back from the face by a laterally extending recess 564.

Figure 33A:
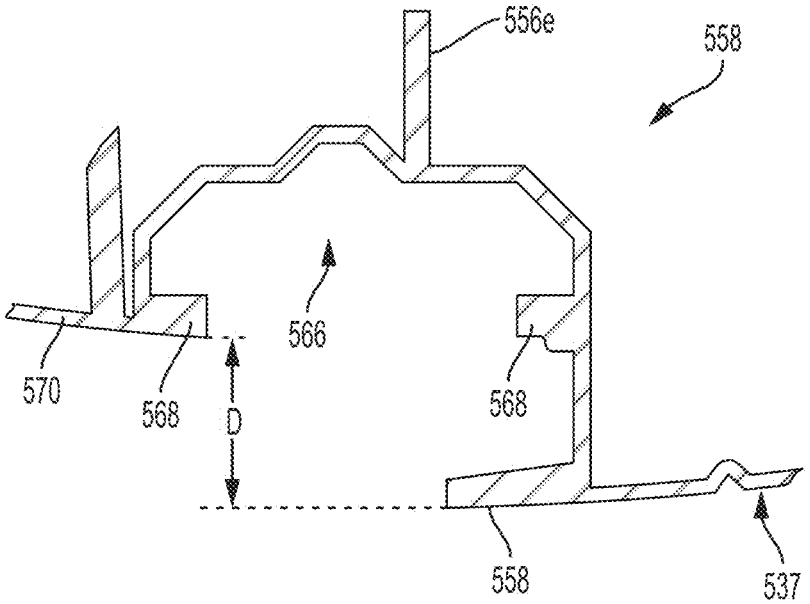
FIGS. 33*a* and 33*b* are cross-sectional views of details of the golf club head of FIG. 24 taken along line 33*a*-33*a* and line 33*b*-33*b*, respectively, of FIG. 31.
Figure 33B:
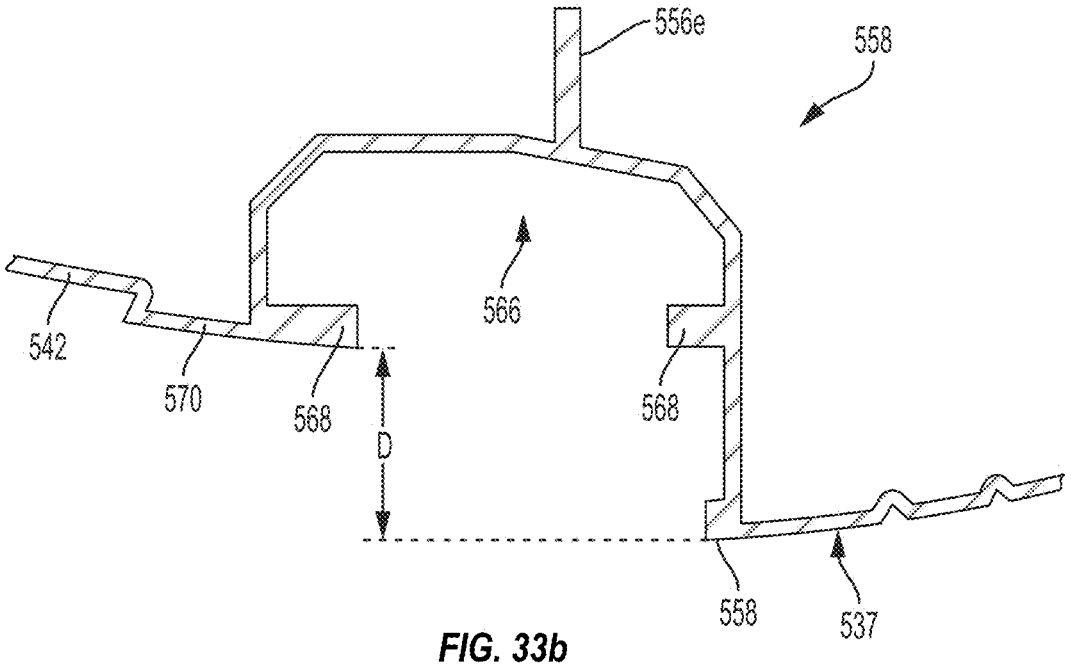

FIGS. 33*a* and 33*b* are lateral cross-sections of fore-aft weight track 558 taken along different vertical planes, represented by lines 33*a*-33*a* and 33*b*-33*b* in FIG. 31. The weight track 558 includes a fore-aft (or front-rear) extending channel 566 to receive one or more compatibly shaped one-piece or multi-piece weights (not shown) for adjustable sliding movement in the fore-aft or front-back direction. Like track 536, the track 558 includes opposing rails or lips 568 to retain and guide the weights (when adjusted) in the channel. In this regard, each weight has portions (in a one-piece construction) or different pieces (in a multi-piece weight) seated on each side of the rails 568. Thus, the rails retain or seat the weight(s) while allowing the weight(s) to slide within the track when a securing fastener is loosened.

In FIG. 33*a* it can be seen that the overhang portion 558 of the heel-side sole portion 537 extends over or overhangs the channel 566 to restrict the mouth of the channel and help retain the weight(s) within the channel. FIGS. 31 and 33*b* illustrate that the overhang portion 558 tapers or narrows as it approaches the aft portion of the sole, such that the heel-side sole portion's amount of overhang or cantilevering over the channel 566 is much smaller than is the case in FIG. 33*a* (where the channel 566 is closer to the face).

The head's sole has a centrally-located fore-aft extending section 570 adjacent the weight track 558, which may be marked with weight track indicia (such as "high" to "low" ball flight) as shown in FIG. 31. The section 570 may sit flush with the sole insert 528 and be formed as an integral part of the head frame. As shown in FIG. 33*b*, the sole section 570 terminates at the sole insert receiving ledge 542.

Referring to FIGS. 33*a* and 33*b*, the sole area on the heel side (represented by heel-side sole portion 537) is lower than the sole area on the toe side (represented by section 570 and sole insert 528 (FIG. 26)) by a distance "D" when the head is in the address position relative to a ground plane. The head has a "drop sole" construction with a portion of the sole dropped (preferably on the heel side) relative to another portion of the sole (preferably on the toe side). Put another way, a portion of the sole (e.g., toe side) is raised relative to another portion of the sole (e.g., heel side).

In one embodiment, the drop distance "D" may be in the range of about 2-12 mm, preferably about 3-9 mm, more preferably about 4-7 mm, and most preferably about 4.5-6.5 mm. In one example, the drop distance "D" may be about 5.5 mm.

The bi-level or drop sole described is counterintuitive because the raised portion of the sole is tends to raise the CG of the club, which generally is disadvantageous. However, by using a sole insert made of a relatively light material such as composite material or other polymeric material (polysulfone for example), the higher CG effect is mitigated while maintaining a stronger, heavier material on the heel side of the sole to promote a lower CG and provide added strength in the area of the sole where it is most needed (i.e., in a sole region proximate to the hosel, shaft connection and FCT components where stress is high). Additionally, the drop sole allows for a smaller radius for a portion of the sole resulting in better acoustic properties due to the increased stiffness from the geometry. This stiffness increase means fewer ribs or even no ribs are needed to achieve a first mode frequency at 3400 Hz or above. Fewer ribs provides a weight savings which allows for more discretionary mass that can be strategically placed elsewhere in the club head or incorporated into a user adjustable movable weight.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head, comprising:

a body, defining an interior cavity and comprising:

a sole portion, positioned at a bottom portion of the golf club head;

a crown portion, positioned at a top portion of the golf club head, wherein an entirety of an exterior surface of the crown portion is convex;

a skirt portion, positioned around a periphery of the golf club head between the sole portion and the crown portion;

a forward region; and a rearward region; and a face portion, coupled to the body at the forward region of the body and comprising a striking face with an area of at least 3500 mm^2 and a maximum height from a ground plane of at least about 50 mm;

wherein there is a face-to-crown transition where the face portion connects to the crown portion proximate the forward region of the body and a skirt-to-crown transition where the skirt portion connects to the crown portion proximate the rearward region;

wherein in a y-z plane passing through a club head origin the crown height continuously increases starting from the face-to-crown transition up to a local maximum; and wherein:

the golf club head has a peak crown height, from the ground plane, of at least about 60 mm;

a volume of the golf club head is at least about 370 $cm^3$;

a location of a center-of-gravity of the golf club head is at a minimum distance (Zup) away from the ground plane;

the difference between the Zup and half of the peak crown height is less than about −5.75 mm;

a z-axis moment of inertia of the golf club head about a z-axis, passing through the center-of-gravity of the golf club head and perpendicular to the ground plane, is greater than about 300 kg-$mm^2$; and when the golf club head is in the address position on the ground plane:

a crown height of the golf club head, at a head origin y-axis coordinate of zero, is less than 65 mm;

a crown height of the golf club head, at a head origin y-axis coordinate of 20 mm, is more than about 62 mm; and a crown height of the golf club head, at a head origin y-axis coordinate of 90 mm, is less than about 32 mm.

2. The golf club head of claim 1, wherein the difference between the Zup and half of the peak crown height is less than about −6.0 mm.

3. The golf club head of claim 1, wherein:

the crown portion of the body is made from a first non-metal material; and at least one of the sole portion or the skirt portion of the body are made from a second material, the second material being different from the first non-metal material.

4. The golf club head of claim 1, wherein an overall forward-to-rearward depth of the golf club head is greater than about 85 mm.

5. The golf club head of claim 1, further comprising a coefficient of restitution (COR) feature located on the sole portion of the body of the golf club head.

6. The golf club head of claim 5, wherein the COR feature is a through-slot.

7. The golf club head of claim 5, wherein the COR feature is a channel.

8. The golf club head of claim 7, further comprising:

at least one ledge extending within the channel; and at least one weight member movably positioned within the channel and configured to clamp the at least one ledge at two or more positions along the channel.

9. The golf club head of claim 1, wherein:

a ratio of the peak crown height to a height of a forward-most point of the crown portion from the ground plane, when the golf club head is in the address position on the ground plane, is greater than about 1.12; and a ratio of the peak crown height to a height of a rearwardmost point of the crown portion from the ground plane, when the golf club head is in the address position on the ground plane, is greater than about 3.3.

10. The golf club head of claim 1, wherein a crown height, in millimeters, of at least 90% of the crown portion of the golf club head along a plane passing through a center of the striking face of the face portion and perpendicular to the ground plane, when the golf club head is in the address position on the ground plane, is approximately between, $-130.73x^4+270.76x^3-269.99x^2+91.737x+59$ and $-107.96x^4+223.87x^3-250.86x^2+92.751x+50$, where x is a normalized forward-to-rearward depth of the golf club head.

11. The golf club head of claim 10, wherein the crown height, in millimeters, of at least 95% of the crown portion of the golf club head along the plane passing through the center of the striking face of the face portion and perpendicular to the ground plane, when the golf club head is in the address position on the ground plane, is approximately between, $-130.73x^4+270.76x^3-269.99x^2+91.737x+59$ and $-107.96x^4+223.87x^3-250.86x^2+92.751x+50$, where x is the normalized forward-to-rearward depth of the crown portion of the golf club head.

12. The golf club head of claim 1, wherein the golf club head has a crown height no less than 11 mm measured from the ground plane at a midplane of the golf club head.

13. The golf club head of claim 12, wherein the golf club head has a minimum crown height less than 20 mm measured from the ground plane at the midplane of the golf club head.

14. The golf club head of claim 1, further comprising a flight control technology component coupled to the body, wherein the flight control technology component is configured to receive a shaft and to selectively adjust an orientation of the shaft relative to the head.

15. A golf club head, comprising:

a body, defining an interior cavity and comprising:

a sole portion, positioned at a bottom portion of the golf club head;

a crown portion, positioned at a top portion of the golf club head, wherein an entirety of an exterior surface of the crown portion is convex;

a skirt portion, positioned around a periphery of the golf club head between the sole portion and the crown portion;

a forward region; and a rearward region; and a face portion, coupled to the body at the forward region of the body and comprising a striking face with an area of at least 3500 mm^2 and a maximum height from a ground plane of at least about 50 mm;

wherein there is a face-to-crown transition where the face portion connects to the crown portion proximate the forward region of the body and a skirt-to-crown transition where the skirt portion connects to the crown portion proximate the rearward region;

wherein in a y-z plane passing through a club head origin the crown height continuously increases starting from the face-to-crown transition up to a local maximum;

wherein:

the golf club head has a peak crown height, from the ground plane, of at least about 60 mm;

a volume of the golf club head is at least about 370 $cm^3$;

a location of a center-of-gravity of the golf club head is at a minimum distance (Zup) away from the ground plane;

the difference between the Zup and half of the peak crown height is less than about −5.75 mm;

a z-axis moment of inertia of the golf club head about a z-axis, passing through the center-of-gravity of the golf club head and perpendicular to the ground plane, is greater than about 300 kg-$mm^2$;

a ratio of the peak crown height to a height of a forwardmost point of the crown portion from the ground plane, when the golf club head is in the address position on the ground plane, is greater than about 1.12; and a ratio of the peak crown height to a height of a rearwardmost point of the crown portion from the ground plane, when the golf club head is in the address position on the ground plane, is greater than about 3.3.

16. The golf club head of claim 15, wherein:

the crown portion of the body is made from a first non-metal material; and at least one of the sole portion or the skirt portion of the body are made from a second material, the second material being different from the first non-metal material.

17. The golf club head of claim 15, further comprising a coefficient of restitution (COR) feature located on the sole portion of the body of the golf club head.

18. A golf club head, comprising:

a body, defining an interior cavity and comprising:

a sole portion, positioned at a bottom portion of the golf club head;

a crown portion, positioned at a top portion of the golf club head, wherein an entirety of an exterior surface of the crown portion is convex;

a skirt portion, positioned around a periphery of the golf club head between the sole portion and the crown portion;

a forward region; and a rearward region; and a face portion, coupled to the body at the forward region of the body and comprising a striking face with an area of at least 3500 mm^2 and a maximum height from a ground plane of at least about 50 mm;

wherein there is a face-to-crown transition where the face portion connects to the crown portion proximate the forward region of the body and a skirt-to-crown transition where the skirt portion connects to the crown portion proximate the rearward region;

wherein in a y-z plane passing through a club head origin the crown height continuously increases starting from the face-to-crown transition up to a local maximum;

wherein:

the golf club head has a peak crown height, from the ground plane, of at least about 60 mm;

a volume of the golf club head is at least about 370 $cm^3$;

a location of a center-of-gravity of the golf club head is at a minimum distance (Zup) away from the ground plane;

the difference between the Zup and half of the peak crown height is less than about −5.75 mm;

a z-axis moment of inertia of the golf club head about a z-axis, passing through the center-of-gravity of the golf club head and perpendicular to the ground plane, is greater than about 300 kg-$mm^2$; and a crown height, in millimeters, of at least 90% of the crown portion of the golf club head along a plane passing through a center of the striking face of the face portion and perpendicular to the ground plane, when the golf club head is in the address position on the ground plane, is approximately between, $-130.73x^4+270.76x^3-269.99x^2+91.737x+59$ and $-107.96x^4+223.87x^3-250.86x^2+92.751x+50$, where x is a normalized forward-to-rearward depth of the golf club head.

19. The golf club head of claim 18, wherein:

the crown portion of the body is made from a first non-metal material; and at least one of the sole portion or the skirt portion of the body are made from a second material, the second material being different from the first non-metal material.

20. The golf club head of claim 18, further comprising a coefficient of restitution (COR) feature located on the sole portion of the body of the golf club head.

21. The golf club head of claim 20, wherein the COR feature is a channel.

22. The golf club head of claim 21, further comprising:

at least one ledge extending within the channel; and at least one weight member movably positioned within the channel and configured to clamp the at least one ledge at two or more positions along the channel.

23. A golf club head, comprising:

a body, defining an interior cavity and comprising:

a sole portion, positioned at a bottom portion of the golf club head;

a crown portion, positioned at a top portion of the golf club head, wherein an entirety of an exterior surface of the crown portion is convex;

a skirt portion, positioned around a periphery of the golf club head between the sole portion and the crown portion;

a forward region; and a rearward region; and a face portion, coupled to the body at the forward region of the body and comprising a striking face with an area of at least 3500 mm^2 and a maximum height from a ground plane of at least about 50 mm;

wherein there is a face-to-crown transition where the face portion connects to the crown portion proximate the forward region of the body and a skirt-to-crown transition where the skirt portion connects to the crown portion proximate the rearward region;

wherein in a y-z plane passing through a club head origin the crown height continuously increases starting from the face-to-crown transition up to a local maximum; and wherein:

the golf club head has a peak crown height, from the ground plane, of at least about 60 mm;

a volume of the golf club head is at least about 370 $cm^3$;

a location of a center-of-gravity of the golf club head is at a minimum distance (Zup) away from the ground plane;

the difference between the Zup and half of the peak crown height is less than about −5.75 mm; and a z-axis moment of inertia of the golf club head about a z-axis, passing through the center-of-gravity of the golf club head and perpendicular to the ground plane, is greater than about 300 kg-$mm^2$.

* * * * *